US008175316B2

(12) United States Patent
Yamagishi et al.

(10) Patent No.: US 8,175,316 B2
(45) Date of Patent: May 8, 2012

(54) EAR SPEAKER DEVICE

(75) Inventors: Makoto Yamagishi, Tokyo (JP); Hideki Seki, Saitama (JP); Noriyuki Hiyama, Kanagawa (JP); Yukimasa Yamaguchi, Tokyo (JP); Takeshi Hara, Kanagawa (JP)

(73) Assignee: Sony Corporation, Tokyo (JP)

( * ) Notice: Subject to any disclaimer, the term of this patent is extended or adjusted under 35 U.S.C. 154(b) by 1168 days.

(21) Appl. No.: 11/998,923

(22) Filed: Dec. 3, 2007

(65) Prior Publication Data

US 2008/0253604 A1 Oct. 16, 2008

(30) Foreign Application Priority Data

Dec. 5, 2006 (JP) ..... P2006-328604
Dec. 5, 2006 (JP) ..... P2006-328606
Dec. 5, 2006 (JP) ..... P2006-328608
Dec. 8, 2006 (JP) ..... P2006-332216

(51) Int. Cl.
*H04R 25/00* (2006.01)
*H04R 5/02* (2006.01)
*H04R 1/02* (2006.01)

(52) U.S. Cl. ..... 381/382; 381/371; 381/309; 381/349; 381/374; 381/370; 381/339

(58) Field of Classification Search ..... 381/382, 381/371, 309, 349, 374, 370, 339
See application file for complete search history.

(56) References Cited

U.S. PATENT DOCUMENTS

| | | | | |
|---|---|---|---|---|
| 1,321,265 | A * | 11/1919 | Wagner | 381/338 |
| 1,579,412 | A | 4/1926 | Stenberg | |
| 3,592,978 | A | 7/1971 | Hess | |
| 4,110,583 | A | 8/1978 | Lepper | |
| 4,309,575 | A | 1/1982 | Zweig et al. | |
| 6,097,827 | A * | 8/2000 | Yang | 381/375 |
| 6,301,367 | B1 | 10/2001 | Boyden et al. | |
| 6,307,943 | B1 * | 10/2001 | Yamagishi | 381/312 |
| 6,603,863 | B1 | 8/2003 | Nagayoshi | |
| D586,778 | S * | 2/2009 | Yang | D14/205 |
| 7,697,710 | B2 * | 4/2010 | Yang | 381/382 |
| 2004/0264727 | A1 | 12/2004 | Kim | |
| 2007/0286446 | A1 * | 12/2007 | Yang | 381/382 |
| 2009/0047905 | A1 * | 2/2009 | Yang | 455/41.3 |

FOREIGN PATENT DOCUMENTS

DE 25 25 642 1/1976

(Continued)

*Primary Examiner* — Ngan Ngo
(74) *Attorney, Agent, or Firm* — Frommer Lawrence & Haug LLP; William S. Frommer; Paul A. Levy

(57) ABSTRACT

An ear speaker device includes an electroacoustic transducer including a housing mounted at a predetermined position of listener's head, a speaker unit mounted on one surface in the housing, and positioned away from an entrance of the listener's external acoustic meatus for a predetermined distance when the housing is mounted on the listener's head, and a tubular duct extended so as to allow a sound generated by the housing in the inner space thereof to reach the vicinity of the entrance of the listener's external acoustic meatus, and a hole for emitting sound of the duct is oriented to the opposite direction with respect to the entrance of the external acoustic meatus; and a mounting part used for mounting the electroacoustic transducer on the listener's head in a manner that the predetermined distance is provided between the speaker unit and the entrance of the listener's external acoustic meatus.

7 Claims, 59 Drawing Sheets

FOREIGN PATENT DOCUMENTS

| | | |
|---|---|---|
| DE | 20 2004 003 078 | 7/2005 |
| EP | 0 360 517 | 3/1990 |
| EP | 1 130 880 | 9/2001 |
| GB | 1 544 234 | 4/1979 |
| JP | 52 68401 | 6/1977 |
| JP | 57 150299 | 9/1982 |
| JP | 57 160283 | 10/1982 |
| JP | 59 69589 | 5/1984 |
| JP | 60 66194 | 5/1985 |
| JP | 3 117999 | 5/1991 |
| JP | 3 162099 | 7/1991 |
| JP | 3 109494 | 11/1991 |
| JP | 4 227396 | 8/1992 |
| JP | 7 264699 | 10/1995 |
| JP | 10 174187 | 6/1998 |
| JP | 3054295 | 4/2000 |
| JP | 2002 78058 | 3/2002 |
| JP | 2003 18693 | 1/2003 |
| JP | 2005 501496 | 1/2005 |
| JP | 2005 117594 | 4/2005 |
| JP | 2006 86980 | 3/2006 |
| JP | 2006 287674 | 10/2006 |
| WO | WO 97 11573 | 3/1997 |
| WO | WO 03 019978 | 3/2003 |
| WO | WO 2004 052050 | 6/2004 |
| WO | WO 2004 112423 | 12/2004 |
| WO | WO 2005 029909 | 3/2005 |
| WO | WO 2005 053354 | 6/2005 |

* cited by examiner

EAR SPEAKER DEVICE

CROSS REFERENCES TO RELATED APPLICATIONS

The present invention contains subject matter related to Japanese Patent Applications JP2006-328604, JP2006-328606, JP2006-328608 filed in the Japanese Patent Office on Dec. 5, 2007, and Japanese Patent Application JP2006-332216 filed in the Japanese Patent Office on Dec. 8, 2007, the entire contents of which being incorporated herein by reference.

BACKGROUND OF THE INVENTION

1. Field of the Invention

This invention relates to an ear speaker device, and is desirably applied to a head-mounted wearable speaker device.

2. Description of the Related Art

As a headphone device being one example of a head-mounted wearable speaker device, there are widely diffused devices which are mounted to the head of the listener, and convert an audio signal representing a reproduced sound etc. of a compact disc (CD) to a sound (referred to as reproduced sound, hereinafter), and make the listener listen to the reproduced sound.

In the headphone device generally used, a speaker unit that generates the reproduced sound is positioned in the vicinity of the front of an entrance of an external acoustic meatus of the listener. Although a sound is allowed to reach an eardrum directly from the speaker unit to possibly improve sound quality, a sound image is localized in the head of the listener and this has provided an unnatural impression to the listener.

For the above reason, there has been devised the headphone device in which the speaker unit is positioned at a location somewhat distant from the entrance of the external acoustic meatus (ear hole) and closer to a parietal region. In this manner, the sound image is localized outside the head just like a general stationary speaker to remove the unnaturalness. At the same time, the headphone device is made as a closed type to form enclosed space around an ear of the listener in consideration of making the listener capable of listening to a low-pitched sound sufficiently (For example, refer to Jpn. Pat. No. 3054295 [page 3, FIG. 1]).

SUMMARY OF THE INVENTION

Meanwhile, in thus configured headphone device, even if the speaker unit is positioned at a location somewhat distant from the entrance of the external acoustic meatus (ear hole) and closer to a parietal region, in case a reproduced sound etc. of contents to be listened to by the listener is emitted from a sound source of the stereo source, a sound image is localized in the head of the listener, and there is raised a problem that the unnaturalness is not removed.

With respect to the headphone device with the above configuration, it has been requested to provide the listener with a sense of liberation by making the headphone device to be an open type while excellent sound quality including a sufficient low-pitched sound is maintained. However, since the speaker unit is isolated from the ear hole, the sound quality becomes deteriorated with insufficient low frequencies when nothing further than changing the closed type to the open type is carried out, and there has been a problem that the above request is not fulfilled.

In view of the above-identified circumstances, it is therefore desirable to provide an ear speaker device that can provide natural sound image localization and make a listener listen to a reproduced sound of high quality.

According to an embodiment of the present invention, there is provided an ear speaker device, including: an electroacoustic transducer including a housing mounted at a predetermined position of the head of a listener, a speaker unit that is mounted on one surface in the housing, and is positioned away from an entrance of an external acoustic meatus of the listener for a predetermined distance when the housing is mounted on the head of the listener and in which a tubular duct that is extended so as to allow a sound generated by the housing in the inner space thereof to reach the vicinity of the entrance of the external acoustic meatus of the listener, and a hole for emitting sound of the duct is oriented to the opposite direction with respect to the entrance of the external acoustic meatus; and a mounting part that is used for mounting the electroacoustic transducer on the head of the listener in a manner that the predetermined distance is provided between the speaker unit and the entrance of the external acoustic meatus of the listener.

Accordingly, the middle-pitched and the high-pitched sounds output from the speaker unit of the electroacoustic transducer mounted to the head of the listener can be listened to by the listener, and it becomes difficult for the middle-pitched and the high-pitched sounds provided with the directivity which are slightly output from the hole of the tubular duct which is oriented to the opposite direction with respect to the entrance of the external acoustic meatus of the listener to reach the entrance of the external acoustic meatus of the listener, and only the low-pitched sound provided with no directivity which is generated in the inner space of the housing and output from the hole of the tubular duct can be listened to by the listener, which can provide natural sound image localization based on only the middle-pitched and the high-pitched sounds output from the speaker unit.

According to an embodiment of the present invention, there is also provided an ear speaker device, including: an electroacoustic transducer including a housing which is mounted at a predetermined position of the head of a listener and has an inner space, a speaker unit that is mounted on one surface in the housing, and is positioned away from an entrance of an external acoustic meatus of the listener for a predetermined distance when the housing is mounted on the head of the listener, and a tubular duct that is extended to the entrance of the external acoustic meatus of the listener, and emits a sound generated in the inside of the housing from a position closer to the entrance of the external acoustic meatus than the speaker unit; and a mounting part that is used for mounting the electroacoustic transducer on the head of the listener in a manner that the predetermined distance is provided between the speaker unit and the entrance of the external acoustic meatus of the listener.

Accordingly, the middle-pitched and the high-pitched sounds emitted from the speaker unit that is positioned away from the entrance of the external acoustic meatus for a predetermined distance can reach the inside of the external acoustic meatus, and also the low-pitched sound emitted from a position close to the entrance of the external acoustic meatus of the listener through the tubular duct can effectively reach the inside of the external acoustic meatus, which can make the listener listen to both the middle-pitched and the high-pitched sounds which can localize the sound image outside the head of the listener and the low-pitched sound which has the sound pressure level increased.

According to an embodiment of the present invention, there is also provided an ear speaker device, including: an electroacoustic transducer including a housing mounted at a predetermined position of the head of a listener, a speaker unit that is mounted on one surface in the housing, and is positioned away from an entrance of an external acoustic meatus of the listener for a predetermined distance when the housing is mounted on the head of the listener, and a tubular duct that is extended so as to allow a sound generated by the housing to reach the vicinity of the entrance of the external acoustic meatus of the listener; a mounting part that is used for mounting the electroacoustic transducer on the head of the listener in a manner that the predetermined distance is provided between the speaker unit and the entrance of the external acoustic meatus of the listener; and a rotation part that rotates the housing with respect to the mounting part so as to make one end of the tubular duct abut on the entrance of the external acoustic meatus of the listener.

Accordingly, a sound generated in the housing can reach the eardrum in the inside of the external acoustic meatus directly and stably from the vicinity of the entrance of the external acoustic meatus of the listener through the tubular duct, which can provide natural sound image localization as the open type, and make the listener stably listen to the sound of a sufficient level.

According to an embodiment of the present invention, there is also provided an ear speaker device, including: an electroacoustic transducer including a housing mounted at a predetermined position of the head of a listener, a speaker unit that is mounted on one surface in the housing, and is positioned away from an entrance of an external acoustic meatus of the listener for a predetermined distance when the housing is mounted on the head of the listener, a tubular duct that is extended so as to allow a sound generated by the housing to reach the vicinity of the entrance of the external acoustic meatus of the listener, and a microphone for the binaural recording which is attached to the vicinity of the speaker unit; and a mounting part that is used for mounting the electroacoustic transducer on the head of the listener in a manner that the predetermined distance is provided between the speaker unit and the entrance of the external acoustic meatus of the listener.

Accordingly, the binaural recording can be performed by gathering a sound from the sound source using the microphone for the binaural recording which is attached to the vicinity of the speaker unit from which the listener really listens to the reproduced sound, which can provide significantly natural sound image localization as compared with an ear speaker device in the past with respect to the reproduced sound, and make the listener listen to the sound of a sufficient level through the tubular duct.

According to the present invention, the middle-pitched and the high-pitched sounds output from the speaker unit of the electroacoustic transducer mounted to the head of the listener can be listened to by the listener, and it becomes difficult for the middle-pitched and the high-pitched sounds provided with the directivity which are slightly output from the hole of the tubular duct which is oriented to the opposite direction with respect to the entrance of the external acoustic meatus of the listener to reach the entrance of the external acoustic meatus of the listener, and only the low-pitched sound provided with no directivity which is generated in the inner space of the housing and output from the hole of the tubular duct can be listened to by the listener, which can provide natural sound image localization based on only the middle-pitched and the high-pitched sounds output from the speaker unit. Accordingly, it becomes possible to realize an ear speaker device that can provide natural sound image localization and make a listener listen to a reproduced sound of high quality.

Furthermore, according to the present invention, the middle-pitched and the high-pitched sounds emitted from the speaker unit that is positioned away from the entrance of the external acoustic meatus for a predetermined distance can reach the inside of the external acoustic meatus, and also the low-pitched sound emitted from a position close to the entrance of the external acoustic meatus of the listener through the tubular duct can effectively reach the inside of the external acoustic meatus, which can make the listener listen to both the middle-pitched and the high-pitched sounds which can localize the sound image outside the head of the listener and the low-pitched sound which has the sound pressure level increased. Accordingly, it becomes possible to realize an electroacoustic transducer and an ear speaker device that can provide natural sound image localization and make a listener listen to a reproduced sound of high quality including a sufficient low-pitched sound.

Furthermore, according to the present invention, a sound generated in the housing can reach the eardrum in the inside of the external acoustic meatus directly and stably from the vicinity of the entrance of the external acoustic meatus of the listener through the tubular duct, which can provide natural sound image localization as the open type, and make the listener stably listen to the sound of a sufficient level. Accordingly, it becomes possible to realize an electroacoustic transducer and an ear speaker device that can provide natural sound image localization and make a listener listen to a reproduced sound of high quality.

Furthermore, according to the present invention, the binaural recording can be performed by gathering a sound from the sound source using the microphone for the binaural recording which is attached to the vicinity of the speaker unit from which the listener really listens to the reproduced sound, which can provide significantly natural sound image localization as compared with an ear speaker device in the past with respect to the reproduced sound, and make the listener listen to the sound of a sufficient level through the tubular duct. Accordingly, it becomes possible to realize an electroacoustic transducer and an ear speaker device that can provide natural sound image localization and make a listener listen to a reproduced sound of high quality.

The nature, principle and utility of the invention will become more apparent from the following detailed description when read in conjunction with the accompanying drawings in which like parts are designated by like reference numerals or characters.

DETAILED DESCRIPTION OF THE PREFERRED EMBODIMENTS

(1) First Embodiment

(1-1) Configuration of Ear Speaker Device

Figure 1:
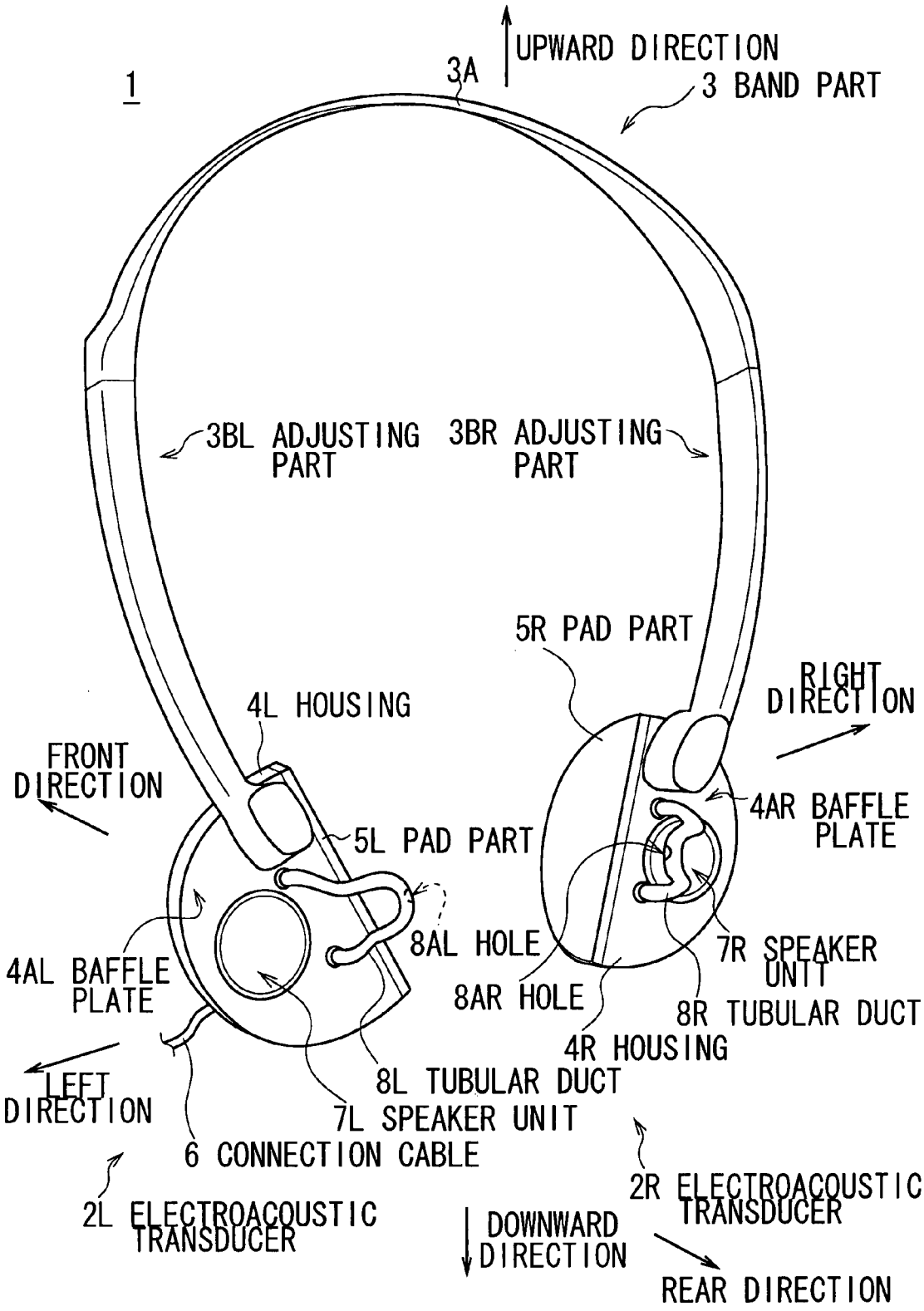
FIG. 1 is a schematic perspective view showing an entire configuration (1) of an ear speaker device according to a first embodiment.
Figure 2:
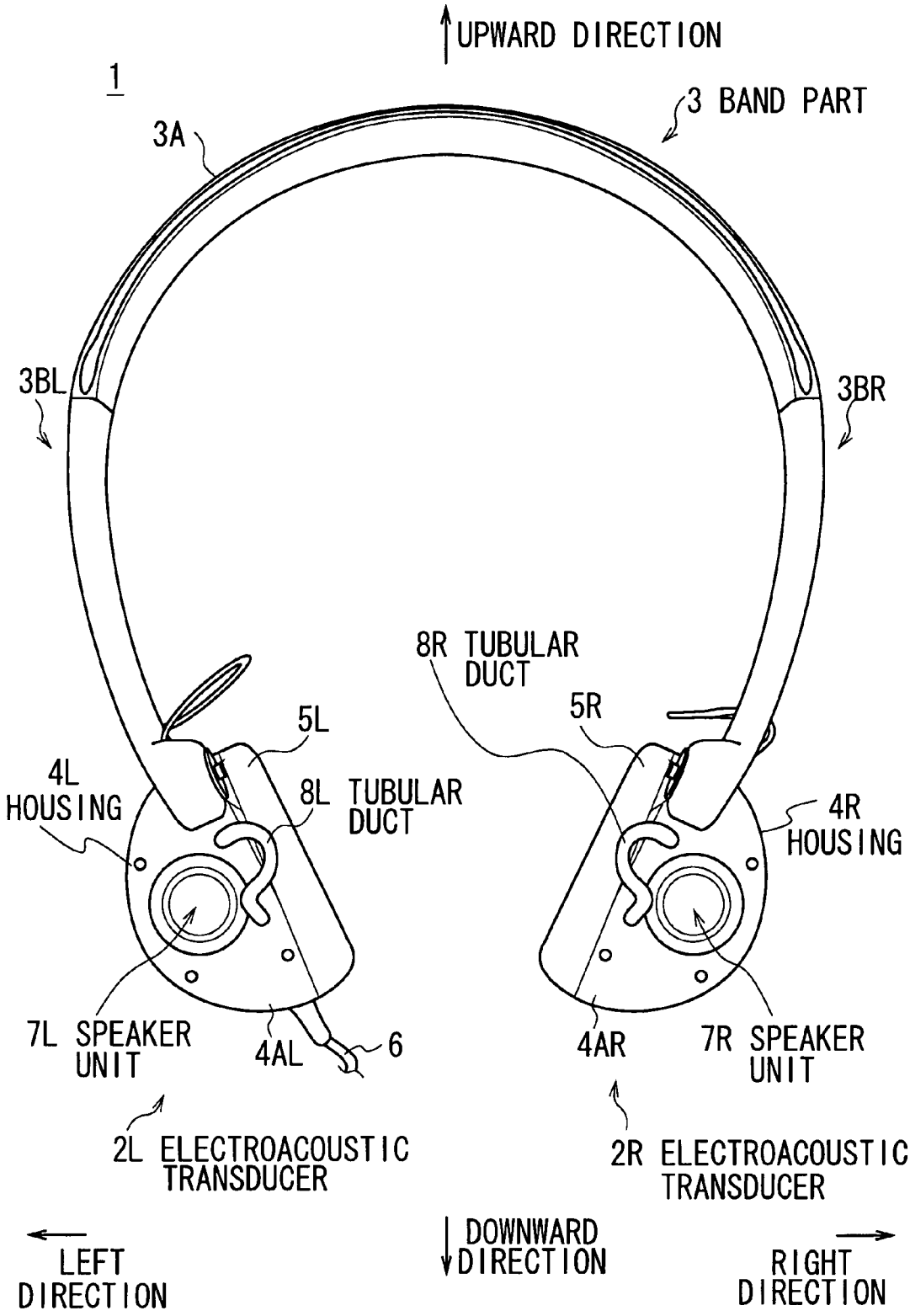
FIG. 2 is a schematic rear view showing the entire configuration (2) of the ear speaker device according to the first embodiment.
Figure 3:
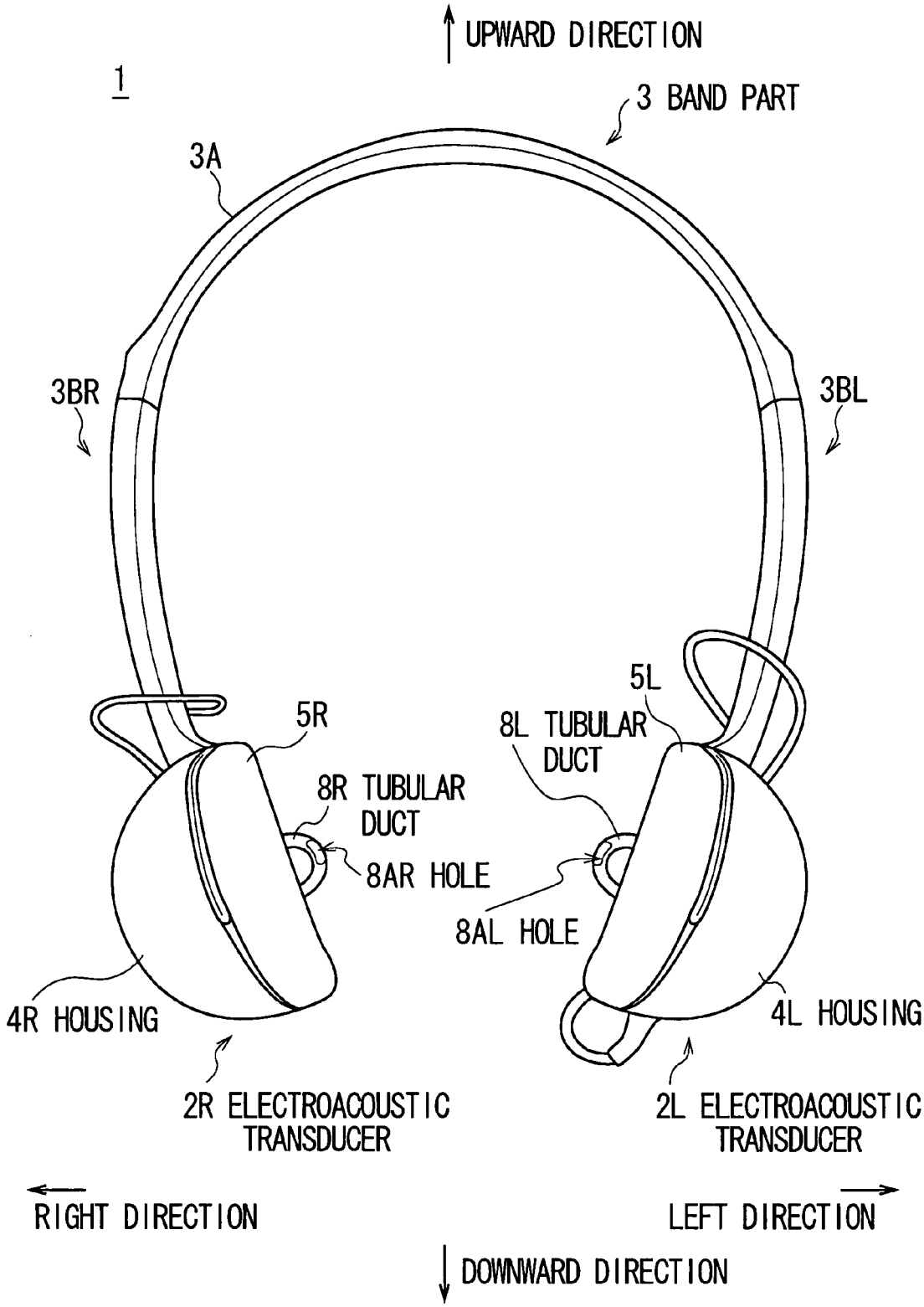
FIG. 3 is a schematic front view showing the entire configuration (3) of the ear speaker device according to the first embodiment.

With respect to FIGS. 1, 2, and 3, the numerical number 1 refers to an entire ear speaker device according to the first embodiment. The ear speaker device is configured so as to convert an audio signal generated by reproduction processing and the like of a portable compact disc (CD) player and a digital music player (DMP) to a reproduced sound, and make a listener capable of listening to the reproduced sound.

Unlike a box-shaped speaker device generally used, the ear speaker device 1 is premised to be mounted on the head of the listener as similar to a headphone device. The ear speaker device 1 is configured with electroacoustic transducers 2L and 2R that convert the audio signal to the reproduced sound, and a band part 3 for mounting and fixing the electroacoustic transducers 2L and 2R on the head of the listener, according to a rough classification.

The electroacoustic transducers 2L and 2R are mainly configured with housings 4L and 4R having a shape of a ball being quartered along a vertical direction. Each of the housings 4L and 4R has plane surfaces formed on a rear side, and a left or a right inner side, respectively. Pad parts 5L and 5R for softening side pressure to the head of the listener are provided on inner sides on the left and the right.

Baffle plates 4AL and 4AR that are the plane surfaces on the rear side of the housings 4L and 4R are provided with speaker units 7L and 7R that convert the audio signal to the reproduced sound. The speaker units 7L and 7R are configured so as to emit sound by vibrating a diaphragm according to the audio signal supplied from the portable CD player, the DMP, and the like via a connection cable 6.

In addition, the baffle plates 4AL and 4AR of the housings 4L and 4R are provided with tubular ducts 8L and 8R that are made of metal, and are formed by curving a hollow member having predetermined thickness into a substantial U-shape respectively on sides. As shown in FIG. 1, the tubular ducts 8L and 8R have outer ends that are curved in the inner side direction on the left or the right, respectively. Further, holes 8AL and 8AR are provided on a substantial center of each of end parts on the rear side.

The band part 3 is formed in a substantial arch shape corresponding to a shape of the head of a general person, centering on a center part 3A. Also, the band part 3 is configured so that an entire length of the band part 3 can be adjusted by adjusting parts 3BL and 3BR that can slide in an extensible manner with respect to the center part 3A.

The band part 3 is formed in the arch shape with a diameter smaller than the shape of the head of the general person, and also has an elastic force. When the ear speaker device 1 is mounted on the listener while the housings 4L and 4R are stretched to the left and the right, the band part 3 tends to return to an original shape by action of the elastic force after the mounting. In this manner, the ear speaker device 1 is held in a state that the housings 4L and 4R are made in contact with the head of the listener.

The ear speaker device 1 is configured in substantial symmetry as shown in FIGS. 1 to 3. Therefore, the electro acoustic transducer 2L on the left side will be mainly described hereinafter.

Figure 4:
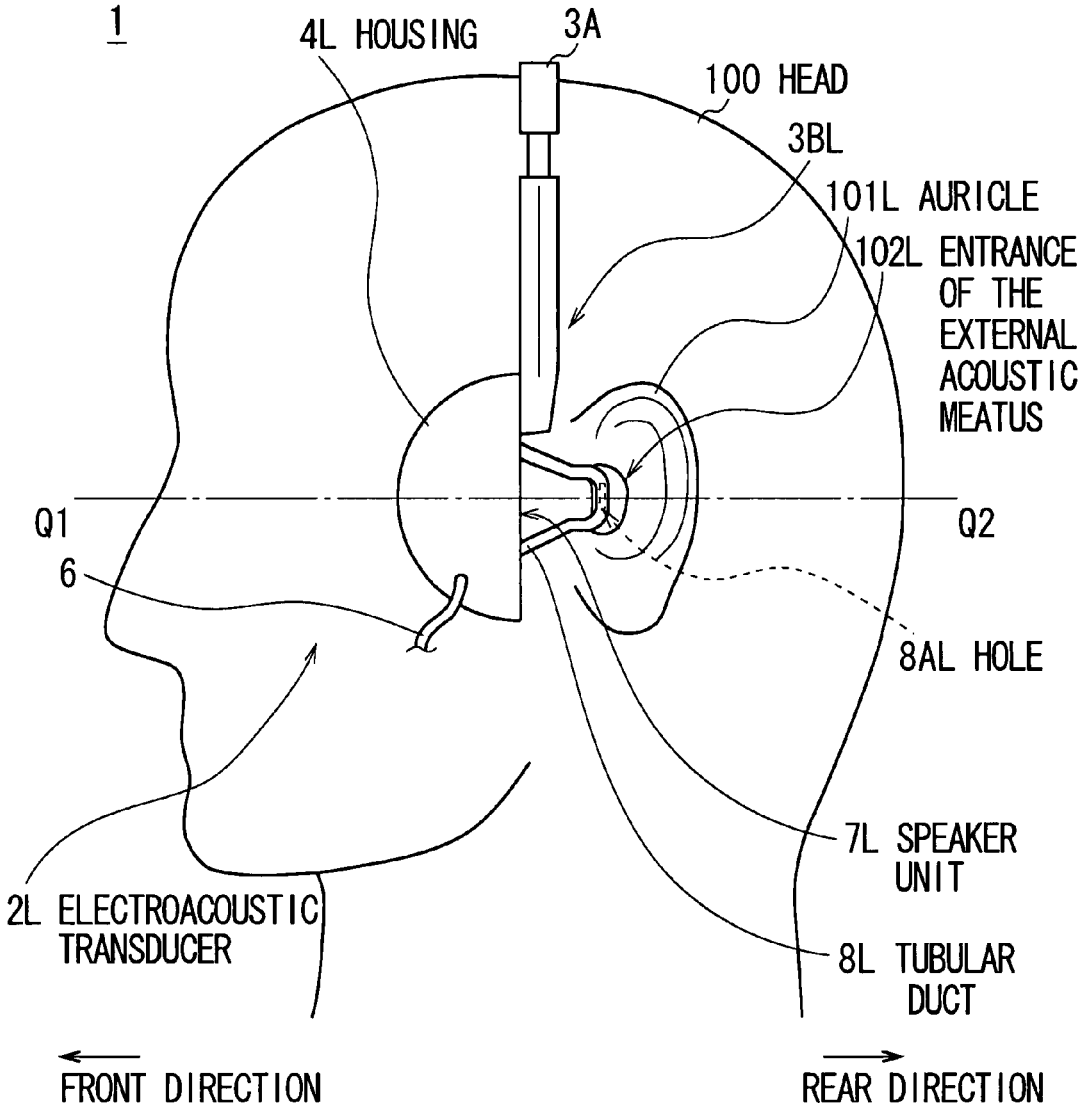
FIG. 4 is a schematic side view showing a mounting state (1) of the ear speaker device according to the first embodiment.

In practice, as shown in a left side view of FIG. 4, the ear speaker device 1 is mounted on a head 100 of the listener after length of the band part 3 is adjusted, thereby the electroacoustic transducer 2L attached to a lower end side of the adjusting part 3BL is positioned somewhat closer to the front than an auricle 101L on the head of the listener.

In the above manner, the electroacoustic transducer 2L of the ear speaker device 1 allows middle-pitched and high-pitched sounds emitted from the speaker unit 7L to directly reach the inside of an external acoustic meatus of the listener, and also allows a reflected sound reflected by a cheek and the auricle 101L of the listener to reach the inside of the external acoustic meatus. Therefore, the ear speaker device 1 is configured to be capable of providing natural sound image localization that is similar to a case of listening to a sound via a general stationary speaker.

When the ear speaker device 1 is mounted on the listener in a normal manner, the speaker unit 7L is positioned somewhat closer to the front than the auricle 101L and an entrance 102L of the external acoustic meatus, and the hole 8AL of the tubular duct 8L is positioned in the vicinity of the entrance 102L of the external acoustic meatus.

The tubular duct 8L has its end formed in a substantial U-shape, and therefore is configured so as not to enter into the inside of the external acoustic meatus of the listener. In this manner, the ear speaker device 1 is configured so as to be able to prevent the tubular duct 8L from hurting the inside of the external acoustic meatus in error when the listener mounts the ear speaker device 1, and so on.

Figure 5:
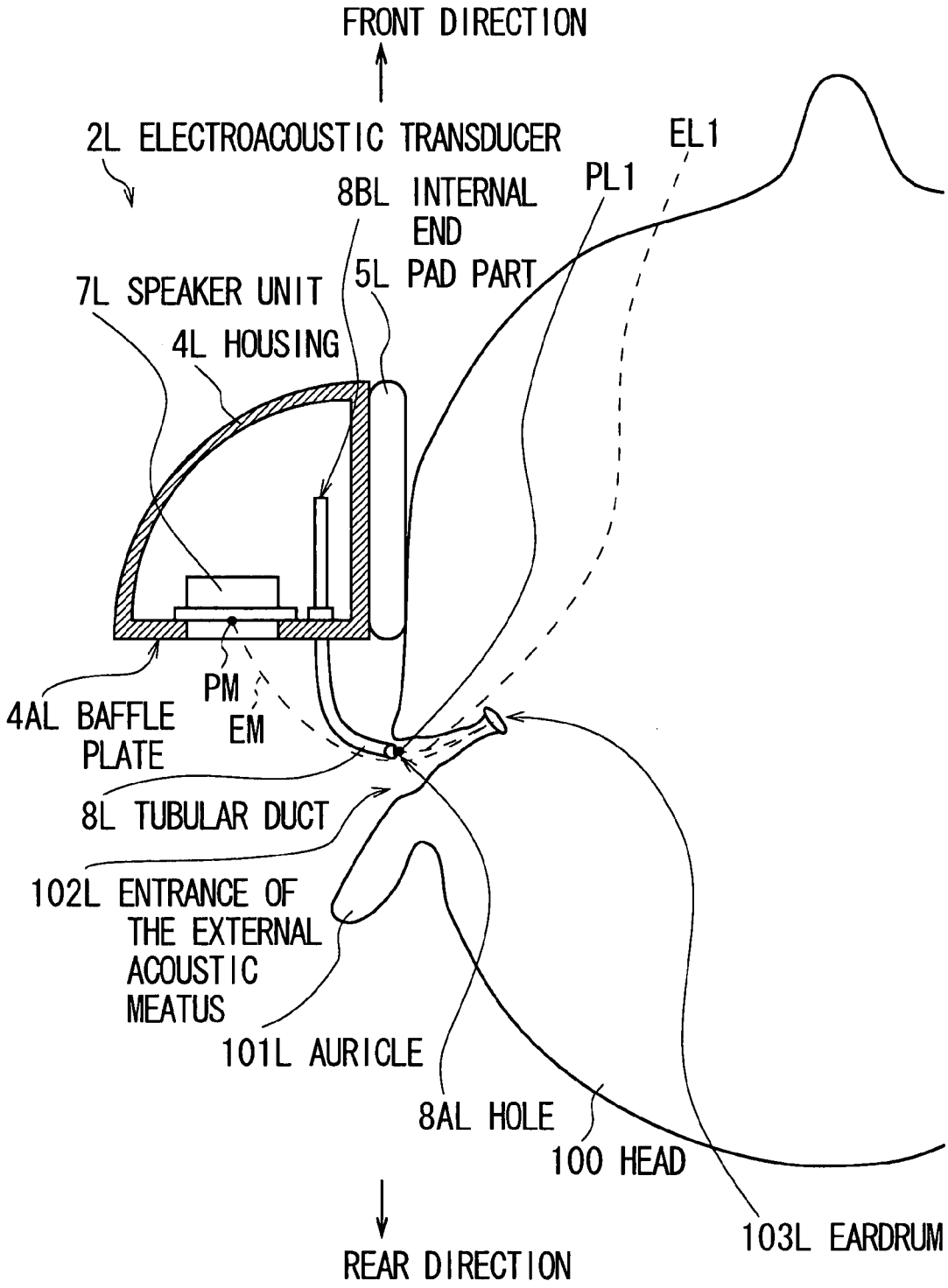
FIG. 5 is a schematic cross-sectional top view showing the mounting state (2) of the ear speaker device according to the first embodiment.

Here, as a cross section cut along the line Q1-Q2 in FIG. 4 is shown in FIG. 5, the housing 4L forms closed space excluding the tubular duct 8L in a state where the speaker unit 7L is attached. In this manner, the housing 4L and the tubular duct 8L form a resonant circuit with respect to the speaker unit 7L.

In addition, the tubular duct 8L reaches the vicinity of the entrance 102L of the external acoustic meatus of the listener by penetrating through the baffle plate 4AL of the housing 4L from the inside of the housing 4L. In practice, the electroacoustic transducer 2L makes the tubular duct 8L working as a bass reflex duct, thereby the electroacoustic transducer 2L as a whole operates as a bass reflex speaker.

Figure 6:
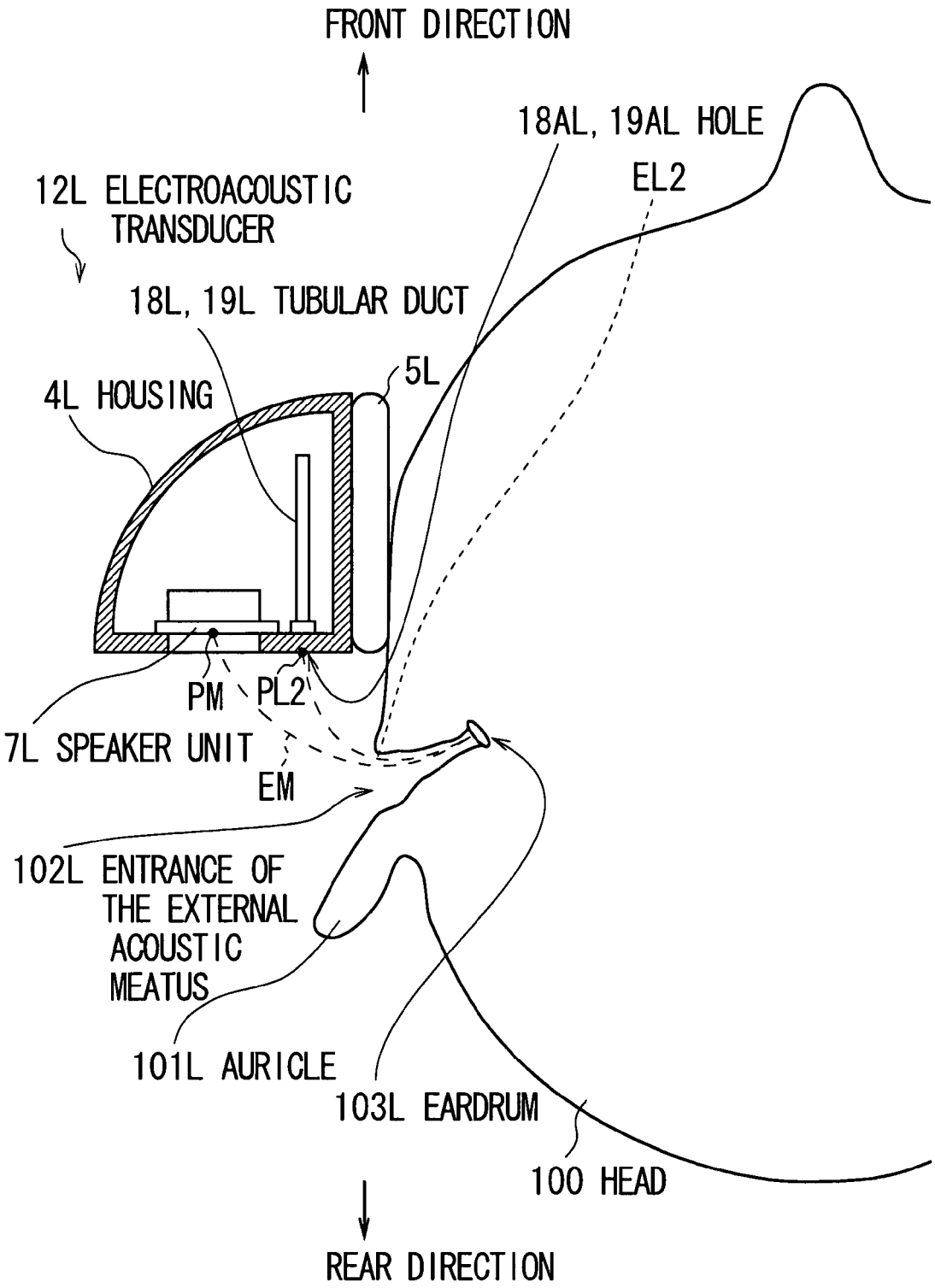
FIG. 6 is a schematic cross-sectional top view showing a bass reflex ear speaker generally used.

In a general bass reflex speaker, a duct is provided only inside a housing and does not extend to the outside. Therefore, for comparison with the electroacoustic transducer 2L, an electroacoustic transducer 12L as shown in FIG. 6 in which a corresponding part with FIG. 5 is attached to with the same numerical number is assumed.

The electroacoustic transducer 12L (FIG. 6) is configured in a similar manner as the general bass reflex speaker, and has two tubular ducts 18L and 19L only on an inner side of the housing 4L in place of the tubular duct 8L (FIG. 5) of the electroacoustic transducer 2L.

In a case of the electroacoustic transducer 12L, in a comparison between path length EM in which the middle-pitched and the high-pitched sounds emitted from the speaker unit 7L reach an eardrum 103L of the listener when a position of the speaker unit 7L is regarded as a position (hereinafter referred to as the virtual sound source position) PM of a virtual sound source, and path length EL2 in which the low-pitched sound emitted from holes 18AL and 19AL through the tubular ducts 18L and 19L reach the eardrum 103L of the listener when the holes 18AL and 19AL are regarded as a virtual sound source position PL2, a relationship of the path length EM≈the path length EL2 is obtained.

Figure 7:
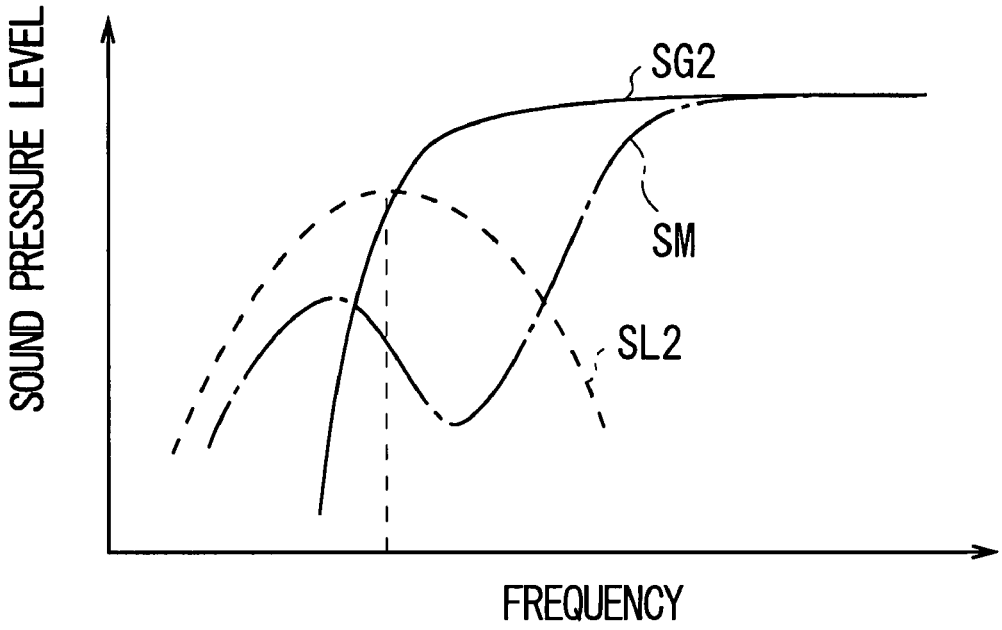
FIG. 7 is a schematic view showing a frequency characteristic in a bass reflex speaker in the past.

Here, a frequency characteristic of a sound reaching the eardrum 103L by the electroacoustic transducer 12L is shown in FIG. 7. As shown in FIG. 7, the bass reflex electroacoustic transducer 12L generally used allows the middle-pitched and the high-pitched sounds having a frequency characteristic as shown in a characteristic curve SM and emitted from the speaker unit 7L and the low-pitched sound having a frequency characteristic as shown in a characteristic curve SL2 emitted from the holes 18AL and 19AL after transmitting through the tubular ducts 18L and 19L to reach all together the eardrum 103L of the listener.

In the above manner, the electroacoustic transducer 12L can make the listener capable of listening to the reproduced sound having the sound pressure level in the low frequencies in the characteristic curve SM increased to some extent, as shown in a characteristic curve SG2 in which the characteristic curve SM and the characteristic curve SL2 are synthesized.

On the other hand, in the electroacoustic transducer 2L (FIG. 5) according to an embodiment of the present invention, in a comparison between the path length EM in which the middle-pitched and the high-pitched sounds emitted from the speaker unit 7L reach an eardrum 103L of the listener when the speaker unit 7L is regarded as the virtual sound source position PM, and path length EL1 in which the low-pitched sound emitted from a hole 8AL through a tubular duct 8L reach the eardrum 103L of the listener when the hole 8AL is regarded as a virtual sound source position PL1, a relationship of the path length EM>the path length EL1 is obtained.

Figure 8:
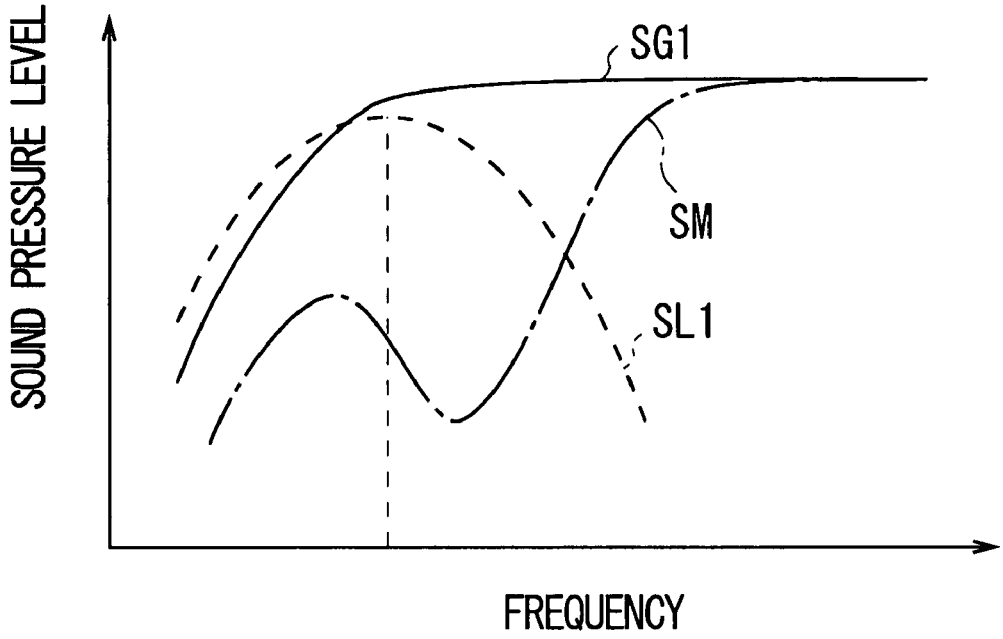
FIG. 8 is a schematic view showing a frequency characteristic of the ear speaker device according to the first embodiment.

Here, a frequency characteristic of the sound reaching the eardrum 103L by the electroacoustic transducer 2L is shown in FIG. 8. The electroacoustic transducer 2L is a type of the bass reflex speakers as described above, and therefore, as similar to the case shown in FIG. 7, the electroacoustic transducer 2L allows the middle-pitched and the high-pitched sounds having the frequency characteristic as shown in the characteristic curve SM and emitted from the speaker unit 7L and the low-pitched sound having a frequency characteristic as shown in a characteristic curve SL1 emitted from the hole 8AL after transmitting through the tubular duct 8L to reach all together the eardrum 103L of the listener.

In general, distance from the sound source and the sound pressure level are in a relationship of inverse proportion. Here, when the path length of the electroacoustic transducer 2L (FIG. 5) and that of the electroacoustic transducer 12L (FIG. 6) are compared, a relationship of the path length EL1<the path length EL2 is obtained.

That is, in the electroacoustic transducer 2L (FIG. 5), the virtual sound source position PL1 is positioned closer to the vicinity of the entrance 102L of the external acoustic meatus of the listener than the virtual sound source position PL2 of the electroacoustic transducer 12L (FIG. 6). Therefore, the electroacoustic transducer 2L allows the low-pitched sound emitted from the hole 8AL (virtual sound source position PL1) after transmitting through the tubular duct 8L to reach the eardrum 103L with the sound pressure level higher than when the electroacoustic transducer 12L is used.

Figure 9:
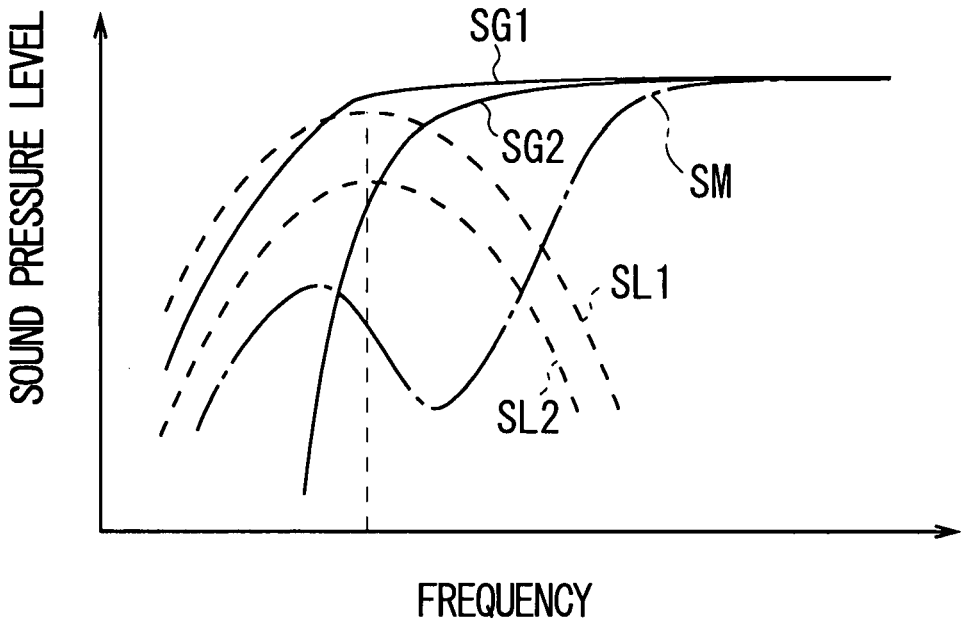
FIG. 9 is a schematic view showing a theoretical frequency characteristic.

That is, as shown in FIG. 9 in which two of the characteristic curves SL1 and SL2 are overlapped, the characteristic curve SL1 of the low-pitched sound by the tubular duct 8L has an entire sound pressure level higher as compared with the characteristic curve SL2 of the low-pitched sound by the tubular ducts 18L and 19L due to the relationship of the path length EL1<the path length EL2.

As a result, as shown in the characteristic curve SG1 in which the characteristic curve SM and the characteristic curve SL1 are synthesized, the electroacoustic transducer 2L in the first embodiment can make the listener capable of listening to the reproduced sound at a sufficient sound pressure level to an extent of a comparatively low frequency band where the sound pressure level in the low frequencies in the characteristic curve SM is increased higher than when the electroacoustic transducer 12L is used (characteristic curve SG2).

Here, when the characteristic curve SG1 and the characteristic curve SG2 are compared, the sound pressure level lowers comparatively steeply as it progresses to a low frequencies side in the characteristic curve SG2, whereas degree of the lowering of the sound pressure level is moderate as it progresses to the low frequencies side in the characteristic curve SG1.

That is, the electroacoustic transducer 2L can allow an excellent reproduced sound having the high sound pressure level extending to a wide frequency band, that is, including the sufficient low frequencies to be transmitted to the eardrum 103 of the listener and can make the listener capable of listening to the excellent reproduced sound.

In this case, as shown in FIGS. 4 and 5, although the electroacoustic transducer 2L makes the end part of the tubular duct 8L in contact with the vicinity of the entrance 102L of the external acoustic meatus of the listener, the electroacoustic transducer 2L does not completely block the entrance 102L of the external acoustic meatus.

For the above reason, the electroacoustic transducer 2L allows a sound generated around the listener (hereinafter referred to as the surround sound) to reach the eardrum 103L of the listener without blocking the surround sound and makes the listener capable of listening to the surround sound, in addition to the reproduced sound made up of combination of the middle-pitched and the high-pitched sounds emitted from the speaker unit 7L and the low-pitched sound emitted from the hole 8AL of the tubular duct 8L.

As for the electroacoustic transducer 2L, an internal volume of the housing 4L is 10 ml, an external diameter of the speaker unit 7L is 21 mm, an effective vibration radius in a diaphragm of the speaker unit 7L is 8.5 mm, equivalent mass of a vibration system is 0.2 g, a minimum resonance frequency f0 is 360 Hz, and a resonance frequency Q0 is 1.0.

As for the tubular duct 8L, an inner diameter is 1.8 mm, effective length from an internal end 8BL positioned in the housing 4L of the tubular duct 8L to the hole 8AL is 50 mm, and a distance from a surface of the baffle plate 4AL to the hole 8AL is around 35 mm.

Here, the tubular duct 8L has its side surface formed in a U-shape, and the hole 8AL provided on the center of the outer end part. Therefore, it is substantially same as that two bass reflex ducts of the top half and the bottom half make up the tubular duct 8L, and the inner diameter and the effective length of the tubular duct 8L are determined after the inner diameter (equivalent to 2.5 mm in this case) when the tubular duct 8L is converted to one tubular duct is considered.

That is, the tubular duct 8L has the side surface formed in the U-shape, thereby the effective length of the tubular duct 8L can be set to be short as compared with the case when the tubular duct 8L is configured with one tubular duct, and design and safety of the tubular duct 8L are significantly improved.

With respect to the electroacoustic transducer 2L (FIG. 5) and the electroacoustic transducer 12L (FIG. 6), an actual frequency characteristic was measured by using a jig for measurement that imitated an auricle and an external acoustic meatus of a human being. As a result, a characteristic curve SG11 (in a case of the electroacoustic transducer 2L) and a characteristic curve SG12 (in a case of electroacoustic transducer 12L) as shown in FIG. 10 were obtained.

Figure 10:
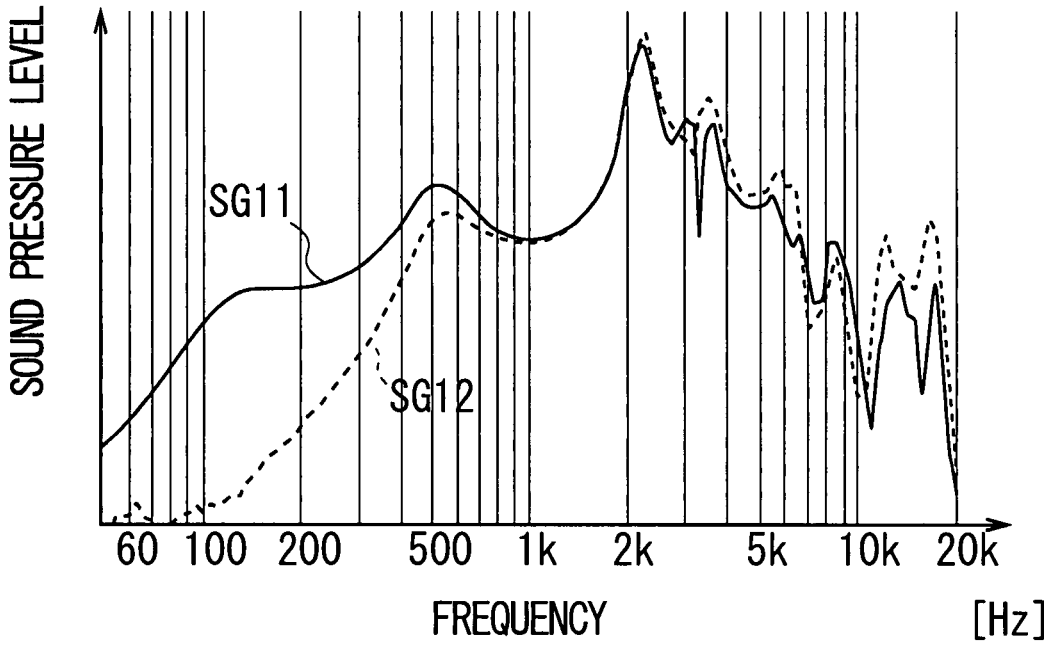
FIG. 10 is a schematic view showing a frequency characteristic based on actual measurement.

In FIG. 10, the characteristic curve SG11 of the electroacoustic transducer 2L has the sound pressure level higher than the characteristic curve SG12 of the electroacoustic transducer 12L in low frequencies of around 500 Hz or below, as similar to the ideal frequency characteristic shown in FIG. 9. That is, FIG. 10 shows that the electroacoustic transducer 2L can make the listener capable of listening to the excellent reproduced sound including a sufficient low-pitched sound.

In this way, when the ear speaker device 1 is mounted on the head 100 of the listener, the speaker unit 7L is positioned at a location somewhat distant from the entrance 102L of the external acoustic meatus of the listener, and the middle-pitched and the high-pitched sounds of the reproduced sound are emitted from the speaker unit 7L, while the low-pitched sound of the reproduced sound is emitted from the hole 8AL of the tubular duct 8L which is extended from the housing 4L to the vicinity of the entrance 102L of the external acoustic meatus to work as a bass reflex duct, which can provide natural sound image localization and make a listener listen to an excellent reproduced sound including a sufficient low-pitched sound.

On the tubular ducts 8L and 8R (FIG. 1) of the ear speaker device 1, the holes 8AL and 8AR are arranged in the vicinity of the entrance 102L of the external acoustic meatus and are oriented to the entrance 102L of the external acoustic meatus. In this case, not only the necessary low-pitched sound but also the middle-pitched and the high-pitched sounds are output from the holes 8AL and 8AR.

When the middle-pitched and the high-pitched sounds enter into the entrance 102L of the external acoustic meatus and reach the eardrum 103L, the listener can listen to the middle-pitched and the high-pitched sounds from the holes 8AL and 8AR of the tubular ducts 8L and 8R in addition to the middle-pitched and the high-pitched sounds output from the speaker units 7L and 7R. Accordingly, the sound image localization is easily positioned in the head, which undesirably exerts a bad influence of making a listener feel that the sound field is narrow.

Figure 11:
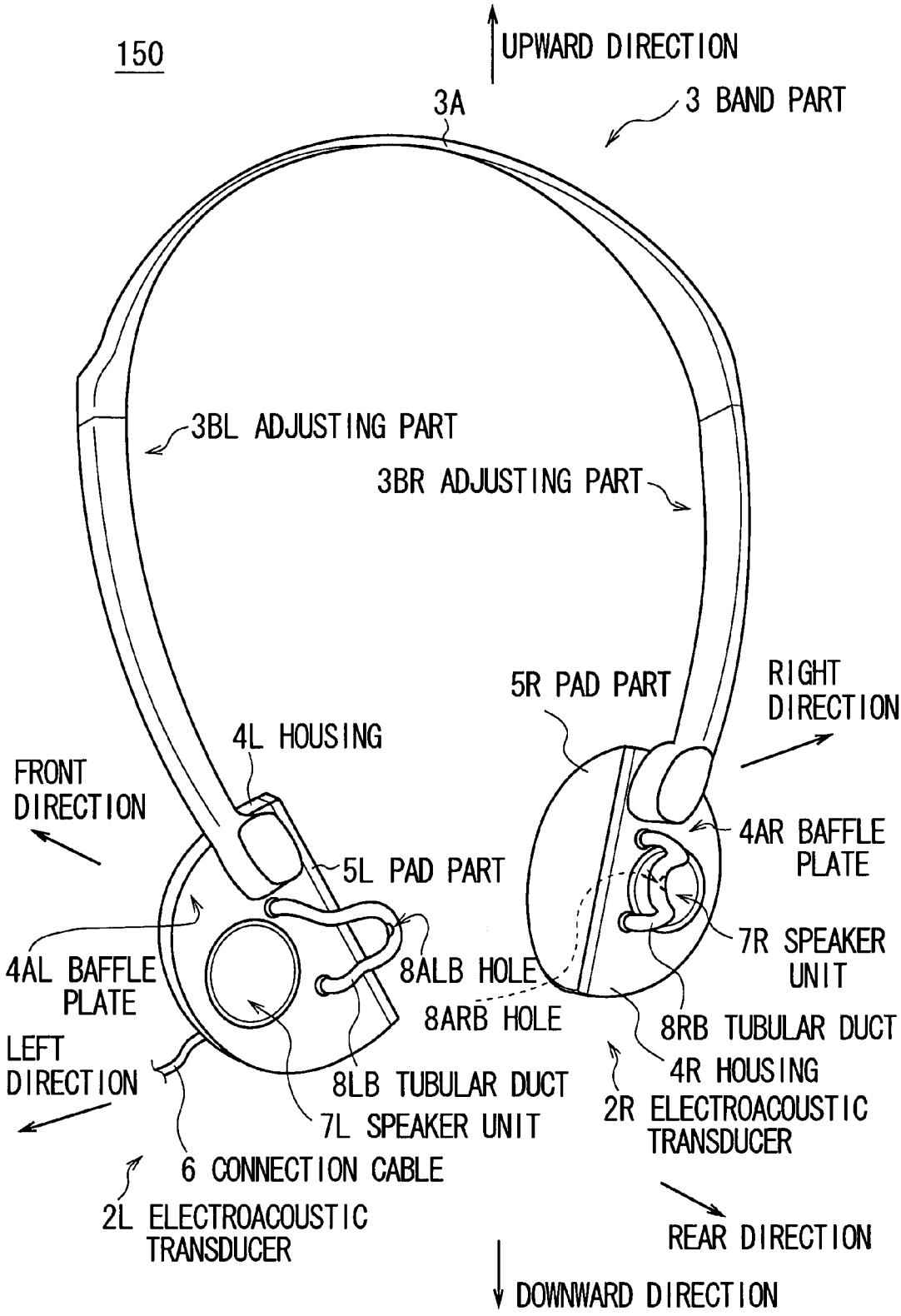
FIG. 11 is a schematic perspective view showing another configuration example of a tubular duct according to the first embodiment.

Thus, in an ear speaker device 150 shown in FIG. 11 in which a corresponding part is attached to with the same numerical number as found in FIG. 1, there are arranged tubular ducts 8LB and 8RB on which holes 8ALB and 8ARB are so formed as to be oriented to the opposite direction with respect to the entrance 102L of the external acoustic meatus of the listener. In practice, the holes 8ALB and 8ARB are formed on the inner side of end parts of the tubular ducts 8LB and 8RB formed into a substantial U-shape respectively on sides.

In this case, in the ear speaker device 150, even if the holes 8ALB and 8ARB of the tubular ducts 8LB and 8RB are oriented to the opposite direction with respect to the entrance 102L of the external acoustic meatus, since the low-pitched sound emitted from the holes 8ALB and 8ARB of the tubular ducts 8LB and 8RB is not provided with the directivity, the low-pitched sound can surely reach the external acoustic meatus of the listener. On the other hand, with respect to the middle-pitched and the high-pitched sounds which are slightly leaked to be emitted from the holes 8ALB and 8ARB, since the holes 8ALB and 8ARB of the tubular ducts 8LB and 8RB are oriented to the opposite direction with respect to the entrance 102L of the external acoustic meatus, the middle-pitched and the high-pitched sounds, which are provided with the directivity, scarcely reach the external acoustic meatus of the listener.

Accordingly, the ear speaker device 150 can output the middle-pitched and the high-pitched sounds of the reproduced sound from the speaker units 7L and 7R to make the sounds reach the entrance 102L of the external acoustic meatus of the listener, and can make only the low-pitched sound of the reproduced sound output from the holes 8ALB and 8ARB of the tubular ducts 8LB and 8RB reach the entrance 102L of the external acoustic meatus of the listener. On the other hand, since the middle-pitched and the high-pitched sounds, which are slightly leaked, are output from the holes 8ALB and 8ARB oriented to the opposite direction with respect to the entrance 102L of the external acoustic meatus of the listener with the directivity, thus leaked middle-pitched and the high-pitched sounds do not reach the entrance 102L of the external acoustic meatus of the listener, which dose not exert a bad influence with respect to the sound image localization of the listener on which the middle-pitched and the high-pitched sounds act.

In this way, the ear speaker device 150 can give more natural sound image localization by the middle-pitched and the high-pitched sounds output from the speaker units 7L and 7R, and make a listener listen to the low-pitched sound of a sufficient level through the holes 8ALB and 8ARB of the tubular ducts 8LB and 8RB.

The positions of the holes 8ALB and 8ARB are not restricted to the places, and the holes 8ALB and 8ARB may be formed on any positions on the tubular ducts 8LB and 8RB so long as the holes are oriented to the opposite direction with respect to the entrance 102L of the external acoustic meatus of the listener.

(1-2) Configuration Example of Another Ear Speaker Device

As shown in FIGS. 1 to 4, the ear speaker device 1 according to the first embodiment is configured so as to mount the electroacoustic transducers 2L and 2R on the head 100 of the listener by the band part 3 as the mounting part. However, the electroacoustic transducers 2L and 2R may be mounted on the head 100 of the listener by using a variety of other mounting parts in place of the band part 3.

Hereinafter, description will be made by mainly taking the electroacoustic transducer 2L on the left side as an example as similar to the case of the ear speaker device 1 described above. With respect to the electroacoustic transducer 2R on the right side, a configuration is made in a manner symmetrical to the electroacoustic transducer 2L on the left side.

Figure 12:
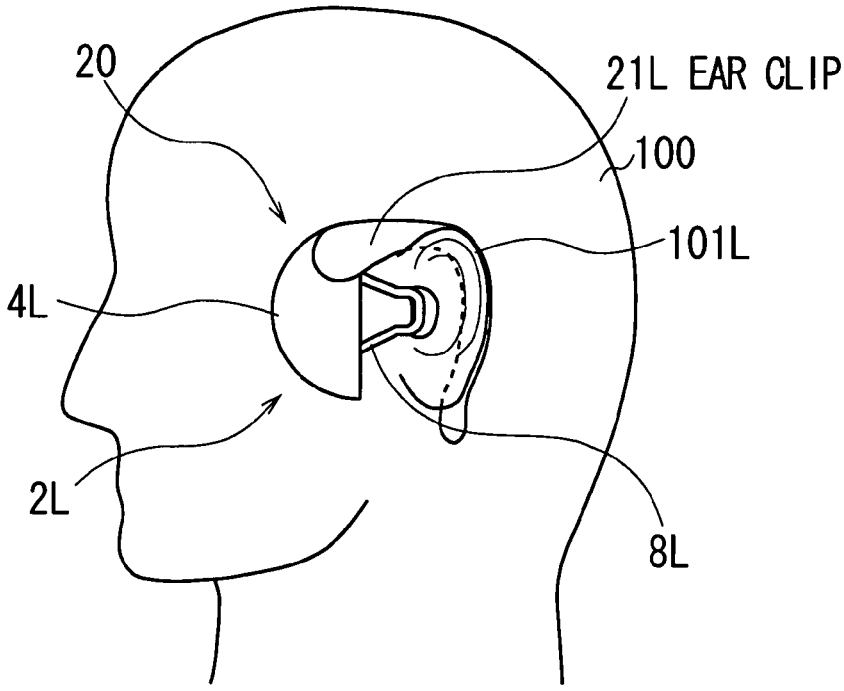
FIG. 12 is a schematic side view showing an example (1) of a configuration and mounting of the ear speaker device according to the first embodiment.

For example, an ear speaker device 20 shown in FIG. 12 is configured as a so-called ear-clip type. In the ear speaker device 20, an ear clip 21L to be hung on an auricle 101L of the listener is attached to the housing 4L of the electroacoustic transducer 2L in place of the band part 3 in the ear speaker device 1 (FIGS. 1 to 4).

The ear speaker device 20 (FIG. 12) can have the electroacoustic transducer 2L mounted on the head 100 of the listener by hanging the ear clip 21L on the auricle 101L of the listener. In this manner, as similar to the ear speaker device 1, the ear speaker device 20 can make the listener capable of listening to the excellent reproduced sound including the sufficient low-pitched sound while providing the natural sound image localization.

Figure 13:
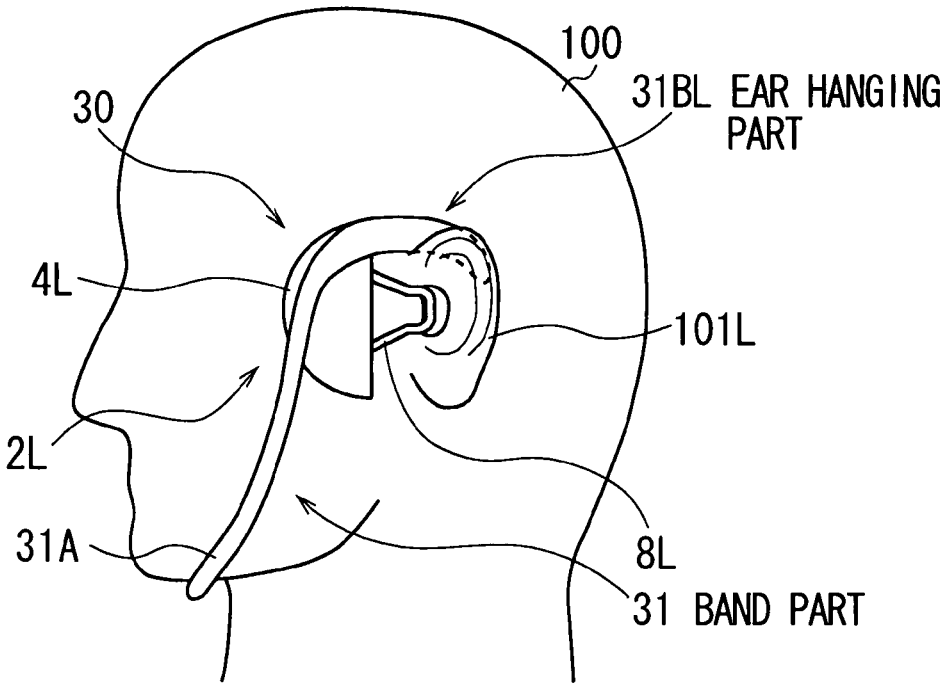
FIG. 13 is a schematic side view showing an example (2) of the configuration and the mounting of the ear speaker device according to the first embodiment.

In addition, an ear speaker device 30 shown in FIG. 13 is configured as a so-called under-chin type. A band part 31 for connecting the electroacoustic transducers 2L and 2R on the left and the right and being hung on the auricle 101L of the listener is attached to the housing 4L in place of the band part 3 of the ear speaker device 1 (FIGS. 1 to 4). A center part 31A of the band part 31 is formed in a substantial arch shape like a U-shape, and premised to be positioned below the chin of the listener and connect the left and the right parts of the band part 31.

The ear speaker device 30 (FIG. 13) can have the electroacoustic transducer 2L mounted on the head 100 of the listener by an ear hanging part 31BL of the band part 31 being hung on the auricle 101L of the listener. As similar to the ear speaker device 1, the ear speaker device 30 can make the listener capable of listening to the excellent reproduced sound including the sufficient low-pitched sound while providing the natural sound image localization.

Figure 14:
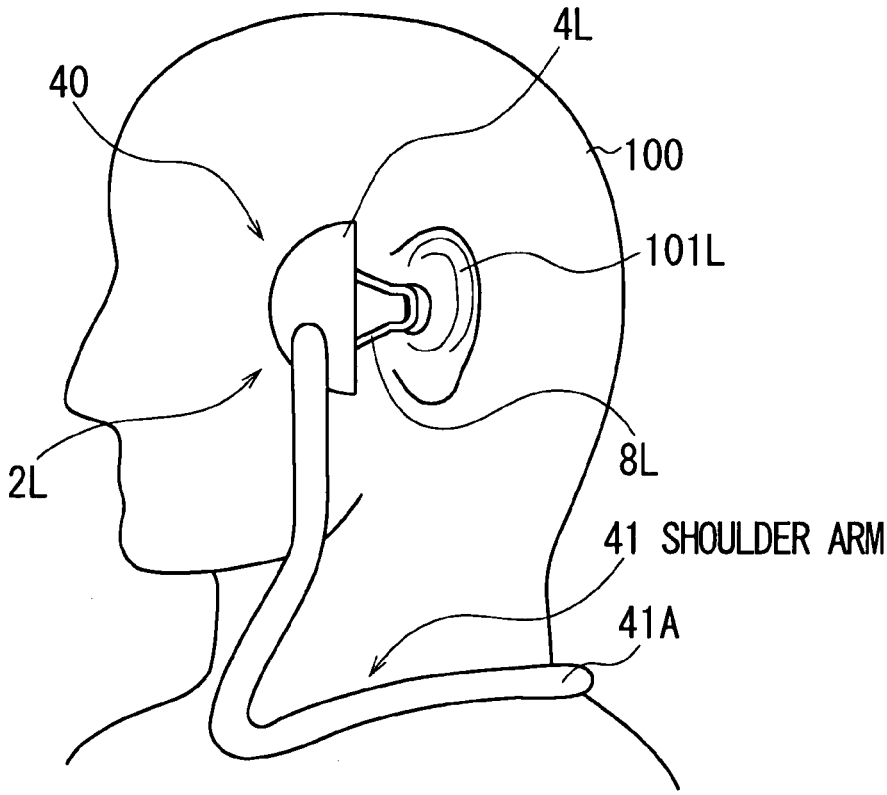
FIG. 14 is a schematic side view showing an example (3) of the configuration and the mounting of the ear speaker device according to the first embodiment.

Further, an ear speaker device 40 shown in FIG. 14 is configured as a so-called shoulder-hold type. A shoulder arm 41 for connecting the electroacoustic transducers 2L and 2R on the left and the right and for supporting the ear speaker device 40 at a shoulder part of the listener is attached to the housing 4L in place of the band part 3 of the ear speaker device 1 (FIGS. 1 to 4). A center part 41A of the shoulder arm 41 is formed in a substantial arch shape curved around a rear side of the neck, and premised to be hung on an upper part of the shoulder from the rear side of the neck of the listener and connect the left and the right parts of the shoulder arm 41.

The ear speaker device 40 (FIG. 14) can have the electroacoustic transducer 2L mounted on the head 100 of the listener by being hung by extending to both shoulders of the listener. As similar to the ear speaker device 1, the ear speaker device 40 can make the listener capable of listening to the excellent reproduced sound including the sufficient low-pitched sound while providing the natural sound image localization.

Figure 15:
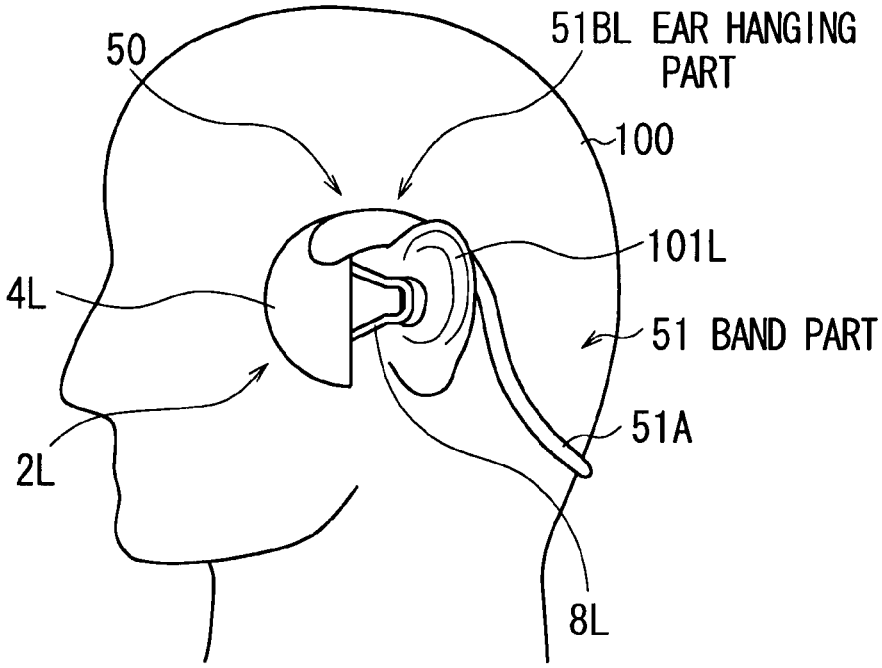
FIG. 15 is a schematic side view showing an example (4) of the configuration and the mounting of the ear speaker device according to the first embodiment.

Further, an ear speaker device 50 shown in FIG. 15 is configured as a so-called neck-band type. A band part 51 for connecting the electroacoustic transducers 2L and 2R on the left and the right and for being hung on the auricle 101L of the listener is attached to the housing 4L in place of the band part 3 of the ear speaker device 1 (FIGS. 1 to 4). A center part 51A of the band part 51 is formed in a substantial arch shape so as to be curved around a rear side of the head, and premised to connect the left and the right parts of the band part 51 on a rear side of the back of the head of the listener.

The ear speaker device 50 (FIG. 15) can have the electroacoustic transducer 2L mounted on the head 100 of the listener by an ear hanging part 51BL of the band part 51 being hung on the auricle 101L of the listener. As similar to the ear speaker device 1, the ear speaker device 50 can make the listener capable of listening to the excellent reproduced sound including the low-pitched sound while providing the natural sound image localization.

Figure 16:
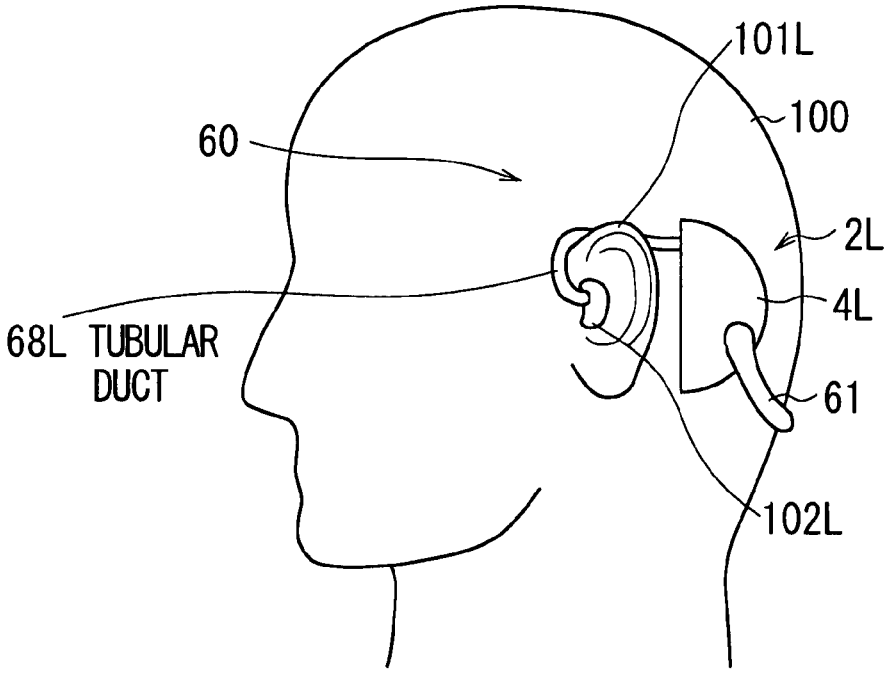
FIG. 16 is a schematic side view showing an example (5) of the configuration and the mounting of the ear speaker device according to the first embodiment.

Further, an ear speaker device 60 shown in FIG. 16 positions the electroacoustic transducer 2L in the ear speaker device 50 shown in FIG. 15 to a position closer to the rear side than the auricle 101 of the listener. At the same time, a tubular duct 68L having a substantial L-shape extends from the housing 4L positioned on the rear side of the auricle 101 of the listener to the vicinity of the entrance 102L of the external acoustic meatus in place of the tubular duct 8L. In addition, a band part 61 positioned at the rear side of the neck of the listener connects the electroacoustic transducers 2L and 2R on the left and the right.

The ear speaker device 60 (FIG. 16) can have the electroacoustic transducer 2L mounted on the head 100 of the listener by the tubular duct 68L being hung on the auricle 101L of the listener. As similar to the ear speaker device 1, the ear speaker device 60 can make the listener capable of listening to the excellent reproduced sound including the sufficient low-pitched sound while providing the natural sound image localization.

Figure 17:
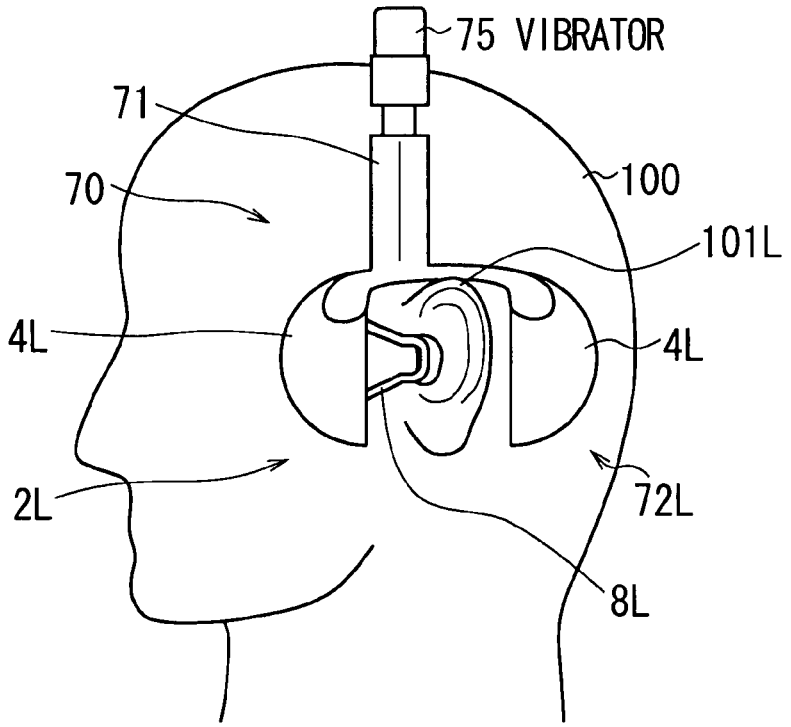
FIG. 17 is a schematic side view showing an example (6) of the configuration and the mounting of the ear speaker device according to the first embodiment.

Further, an ear speaker device 70 shown in FIG. 17 has a rear electroacoustic transducer 72L having a similar configuration as the electroacoustic transducer 12L (FIG. 6) in addition to the electroacoustic transducer 2L. A band part 71 in place of the band part 3 in the ear speaker device 1 (FIGS. 1 to 4) positions the electroacoustic transducer 2L closer to the front than the auricle 101L, and at the same time, the band part 71 positions the rear electroacoustic transducer 72L closer to the rear side of the auricle 101L.

An audio signal for a rear channel in a multi-channel sound source such as 4-channel and 5.1-channel is configured to be supplied to the rear electroacoustic transducer 72L.

The ear speaker device 70 (FIG. 17) can have the electroacoustic transducer 2L and the rear electroacoustic transducer 72L mounted on the head 100 of the listener by being mounted on the head 100 of the listener. The ear speaker device 70 can make the listener capable of listening to the excellent reproduced sound being surround sound including the sufficient low-pitched sound while providing the natural sound image localization in a state that the auricle 101L is sandwiched between the electroacoustic transducer 2L and the rear electroacoustic transducer 72L.

In addition, in the above case, the ear speaker device 70 (FIG. 17) may have a vibrator 75 attached to the band part 71, and vibration corresponding to a deep bass component in a 5.1-channel sound source may be generated on the head 100 of the listener, for example.

The ear speaker device 70 (FIG. 17) may have the tubular duct extended from the rear electroacoustic transducer 72L to the vicinity of the entrance 102L of the external acoustic meatus of the listener as similar to the ear speaker device 60 (FIG. 16), or may have the tubular duct extended from both the electroacoustic transducer 2L and the rear electroacoustic transducer 72L to the vicinity of the entrance 102L of the external acoustic meatus of the listener, in addition to having the tubular duct 8L extended from the electroacoustic transducer 2L to the vicinity of the entrance 102L of the external acoustic meatus of the listener.

Figure 18:
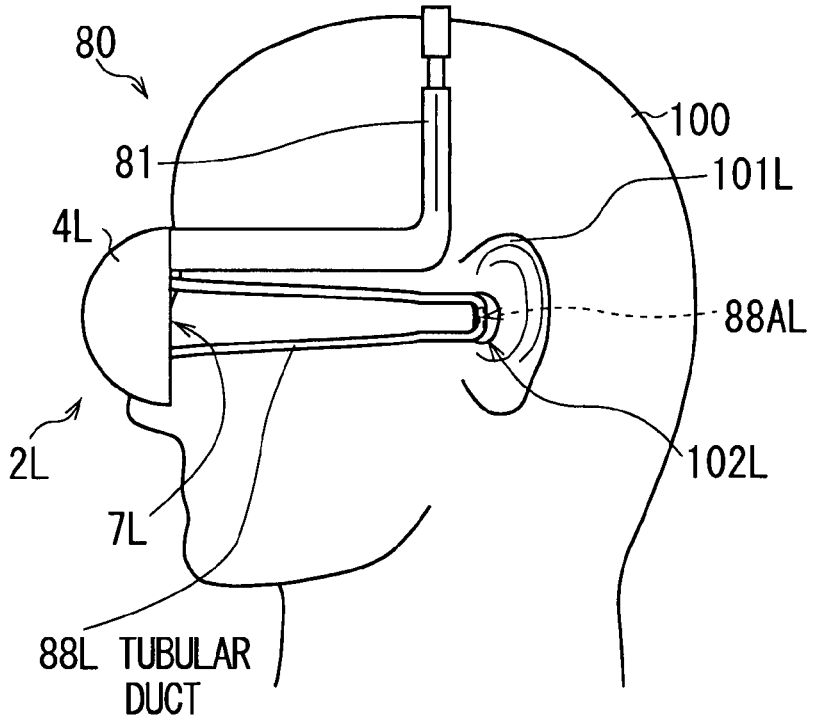
FIG. 18 is a schematic side view showing an example (7) of the configuration and the mounting of the ear speaker device according to the first embodiment.

Further, an ear speaker device 80 shown in FIG. 18 has a band part 81 for connecting the electroacoustic transducers 2L and 2R on the left and the right and for positioning the electroacoustic transducers closer to the front than the cheeks of the listener attached to the housing 4L in place of the band part 3 of the ear speaker device 1 (FIGS. 1 to 4).

In addition, the housing 4L has a tubular duct 88L extended from the housing 4L to the vicinity of the entrance 102L of the external acoustic meatus of the listener provided thereto in place of the tubular duct 8L. The tubular duct 88L has its inner diameter, path length of a sound, and so on appropriately calculated so as to emit the excellent low-pitched sound of the reproduced sound from the hole 88AL.

The ear speaker device 80 (FIG. 18) can position the housing 4L closer to the front than the cheek of the listener by being mounted on the head 100 of the listener. In this case, the middle-pitched and the high-pitched sounds emitted from the speaker unit 7L have their characteristic changed by being reflected on the cheeks of the listener and so on. Therefore, the middle-pitched and the high-pitched sounds are made even closer to the sound emitted from the general stationary speaker as compared with the ear speaker device 1. In this manner, the ear speaker device 80 can make the listener capable of listening to the reproduced sound that can provide even more natural localization.

As described above, according to the present invention, the electroacoustic transducers 2L and 2R may be mounted on the head 100 of the listener by the mounting parts in a variety of modes such as the ear speaker devices 20 to 80 (FIGS. 12 to 18) in addition to the band part 3 (FIGS. 1 to 4) of the ear speaker device 1.

(1-3) Operation and Advantageous Effect of First Embodiment

In the above configuration, the ear speaker device 1 is mounted on the head 100 of the listener, thereby the speaker unit 7L provided to the housing 4L of the electroacoustic transducer 2L is positioned somewhat closer to the front than the entrance 102L of the external acoustic meatus of the listener. At the same time, the ear speaker device 1 outputs the reproduced sound based on the audio signal supplied from a predetermined amplifier in a state that the end part of the tubular duct 8L extended to the rear side from the housing 4L and working as the bass reflex duct is positioned in the vicinity of the entrance 102L of the external acoustic meatus.

At this time, with respect to the electroacoustic transducer 2L (FIG. 5) of the ear speaker device 1, the path length EL1 which the low-pitched sound emitted from the hole 8AL of the tubular duct 8L reaches the eardrum 103L of the listener is shorter than the path length EM which the middle-pitched and the high-pitched sounds after emitted from the speaker unit 7L reach the eardrum 103L. Therefore, the electroacoustic transducer 2L can allow the low-pitched sound having a comparatively higher sound pressure level as shown in the characteristic curve SL1 than the middle-pitched and the high-pitched sounds as shown in the characteristic curve SM (FIG. 7) to reach the eardrum 103L.

As described above, the electroacoustic transducer 2L of the ear speaker device 1 can allow the middle-pitched and the high-pitched sounds emitted from the speaker unit 7L to reach the eardrum 103L after being reflected by the cheek, the auricle 101L, and so on of the listener. Therefore, the electroacoustic transducer 2L can make the reproduced sound having a characteristic similar to the case where the reproduced sound is listened to via the general speaker, and in this manner the electroacoustic transducer 2L can provide a natural sense of localization as though the sound image is positioned outside the head.

Further, the electroacoustic transducer 2L of the ear speaker device 1 has the tubular duct 8L extended to the vicinity of the entrance 102L of the external acoustic meatus of the listener. In this manner, the electroacoustic transducer 2L can make the listener capable of listening to the excellent reproduced sound that has the comparatively excellent sound pressure level down to the low frequencies as shown in the characteristic curve SG1 (FIG. 9) and the characteristic curve SG11 (FIG. 10).

In this case, the electroacoustic transducer 2L of the ear speaker device 1 has the tubular duct 8L extended to the vicinity of the entrance 102L of the external acoustic meatus of the listener. Therefore, as compared with the low-pitched sound as shown in the characteristic curve SL2 (FIG. 7) output from the tubular ducts 18L and 19L in the bass-reflex type electroacoustic transducer 12L (FIG. 6) generally used, the ear speaker device 1 can allow the low-pitched sound having a high sound pressure level as shown in the characteristic curve SL1 (FIG. 7) to reach the eardrum 103L of the listener. As a result, the ear speaker device 1 can make the listener capable of listening to, at the sufficient sound pressure level, the low-pitched sound that tends to be insufficient due to reasons that the speaker unit 7L has a comparatively small diameter and is located somewhat distant from the entrance 102L of the external acoustic meatus.

Further, the ear speaker device 1 does not increase reproducing sound volume of the low-pitched sound, but puts the hole 8AL of the tubular duct 8L which is an emission aperture of the low-pitched sound closer to the eardrum 103L to allow the sufficient low-pitched sound to reach the eardrum 103L (FIG. 5) of the listener. Therefore, as compared with a case where the low-pitched sound is reproduced by using a speaker having a large diameter, a subwoofer, and so on, leakage of the low-pitched sound and vibration can be minimized.

Therefore, in a case that the listener listens to the reproduced sound via the ear speaker device 1 late at night, for example, the listener can enjoy the excellent reproduced sound including the sufficient low-pitched sound without too much caring about whether the neighbors and the surroundings are disturbed.

The tubular duct 8L does not block the entrance 102L of the external acoustic meatus of the listener. Therefore, the ear speaker device 1 can allow, without blocking, the surround sound generated around the listener to reach the eardrum 103L and can make the listener capable of listening to the surround sound together with the reproduced sound.

In the above manner, the ear speaker device 1 can make the listener capable of reliably listening to the surround sound in addition to the excellent reproduction sound even in a case where the listener has to listen to the surround sound, such as when the listener is walking or playing some sports.

The ear speaker device 1 does not cover the auricle 101L and so on of the listener by the electroacoustic transducer 2L like a closed-type headphone in the past. Therefore, the ear speaker device 1 does not cause uncomfortableness such as a cooped-up feeling and sweatiness the listener feels when the listener wears the closed-type headphone. Further, the ear speaker device 1 does not form closed space, therefore the ear speaker device 1 does not generate a change of a resonance frequency in the external acoustic meatus which may be generated in a case of using the closed-type headphone, and does not make the listener uncomfortable.

In addition, the ear speaker device 1 can make the listener capable of listening to the low-pitched sound at the sufficient sound volume level by putting the hole 8AL of the tubular duct 8L which is the emission aperture of the low-pitched sound close to the eardrum 103L. Therefore, the diameter of the speaker unit 7L does not have to be made bigger than necessary, and size of the housing 4L can be limited to be minimum. In this manner, the entire size and mass of the speaker device 1 can be limited to be minimum, therefore troublesomeness caused by the size and the mass of the ear speaker device 1 when the listener wears the ear speaker device 1 can be restricted as much as possible.

According to the configuration described above, the ear speaker device 1 positions the speaker unit 7L of the electroacoustic transducer 2L somewhat closer to the front than the entrance 102L of the external acoustic meatus of the listener when the ear speaker device 1 is mounted on the head 100 of the listener. At the same time, the reproduced sound is output in a state that the hole 8AL of the tubular duct 8L is positioned in the vicinity of the entrance 102L of the external acoustic meatus. In this manner, the ear speaker device 1 can allow the low-pitched sound emitted from the hole 8AL of the tubular duct 8L working as the bass reflex duct to reach the eardrum 103 at the sufficient sound pressure level. Therefore, the ear speaker device 1 can make the listener capable of listening to the excellent reproduced sound having the sufficient sound pressure level down to the comparatively low frequencies while providing the natural sound image localization.

(1-4) Another Embodiment with Respect to First Embodiment

In the first embodiment described above, the description is made with respect to the case where the tubular duct 8L has a side surface formed in a substantial U-shape and is made to function as the two bass reflex ducts with the hole 8AL in the middle. However, the present invention is not limited thereto, and the tubular duct 8L may be configured with one or three or more tubular ducts.

Figure 19:
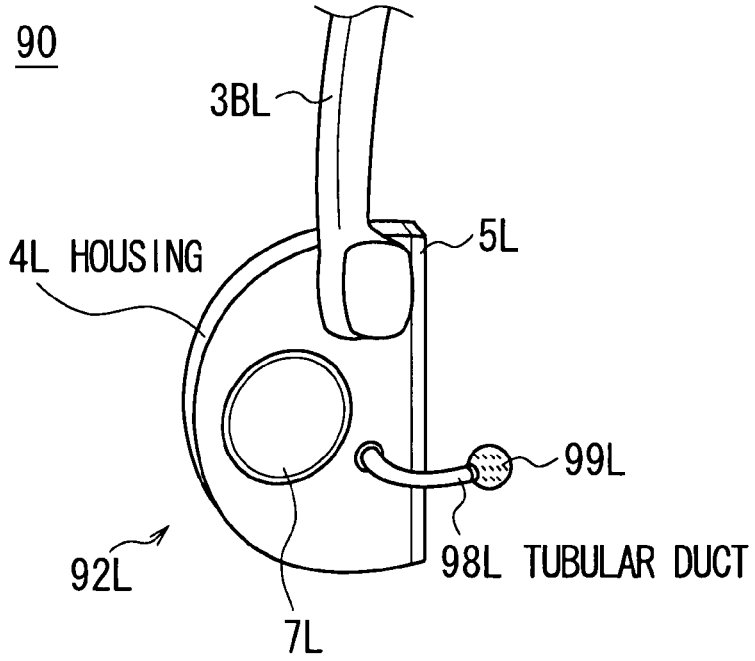
FIG. 19 is a schematic perspective view showing a configuration example (1) of the tubular duct according to another embodiment.

For example, as shown in FIG. 19, in an electroacoustic transducer 92L of an ear speaker device 90, one tubular duct 98L functioning as the bass reflex duct may extend from the housing 4L to the rear direction. Further, a protective part 99L for protecting the entrance 102L of the external acoustic meatus of the listener may be attached to the end part of the tubular duct 98L. In this case, the protective part 99L is configured with a sponge member and the like through which a sound can easily pass through. Thereby, the surround sound is not blocked and can be listened to by the listener.

In addition, in the first embodiment, the description was made with respect to the case of using the tubular duct 8L made of a hard material such as metal. However, the present invention is not limited thereto, and the tubular duct 8L made of a soft material such as flexible resin may be used.

Further, in the first embodiment, the description was made with respect to the case that the tubular duct 8L is provided so as to pass through the baffle plate 4AL of the housing 4L. However, the present invention is not limited thereto, and the tubular duct 8L may be provided so as to pass through another side surface of the housing 4L.

Further, in the first embodiment, the description was made with respect to the case where the sound emitting surface of the speaker unit 7L is oriented to a substantially rear direction when the ear speaker device 1 is mounted on the head 100 (FIG. 4) of the listener. However, the present invention is not limited thereto, and for example, the sound emitting surface of the speaker unit 7L may be oriented somewhat to the inner side. What is important here is that the sound emitting surface of the speaker unit 7L has to be directed to a substantial direction of the entrance 102L of the external acoustic meatus, and the middle-pitched and the high-pitched sounds being emitted have to be allowed to efficiently reach the eardrum 103L.

Further, in the first embodiment, the description was made with respect to the case where the ear speaker device 1 has the left and the right electroacoustic transducers 2L and 2R, and outputs the reproduced sound of two channels. However, the present invention is not limited thereto, and, for example, the ear speaker device 1 may have only the electroacoustic transducer 2L on the left side and output the reproduced sound of one channel.

Further, in the first embodiment, the description was made with respect to the case where the speaker unit 7L for the middle-pitched and the high-pitched sounds is provided in the housing 4L. However, the present invention is not limited thereto, and a plurality of speaker units may be provided in the housing 4L in a manner that, for example, two speaker units for the middle-pitched sound and the high-pitched sound are provided in the housing 4L to configure a two-way speaker.

Further, in the first embodiment, the description was made with respect to the case where the housing 4L having a shape of a ball being quartered in a vertical direction. However, the present invention is not limited thereto, and for example, the housing 4L may have any of a variety of shapes such as a cube shape and a cylinder shape. What is important here is that the housing 4L has to have substantially closed space that can function as an enclosure of the bass reflex speaker in the inside.

Further, in the first embodiment, the description was made with respect to the case of the housing 4L in a state of having an edge remaining at an end part of an inner end part 8BL of the tubular duct 8L (FIG. 5). However, the present invention is not limited thereto, and the housing 4L having roundness of an R-shape formed with respect to the end part of the inner end part 8BL of the tubular duct 8L may be used. In this case, in the housing 4L, air pushed out from a rear surface side of the speaker unit 7L does not hit the edge to generate wind noise, and only the low-pitched sound without the noise can be emitted from the hole 8AL of the tubular duct 8L.

Further, in the first embodiment, the description was made with respect to the case where the tubular ducts 8L and 8R are attached to the housings 4L and 4R in an integrated manner. However, the present invention is not limited thereto, and the tubular ducts 8L and 8R may be configured to be attachable and detachable.

Figure 20:
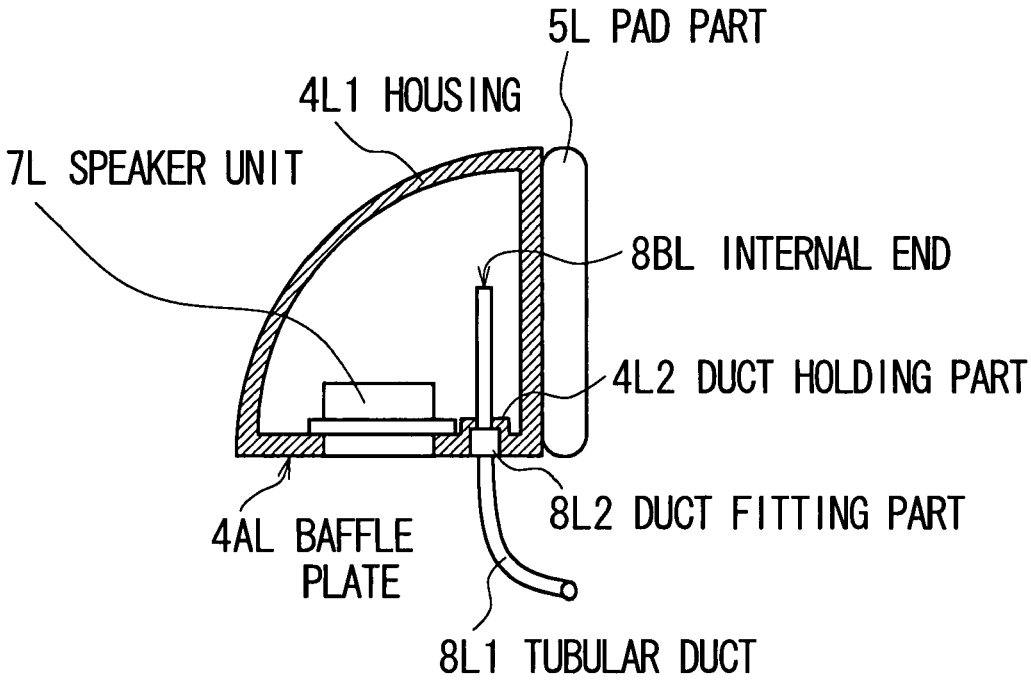
FIG. 20 is a schematic perspective view showing the configuration example (2) of the tubular duct according to another embodiment.

For example, as shown in FIG. 20 in which a corresponding part is attached with the same numerical number as found in FIG. 5, in a housing 4L1, a duct fitting part 8L2 of the tubular duct 8L1 is fitted and attached to a duct holding part 4L2 having a concave shape formed on the baffle plate 4AL of the housing 4L1. In addition, by releasing the fitting state of the duct holding part 4L2 and the duct fitting part 8L2, the tubular duct 8L1 can be detached.

Further, in the first embodiment, the description was made with respect to the case of using the tubular duct 8L having duct length from the hole 8AL to both the inner end parts 8BL is set to be the same length. However, the present invention is not limited thereto, and a tubular duct having the duct length different from the other may be used.

Figure 21:
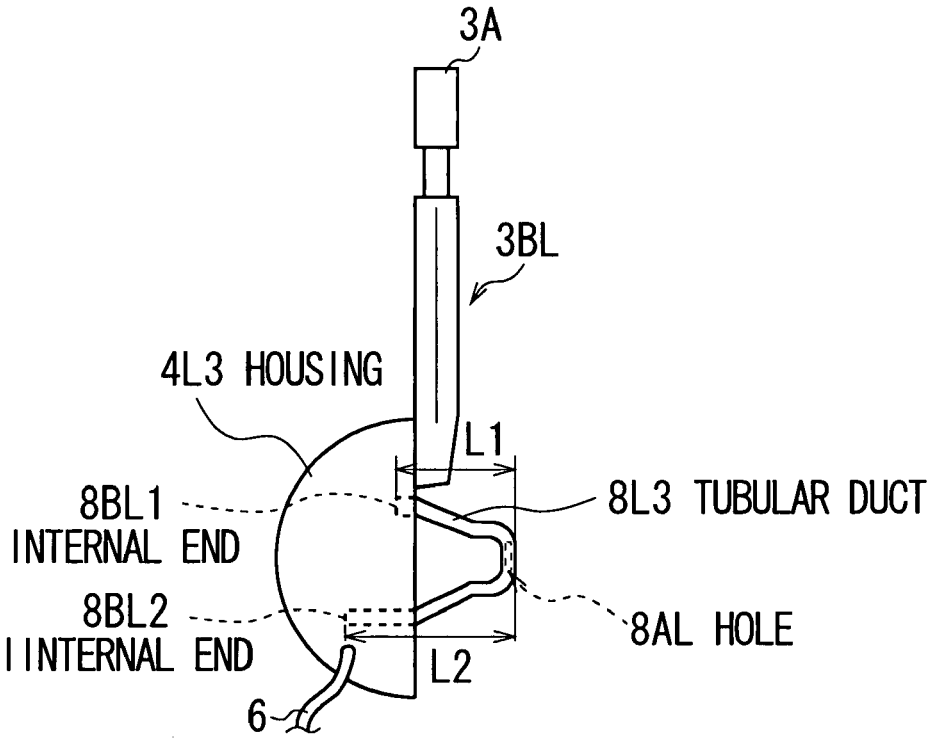
FIG. 21 is a schematic perspective view showing the configuration example (3) of the tubular duct according to another embodiment.

For example, as shown in FIG. 21 in which a corresponding part is attached to with the same numerical number as found in FIG. 4, in a housing 4L3 provided with a tubular duct 8L3 having length L1 from the hole 8AL to an inner end part 8BL1 and length L2 from the hole 8AL to an inner end part 8BL2 which are different from each other, there is a phase shift of a resonant characteristic generated between a duct part of the length L1 and a duct part of the length L2. As a result, a frequency component of the middle-pitched and the high-pitched frequencies slightly output from the hole 8AL is cancelled, and only the low-pitched sound from which the middle-pitched and the high-pitched sounds are eliminated can be emitted from the hole 8AL of the tubular duct 8L3.

Further, in the first embodiment, the description was made with respect to the case where the electroacoustic transducers 2L and 2R as the electroacoustic transducers are configured with the housings 4L and 4R as the housing, the speaker units 7L and 7R as the speaker unit, and the tubular ducts 8L and 8R as the tubular duct. However, the present invention is not limited thereto, and the electroacoustic transducer may be configured with the housing, the speaker unit, and the tubular duct, which have a variety of other configurations.

Further, in the first embodiment, the description was made with respect to the case where the ear speaker device 1 as the ear speaker device is configured with the housings 4L and 4R as the housing, the speaker units 7L and 7R as the speaker unit, the band part 3 as the mounting part, and the tubular ducts 8L and 8R as the tubular duct. However, the present invention is not limited thereto, and the ear speaker device may be configured with the housing, the speaker unit, the mounting part, and the tubular duct, which have a variety of other configurations.

(2) Second Embodiment

(2-1) Configuration of Ear Speaker Device

Figure 22:
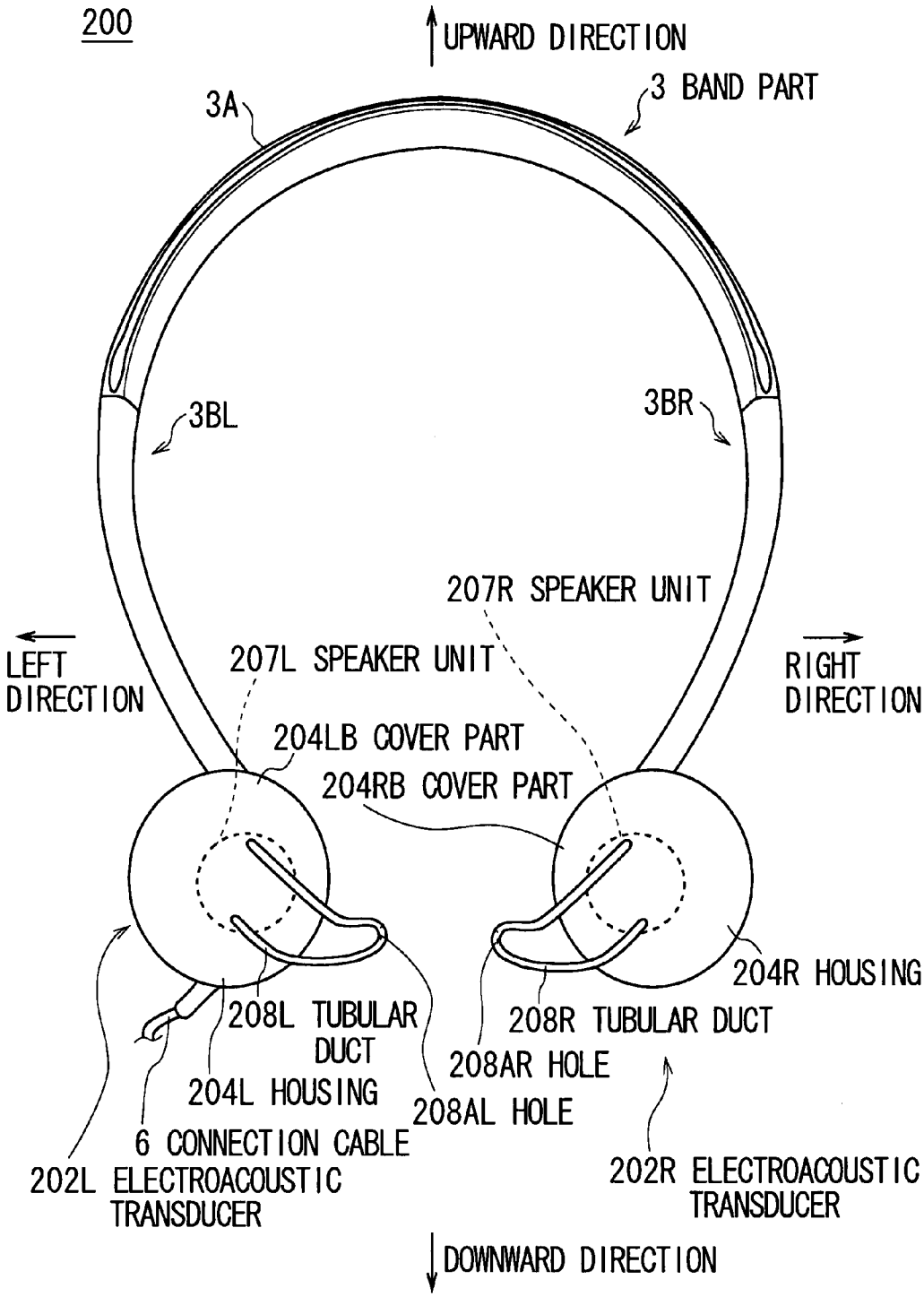
FIG. 22 is a schematic perspective view showing an entire configuration of an ear speaker device according to a second embodiment.
Figure 23:
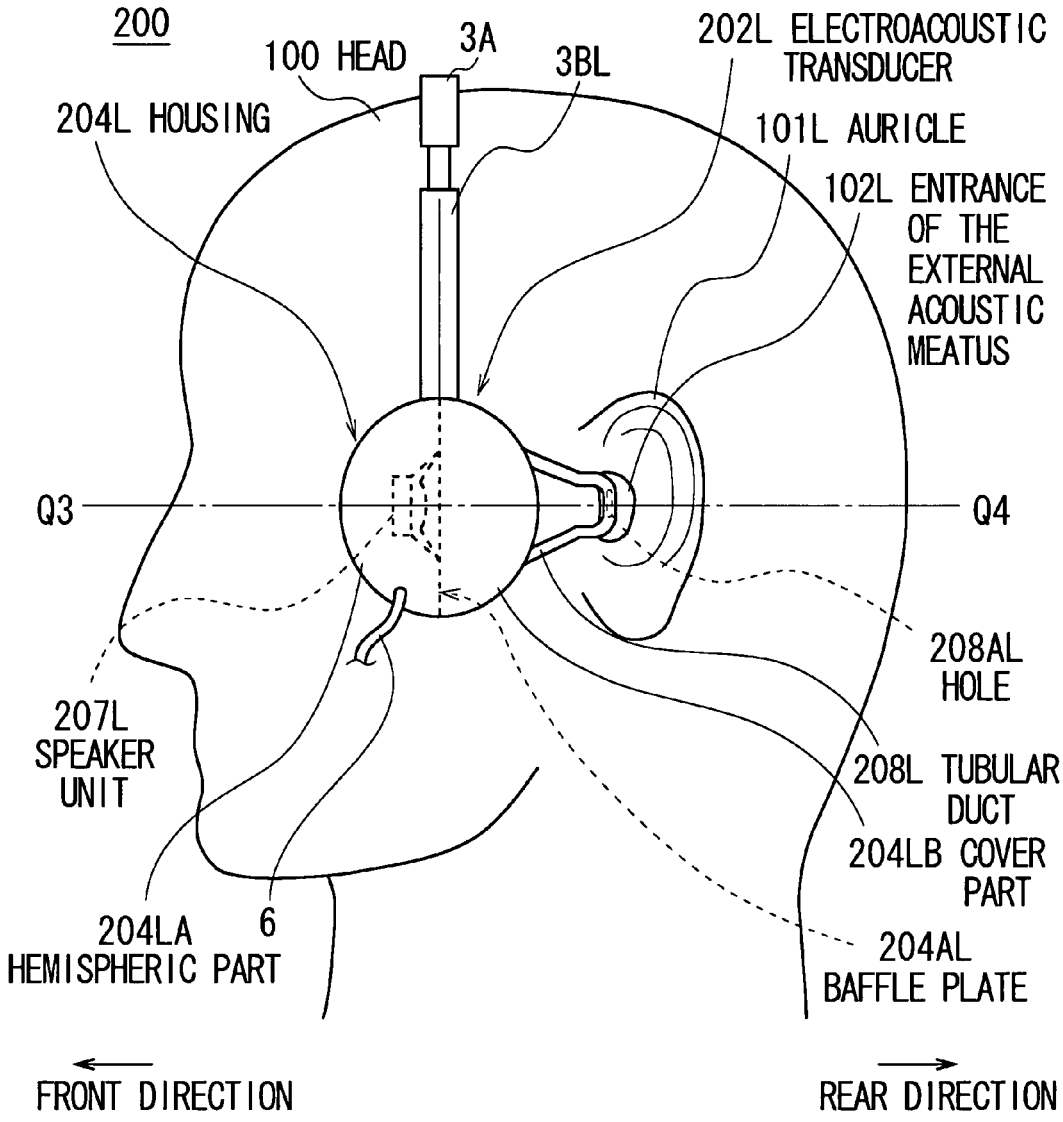
FIG. 23 is a schematic side view showing a mounting state (1) of the ear speaker device according to the second embodiment.

In FIGS. 22 and 23 in which a corresponding part is attached with the same numerical number as found in FIG. 1, the numerical number 200 shows the entire ear speaker device according to the second embodiment. The ear speaker device 200 converts the audio signal generated by reproduction processing, and so on of a portable CD player and a DMP to the reproduced sound, and makes the listener capable of listening to the reproduced sound.

The ear speaker device 200 is also premised to be mounted on the head of the listener as similar to a normal headphone device unlike a general box-type speaker device. The ear speaker device 200 is configured with electroacoustic transducers 202L and 202R that convert the audio signal to the reproduced sound and the band part 3 that mounts and fixes the electroacoustic transducers 202L and 202R on the head of the listener, as a rough classification.

The electroacoustic transducers 202L and 202R are configured centering on housings 204L and 204R having an entire shape as a substantial ball shape, and the speaker units 207L and 207R are provided inside the housings 204L and 204R, respectively.

The housing 204L (FIG. 23) is divided into a hemispheric part 204LA positioned on a front direction side and a cover part 204LB positioned on a rear direction side with the speaker unit 207L interposed therebetween. The speaker unit 207L that converts the audio signal to the reproduced sound is attached to a baffle plate 204AL of the hemispheric part 204LA.

The speaker unit 207L mainly emits the middle-pitched and the high-pitched sounds by vibrating the diaphragm in accordance with the audio signal supplied from the portable CD player, the DMP, and so on via the connection cable 6.

The cover part 204LB (FIG. 23) has a hemispheric shape that has space in the inside. The cover part 204LB covers front space of the baffle plate 204AL. Also, a tubular duct 208L that is made of metal, and is formed by curving a hollow member having predetermined thickness into a substantial U-shape on a side is attached to a substantial center of a surface of the cover part 204LB.

The tubular ducts 208L and 208R (FIG. 22) have their external end parts being curved to the inner sides on the left and the right, respectively. Further, holes 208AL and 208AR are formed on a substantial center of the external end parts, respectively.

The band part 3 is formed in a substantial arch shape so as to surround an upper part of the head of a general human being centering on a center part 3A. At the same time, the entire length of the band part 3 is made adjustable by using adjusting parts 3BL and 3BR that can slide with respect to the center part 3A in an extendible manner.

In addition, the band part 3 is formed in the arch shape having a diameter smaller than the shape of the head of the general human being and also has elastic force. Therefore, when the ear speaker device is mounted on the listener while the housings 204L and 204R are extended to the left and the right, the band part 3 tends to return to the normal shape by action of the elastic force after the mounting. In this manner, the housings 204L and 204R are held in the state that the housings contact the head of the listener.

The ear speaker device 200 is configured in substantial symmetry. Therefore, the electro acoustic transducer 202L on the left side will be mainly described hereinafter.

In practice, the ear speaker device 200 (FIG. 23) is mounted on the head 100 of the listener after length of the band part 3 is adjusted, thereby the electroacoustic transducer 202L attached to the lower end side of the adjusting part 3BL is positioned somewhat closer to the front than an auricle 101L on the head of the listener.

In the above manner, when the electroacoustic transducer 202L is mounted on the listener in a normal manner via the band part 3, the speaker unit 207L of the housing 204L is positioned somewhat closer to the front than the auricle 101L and the entrance 102L of the external acoustic meatus, and the hole 208AL of the tubular duct 208L of the cover part 204LB is positioned in the vicinity of the entrance 102L of the external acoustic meatus.

Therefore, the ear speaker device 200 can allow mainly the middle-pitched and the high-pitched sounds emitted from the speaker unit 207L to reach the inside of the external acoustic meatus of the listener directly via the cover part 204LB and the tubular duct 208L. In this manner, the ear speaker device 200 can provide the natural sound image localization in a state of less sound leakage of the middle-pitched and the high-pitched sounds than when the sounds are listened to via the general stationary speaker.

The tubular duct 208L has its end part formed in a substantial U-shape on its side surface, and therefore is configured so as not to enter into the inside of the external acoustic meatus of the listener. In this manner, the ear speaker device 200 is configured so as to be able to prevent the end part of the tubular duct 208L from hurting the inside of the external acoustic meatus in error when the listener mounts the ear speaker device 200, and so on.

Figure 24:
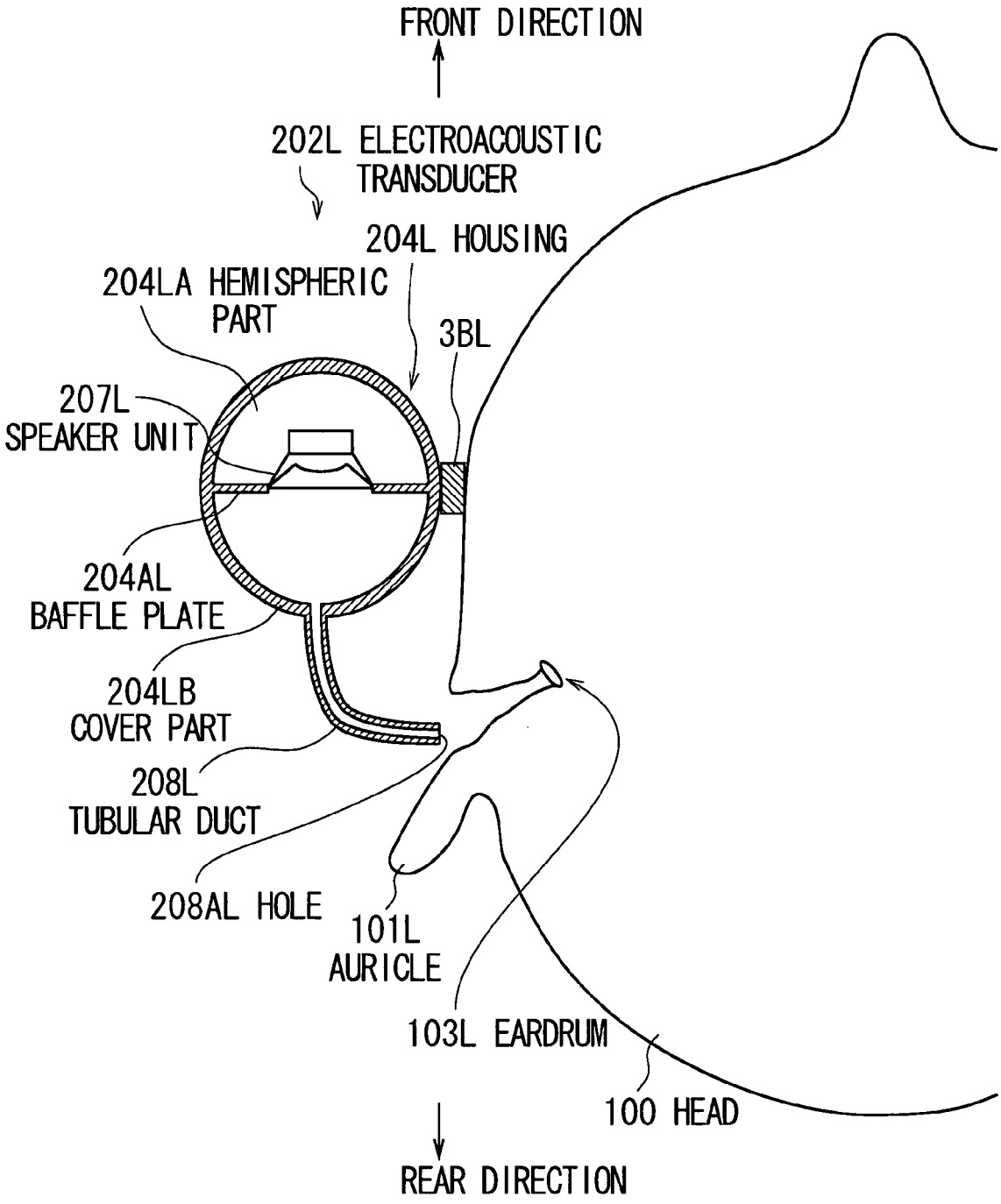
FIG. 24 is a schematic cross-sectional top view showing the mounting state (2) of the ear speaker device according to the second embodiment.

Here, as a cross section cut along the line Q3-Q4 in FIG. 23 is shown in FIG. 24, the housing 204L of the electroacoustic transducer 202L has the front space of the speaker unit 207L forming closed space excluding the hole 208AL of the tubular duct 208L. The cover part 204LB and the tubular duct 208L form a resonant circuit with respect to the speaker unit 207L.

In addition, the tubular duct 208L reaches the vicinity of the entrance 102L of the external acoustic meatus of the listener via the cover part 204LB of the housing 204L from the inside of the housing 204L. In practice, the electroacoustic transducer 202L gathers mainly the middle-pitched and the high-pitched sounds emitted from a front surface of the speaker unit 207L via the cover part 204LB and the tubular duct 208L, and allows the middle-pitched and the high-pitched sounds to directly reach the eardrum 103 of the listener from the hole 208AL of the tubular duct 208L. In this manner, the middle-pitched and the high-pitched sounds at a sufficient sound level can be listened to by the listener in a state where there is little sound leakage.

The tubular duct 208L is formed in a substantial U-shape on its side surface. Therefore, effective length of the tubular duct 208L can be set shorter as compared with a case where one tubular duct is used. Also, design and safety of the tubular duct 208L can be significantly improved.

(2-2) Configuration Example of Another Ear Speaker Device

As shown in FIGS. 22 to 24, the ear speaker device 200 in the second embodiment has the electroacoustic transducers 202L and 202R mounted on the head 100 of the listener by the band part 3 as the mounting part. However, the electroacoustic transducers 202L and 202R may be mounted on the head 100 of the listener by using a variety of other mounting parts in place of the band part 3.

Hereinafter, as similar to the case of the ear speaker device 200 described above, description will be made by taking mainly the electroacoustic transducer 202L on the left side as an example. The electroacoustic transducer 202R on the right side is configured in a symmetrical manner as the electroacoustic transducer 202L on the left side.

Figure 25:
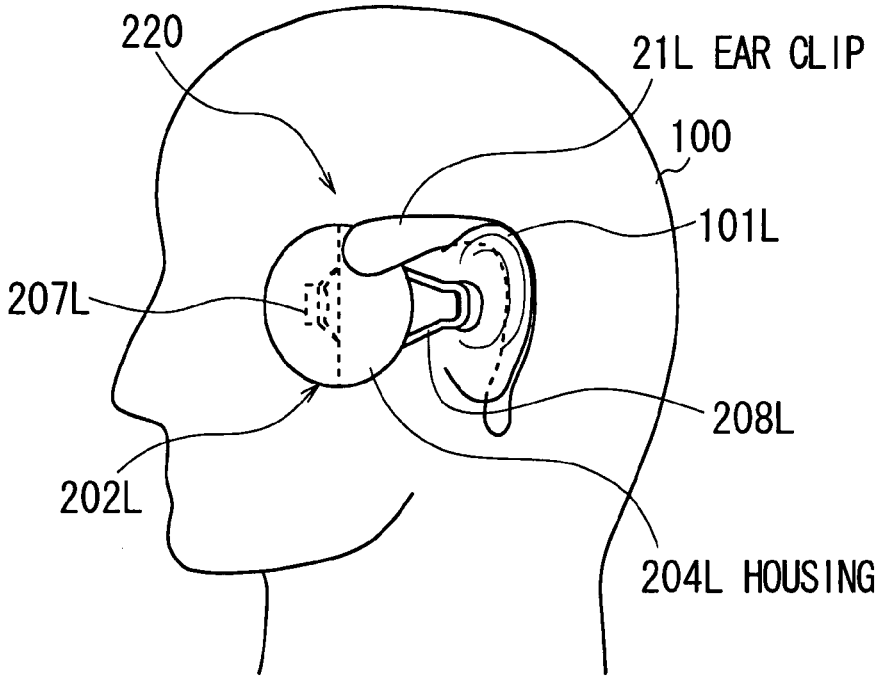
FIG. 25 is a schematic side view showing an example (1) of a configuration and mounting of the ear speaker device according to the second embodiment.

For example, as shown in FIG. 25 in which a corresponding part is attached with the same numerical number as found in FIG. 12, a so-called ear-clip type ear speaker device 220 having the ear clip 21L to be hung on the auricle 101L of the listener attached to the housing 204L of the electroacoustic transducer 202L in place of the band part 3 of the ear speaker device 200 (FIGS. 22 to 24) in the second embodiment can be considered.

The ear speaker device 220 (FIG. 25) in the above case allows mainly the middle-pitched and the high-pitched sounds emitted from the speaker unit 207L to directly reach the inside of the external acoustic meatus of the listener via the cover part 204LB and the tubular duct 208L. Therefore, the ear speaker device 220 can provide the natural sound image localization in a state that there is less sound leakage of the middle-pitched and the high-pitched sounds than when the sounds are listened to via the general stationary speaker.

Figure 26:
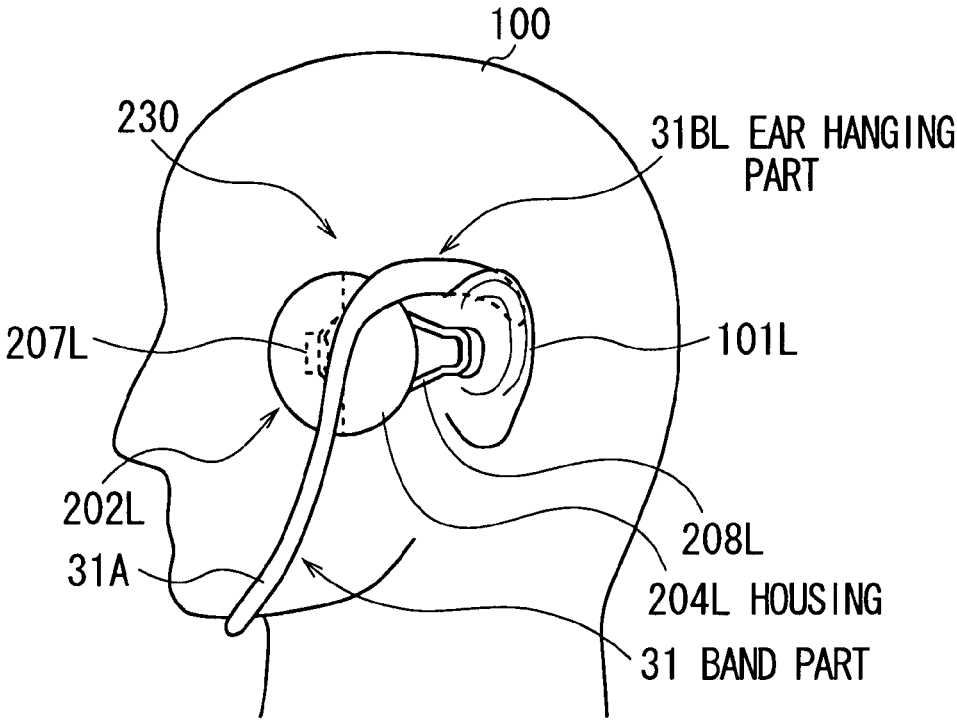
FIG. 26 is a schematic side view showing an example (2) of the configuration and the mounting of the ear speaker device according to the second embodiment.

In addition, as shown in FIG. 26 in which a corresponding part is attached with the same numerical number as found in FIG. 13, a so-called under-chin type ear speaker device 230 having a band part 31 for connecting the electroacoustic transducers 202L and 202R on the left and right of the ear speaker device 200 (FIGS. 22 to 24) in the second embodiment and being hung on the auricle 101L of the listener attached to the housing 204L of the electroacoustic transducer 202L in place of the band part 3 of the ear speaker device 200 can be considered.

The ear speaker device 230 (FIG. 26) in the above case can also allow mainly the middle-pitched and the high-pitched sounds emitted from the speaker unit 207L to directly reach the inside of the external acoustic meatus of the listener via the cover part 204LB and the tubular duct 208L. Therefore, the ear speaker device 230 can provide the natural sound image localization in a state that there is less sound leakage of the middle-pitched and the high-pitched sounds than when the sounds are listened to via the general stationary speaker.

Figure 27:
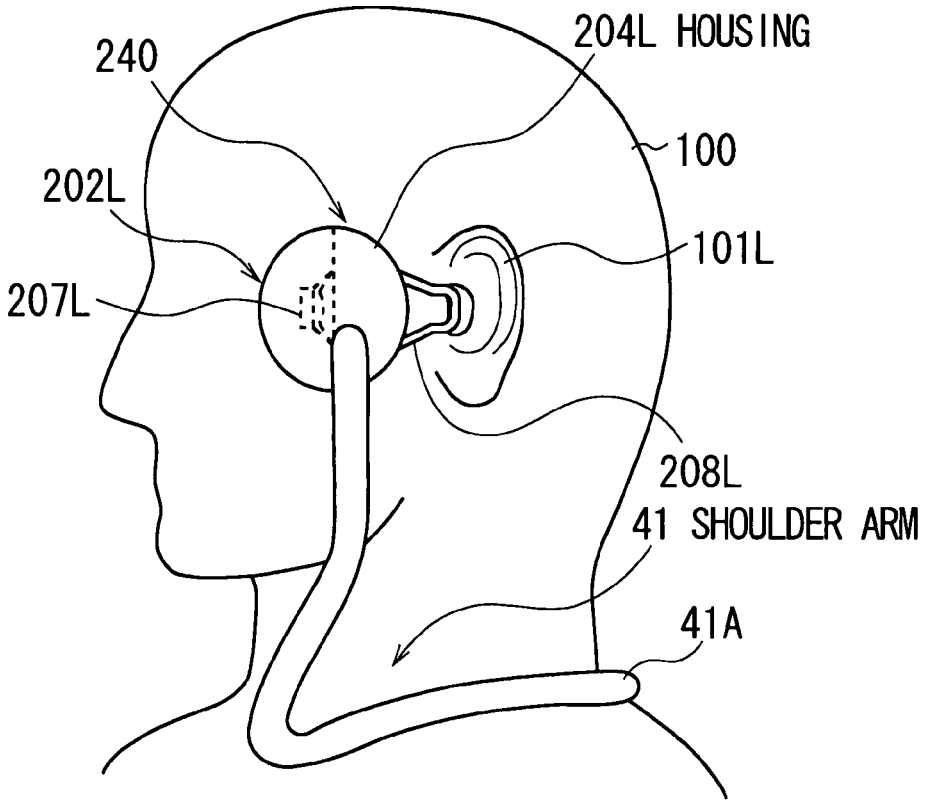
FIG. 27 is a schematic side view showing an example (3) of the configuration and the mounting of the ear speaker device according to the second embodiment.

Further, as shown in FIG. 27 in which a corresponding part is attached with the same numerical number as found in FIG. 14, a so-called shoulder-hold type ear speaker device 240 can be considered. In the shoulder-hold type ear speaker device 240, a shoulder arm 41 for connecting the electroacoustic transducers 202L and 202R on the left and right of the ear speaker device 200 (FIGS. 22 to 24) in the second embodiment is attached to the housing 204L of the electroacoustic transducer 202L in place of the band part 3 of the ear speaker device 200.

The ear speaker device 240 (FIG. 27) in the above case can also allow mainly the middle-pitched and the high-pitched sounds emitted from the speaker unit 207L to directly reach the inside of the external acoustic meatus of the listener via the cover part 204LB and the tubular duct 208L. Therefore, the ear speaker device 240 can provide the natural sound image localization in a state that there is less sound leakage of the middle-pitched and the high-pitched sounds than when the sounds are listened to via the general stationary speaker.

Figure 28:
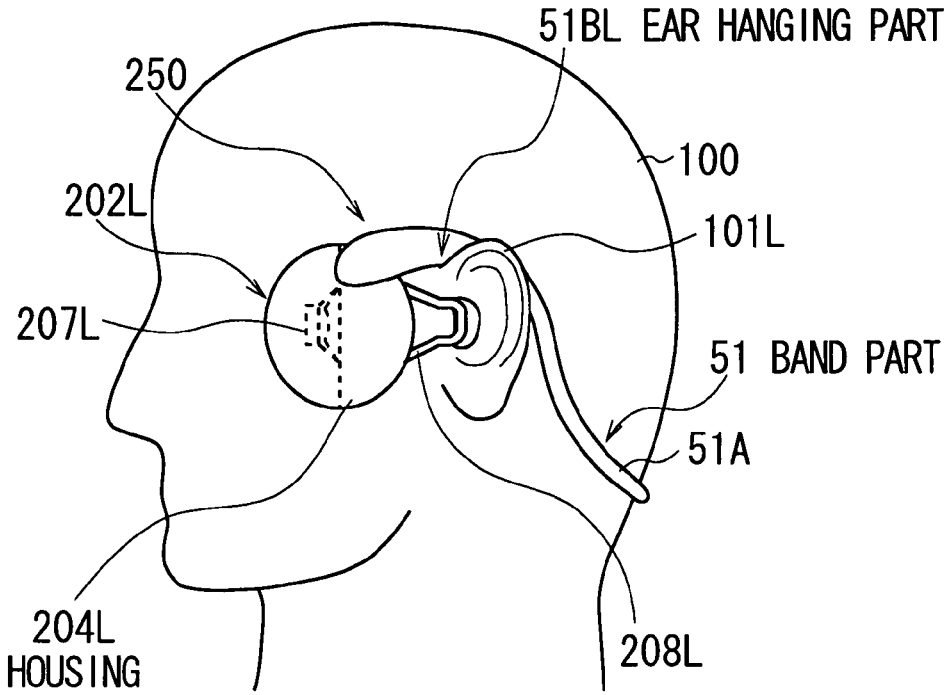
FIG. 28 is a schematic side view showing an example (4) of the configuration and the mounting of the ear speaker device according to the second embodiment.

Further, as shown in FIG. 28 in which a corresponding part is attached to with the same numerical number as found in FIG. 15, a so-called neck-band type ear speaker device 250 can be considered. In the neck-band type ear speaker device 250, a band part 51 for connecting the electroacoustic transducers 202L and 202R on the left and right of the ear speaker device 200 (FIGS. 22 to 24) in the second embodiment and being hung on the auricle 101L of the listener is attached to the housing 204L in place of the band part 3 of the ear speaker device 200.

The ear speaker device 250 (FIG. 28) in the above case can also allow mainly the middle-pitched and the high-pitched sounds emitted from the speaker unit 207L to directly reach the inside of the external acoustic meatus of the listener via the cover part 204LB and the tubular duct 208L. Therefore, the ear speaker device 250 can provide the natural sound image localization in a state that there is less sound leakage of the middle-pitched and the high-pitched sounds than when the sounds are listened to via the general stationary speaker.

Figure 29:
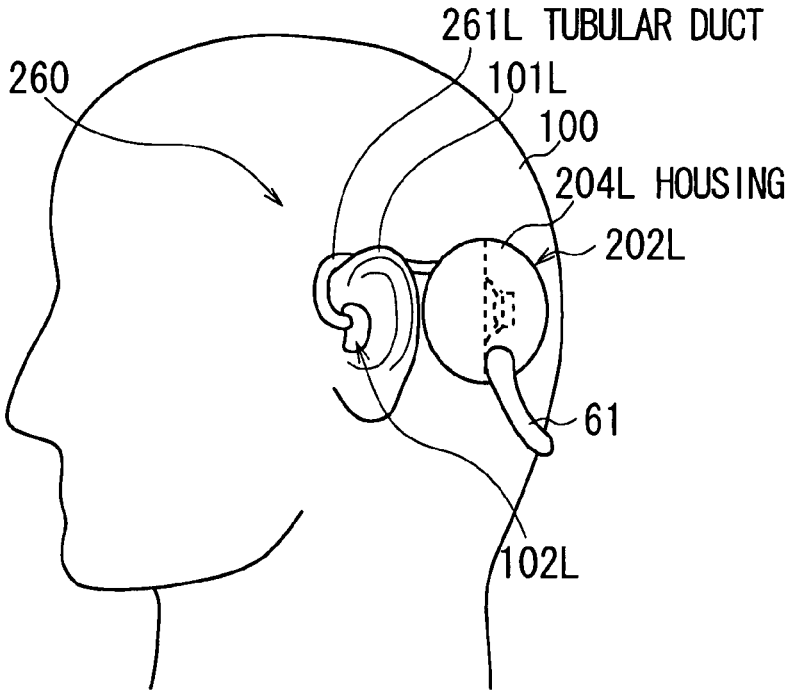
FIG. 29 is a schematic side view showing an example (5) of the configuration and the mounting of the ear speaker device according to the second embodiment.

Further, as shown in FIG. 29 in which a corresponding part is attached to with the same numerical number as found in FIG. 16, an ear speaker device 260 can be considered. The ear speaker device 260 has a configuration in which the electroacoustic transducer 202L of the ear speaker device 200 (FIGS. 22 to 24) in the second embodiment is positioned closer to the rear side than the auricle 101 of the listener, and also a tubular duct 261L having a substantial L-shape extends from the housing 204L positioned in a rear side of the auricle 101L of the listener to the vicinity of the entrance 102L of the external acoustic meatus in place of the tubular duct 208L.

The ear speaker device 260 (FIG. 29) in the above case can also allow mainly the middle-pitched and the high-pitched sounds emitted from the speaker unit 207L to directly reach the inside of the external acoustic meatus of the listener via the cover part 204LB and the tubular duct 208L. Therefore, the ear speaker device 260 can provide the natural sound image localization in a state that there is less sound leakage of the middle-pitched and the high-pitched sounds than when the sounds are listened to via the general stationary speaker.

Figure 30:
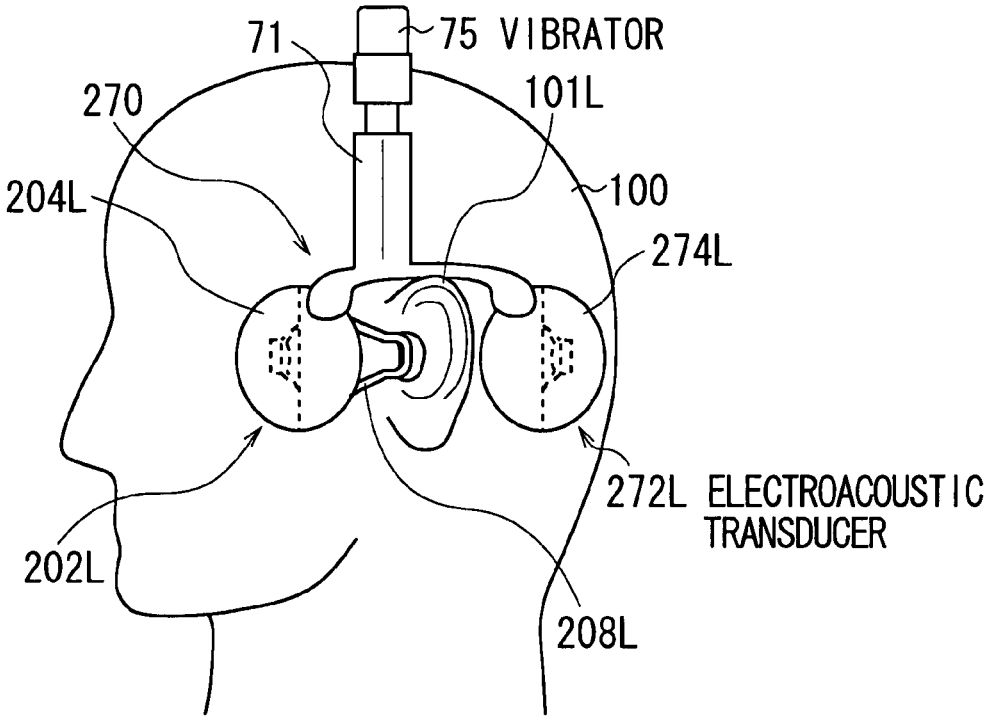
FIG. 30 is a schematic side view showing an example (6) of the configuration and the mounting of the ear speaker device according to the second embodiment.

Further, as shown in FIG. 30 in which a corresponding part is attached with the same numerical number as found in FIG. 17, a rear electroacoustic transducer 272L having a similar configuration as the electroacoustic transducer 202L is included in addition to the electroacoustic transducer 202L of the ear speaker device 200 (FIGS. 22 to 24) in the second embodiment. The band part 71 provided in place of the band part 3 in the ear speaker device 200 (FIGS. 22 to 24) positions the electroacoustic transducer 202L in front of the auricle 101L, and the electroacoustic transducer 272L in the rear of the auricle 101L.

The rear electroacoustic transducer 272L is supplied with the audio signal for the rear channel in the multi-channel sound source such as the 4-channel and the 5.1-channel.

This ear speaker device 270 (FIG. 30) can mount the electroacoustic transducer 202L and the rear electroacoustic transducer 272L on the head 100 of the listener by being mounted on the head 100 of the listener. The ear speaker device 270 can make the listener capable of listening to the excellent reproduced sound made of a surround sound and including the sufficient low-pitched sound while providing the natural sound image localization in a state that the auricle 101L is sandwiched by the electroacoustic transducer 202L and the rear electroacoustic transducer 272L.

In addition, in the above case, the ear speaker device 270 (FIG. 30) may have the vibrator 75 attached to the band part 71 to generate, for example, vibration corresponding to the deep bass component in the 5.1-channel sound source to transmit the vibration to the head 100 of the listener.

In the ear speaker device 270 (FIG. 30), apart from that the tubular duct 208L is extended from the electroacoustic transducer 202L to the vicinity of the entrance 102L of the external acoustic meatus of the listener, a tubular duct may be extended from the rear electroacoustic transducer 272L to the vicinity of the entrance 102L of the external acoustic meatus of the listener as similar to the ear speaker device 260 (FIG. 29). Alternatively, a tubular duct may be extended from both the electroacoustic transducer 202L and the rear electroacoustic transducer 272L to the entrance 102L of the external acoustic meatus of the listener.

Figure 31:
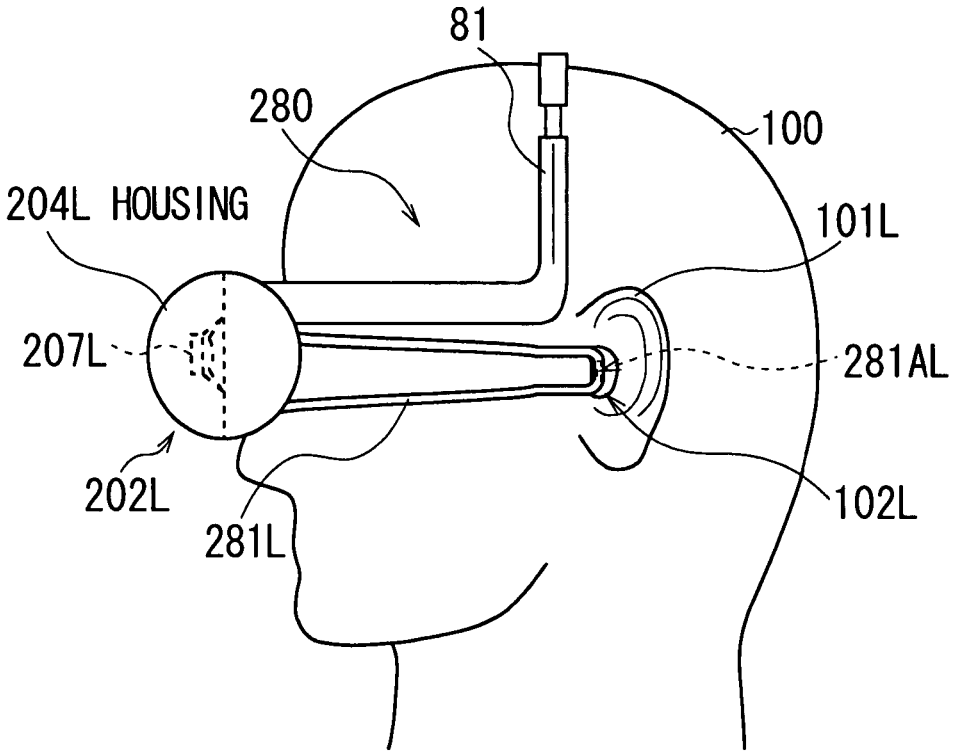
FIG. 31 is a schematic side view showing an example (7) of the configuration and the mounting of the ear speaker device according to the second embodiment.

Further, as shown in FIG. 31 in which a corresponding part is attached with the same numerical number as found in FIG. 18, an ear speaker device 280 can be considered. In the ear speaker device 280, a band part 81 that positions the electroacoustic transducer 202L of the ear speaker device 200 (FIGS. 22 to 24) in the second embodiment closer to the front side than the cheek of the listener is attached to the housing 204L.

In addition, the housing 204L is provided with a tubular duct 281L extending from the housing 204L to the vicinity of the entrance 102L of the external acoustic meatus of the listener in place of the tubular duct 208L. The tubular duct 281L has its inner diameter, path length of the sound, and so on appropriately calculated to emit the excellent low-pitched sound in the reproduced sound from a hole 281AL.

The ear speaker device 280 (FIG. 31) can position the housing 204L closer to the front than the cheek of the listener by being mounted on the head 100 of the listener. In this case, the middle-pitched and the high-pitched sounds emitted from the speaker unit 207L have their characteristics changed by being reflected on the cheek of the listener, and so on. Therefore, as compared with the case of the ear speaker device 200, the middle-pitched and the high-pitched sounds are made even closer to the sound emitted from the general stationary speaker. In this manner, the ear speaker device 280 can make the listener capable of listening to the reproduced sound that can provide better natural localization.

As described above, in the present invention, the electroacoustic transducers 202L and 202R may be mounted on the head 100 of the listener by the mounting parts in a variety of modes such as ear speaker devices 220 to 280 (FIGS. 22 to 24), other than the band part 3 (FIGS. 25 to 31) in the ear speaker device 200.

(2-3) Operation and Advantageous Effect in Second Embodiment

In the above configuration, the ear speaker device 200 gathers mainly the middle-pitched and the high-pitched sounds emitted from the speaker unit 207L provided on the housing 204L of the electroacoustic transducer 202L via the cover part 204LB to the tubular duct 208L by being mounted on the head 100 of the listener. Then, the ear speaker device 200 outputs the middle-pitched and the high-pitched sounds from the hole 208AL of the tubular duct 208L positioned in the vicinity of the entrance 102L of the external acoustic meatus.

Therefore, the electroacoustic transducer 202L of the ear speaker device 200 can allow the middle-pitched and the high-pitched sounds emitted from the speaker unit 207L to directly reach the eardrum 103L only from the hole 208AL of the tubular duct 208L. Therefore, the electroacoustic transducer 202L can make the listener capable of listening to the reproduced sound having a characteristic similar to the case of making the listener listening to the sound via the general speaker, without sound leakage, and can provide a sense of the natural localization as though the sound image is localized outside the head.

In addition, the ear speaker device 200 only positions the hole 208AL of the tubular duct 208L in the vicinity of the entrance 102L of the external acoustic meatus, and does not block the entrance 102L of the external acoustic meatus unlike a closed-type headphone. Therefore, the ear speaker device 200 can allow not only the reproduced sound output from the hole 208AL of the tubular duct 208L, but also the surround sound without being blocked, to reach the eardrum 103. In this manner, the ear speaker device 200 can make the listener capable of listening to the reproduced sound via the tubular duct 208L and also to the surround sound outside.

In the above manner, the ear speaker device 200 can ensure to make the listener listen to the surround sound in addition to the reproduced sound output from the hole 208AL of the tubular duct 208L, even in a case where the listener has to listen to the surround sound such as when the listener is walking and playing some sport.

In addition, the ear speaker device 200 does not cover the auricle 101L, and so on of the listener with the electroacoustic transducer 202L. Therefore, the ear speaker device 200 does not cause uncomfortableness such as a sense of closeness and sweatiness the listener feels when the listener wears the general headphone. Further, the ear speaker device 200 does not form closed space, therefore the ear speaker device 200 does not generate a change of a resonance frequency in the external acoustic meatus which may be generated in a case of using the closed-type headphone, and does not make the listener uncomfortable.

In addition, the ear speaker device 200 can make the listener capable of listening to the middle-pitched and the high-pitched sounds at the sufficient sound volume level by making the hole 208AL of the tubular duct 208L which is an emitting aperture of the reproduced sound closer to the eardrum 103L. Therefore, a diameter of the speaker unit 207L does not have to be made large unnecessarily, and size of the housing 204L can be minimized.

In this manner, the entire size and weight of the ear speaker device 200 can be limited to be minimum, therefore troublesomeness caused by the size and the weight of the ear speaker device 200 when the listener wears the ear speaker device 200 can be restricted as much as possible.

According to the configuration described above, the ear speaker device 200 positions the speaker unit 207L of the electroacoustic transducer 202L somewhat closer to the front than the entrance 102L of the external acoustic meatus of the listener when the ear speaker device 200 is mounted on the head 100 of the listener. Also, the ear speaker device 200 gathers mainly the middle-pitched and the high-pitched sounds emitted from the speaker unit 207L via the cover part 204LB to the tubular duct 208L without leaking to the outside, and outputs the reproduced sound based on the sound signal from the hole 208AL of the tubular duct 208L positioned in the vicinity of the entrance 102L of the external acoustic meatus. In this manner, the ear speaker device 200 can allow the middle-pitched and the high-pitched sounds emitted from the hole 208AL of the tubular duct 208L to reach the eardrum 103 at the sufficient sound pressure level. Therefore, the ear speaker device 200 can make the listener capable of listening to the excellent reproduced sound at the sufficient sound pressure level while providing the natural sound image localization.

(2-4) Another Embodiment with Respect to Second Embodiment

In the second embodiment described above, the description was made with respect to the case where the tubular duct 208L is formed in a substantial U-shape on its side surface, and is configured with two tubular ducts with the hole 208AL located on a border therebetween. However, the present invention is not limited thereto, and the tubular duct 208L may be configured with one or three or more tubular ducts.

Figure 32:
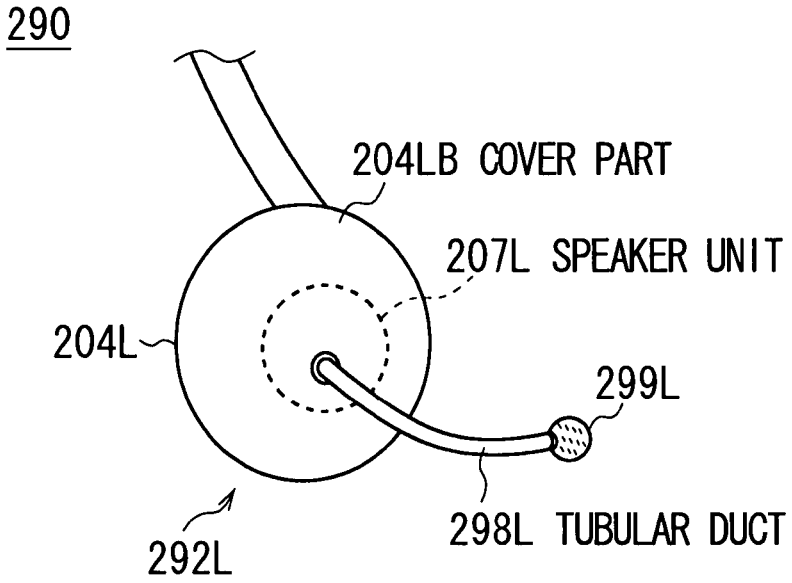
FIG. 32 is a schematic perspective view showing a configuration example (4) of a tubular duct according to another embodiment.

For example, as shown in FIG. 32, in an electroacoustic transducer 292L of an ear speaker device 290, one tubular duct 298L may be extended to a rear side from a surface of the cover part 204LB of the housing 204L. Further, a protective part 299L for protecting the entrance 102L of the external acoustic meatus of the listener may be attached to an end part on a rear side of the tubular duct 298L. In this case, the protective part 299L can make the listener capable of listening to the surround sound without being blocked by being configured with a sponge member that can easily pass a sound.

In addition, in the second embodiment, the description was made with respect to the case where the tubular duct 208L made of a hard material such as metal is used. However, the present invention is not limited thereto, and the tubular duct 208L made of a soft material such as flexible resin may be used. In this case, the inner diameter and the path length are desirably set in consideration of a difference of materials of the tubular duct 208L.

Further, in the second embodiment, the description was made with respect to the case where the sound emitting surface of the speaker unit 207L is oriented to a substantial rear direction when the ear speaker device 200 is mounted on the head 100 (FIG. 23) of the listener. However, the present invention is not limited thereto, and, for example, the sound emitting surface of the speaker unit 207L may be oriented to a somewhat inner side. What is important here is that the sound emitting surface of the speaker unit 207L is roughly oriented to a direction of the entrance 102L of the external acoustic meatus, and the middle-pitched and the high-pitched sounds being emitted are allowed to efficiently reach the eardrum 103L.

Further, in the second embodiment, the description was made with respect to the case where the ear speaker device 200 has the electroacoustic transducers 202L and 202R on the left and the right, and outputs the reproduced sound of two channels. However, the present invention is not limited thereto, and, for example, the ear speaker device 200 may have only the electroacoustic transducer 202L on the left and output the reproduced sound of one channel.

Further, in the second embodiment, the description was made with respect to the case where the speaker unit 207L for the middle-pitched and the high-pitched sounds is provided in the housing 204L. However, the present invention is not limited thereto, and, for example, a plurality of speaker units may be provided in the housing 204L in such a manner as providing two speaker units for the middle-pitched sound and the high-pitched sound in the housing 204L to make the two-way speaker.

Further, in the second embodiment, the description was made with respect to the case where the cover part 204LB having a hemispheric shape is used. However, the present invention is not limited thereto, and, for example, the cover part 204LB may have a quadrangular pyramid or a triangular pyramid shape. What is important here is that the cover part 204LB has to have a configuration that can gather the middle-pitched and the high-pitched sounds output from the speaker unit 207L and does not allow such sounds to leak to the outside.

Figure 33:
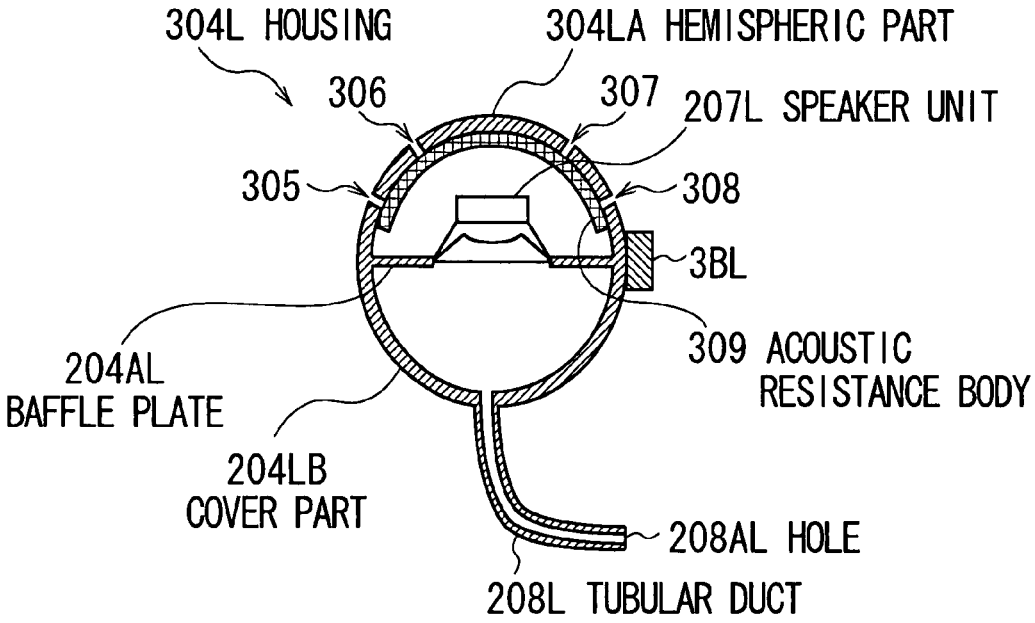
FIG. 33 is a schematic cross-sectional view showing a configuration example (1) of a housing according to another embodiment.

Further, in the second embodiment, the description was made with respect to the case where the housing 204L in which a hemispheric part 204LA configured to block a rear part of the speaker unit 207L is used. However, the present invention is not limited thereto, and as shown in FIG. 33, a housing 304L including a hemispheric part 304LA which has through holes 305 to 308 formed thereon in the rear of the speaker unit 207L, and at the same time, an acoustic resistance body 309 made of sponge and so on attached thereto in a manner as blocking the through holes 305 to 308 from an inner side thereof may be used.

In the housing 304L (FIG. 33) in the above case, the diaphragm of the speaker unit 207L easily complies with the audio signal by a rear side of the speaker unit 207L being opened by the through holes 305 to 308. At the same time, lowering of sound quality due to the forming of the through holes 305 to 308 can be prevented by the acoustic resistance body 309. In this manner, the middle-pitched and the high-pitched sounds with high quality can be emitted from the hole 208AL of the tubular duct 208L.

In the housing 304L (FIG. 33), the acoustic resistance body 309 does not have to be provided. The acoustic resistance body 309 can be attached as necessary, and the sound quality can be adjusted by attaching the acoustic resistance body 309 with its length and thickness changed.

Figure 34:
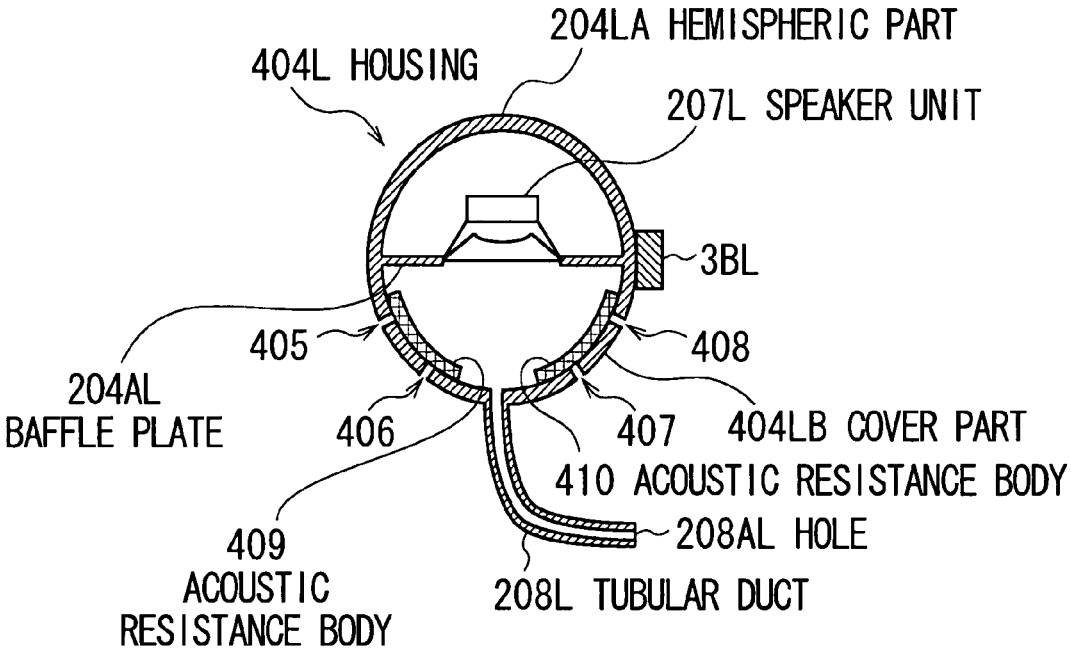
FIG. 34 is a schematic cross-sectional view showing a configuration example (2) of the housing according to another embodiment.

Further, in the second embodiment, the description was made with respect to the case where the housing 204L in which the hemispheric part 204LA configured to block the rear part of the speaker unit 207L. However, the present invention is not limited thereto, and as shown in FIG. 34, a housing 404L including a cover part 404LB which has through holes 405 to 408 formed thereon in the front of the speaker unit 207L, and at the same time, acoustic resistance bodies 409 and 410 made of sponge and so on attached thereto in a manner as blocking the through holes 405 to 408 from an inner side thereof may be used.

In the housing 404L (FIG. 34) in the above case, the diaphragm of the speaker unit 207L easily complies with the audio signal by the front side of the speaker unit 207L being opened by the through holes 405 to 408. At the same time, lowering of sound quality due to the forming of the through holes 405 to 408 can be prevented by the acoustic resistance bodies 409 and 410. In this manner, the middle-pitched and the high-pitched sounds with high quality can be emitted from the hole 208AL of the tubular duct 208L.

In the housing 404L (FIG. 34) as well, the acoustic resistance bodies 409 and 410 do not have to be provided. The acoustic resistance bodies 409 and 410 can be attached as necessary, and the sound quality can be adjusted by attaching the acoustic resistance bodies 409 and 410 with their length and thickness changed.

Figure 35:
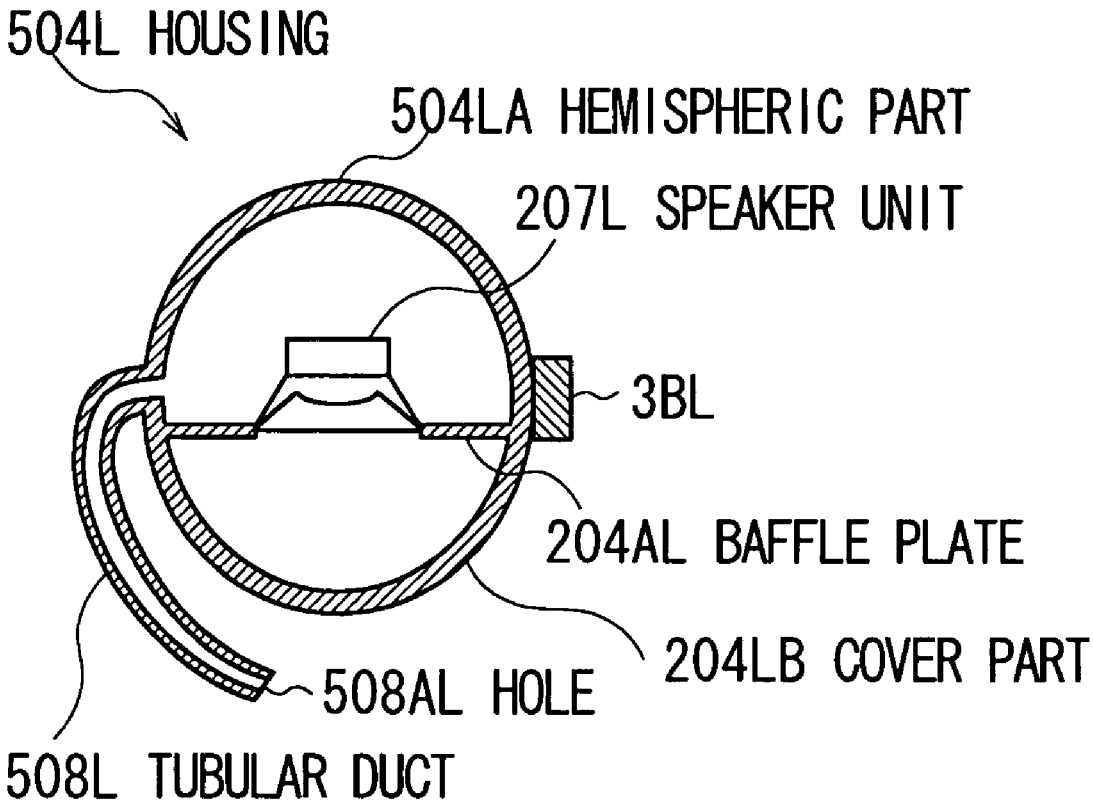
FIG. 35 is a schematic cross-sectional view showing a configuration example (3) of the housing according to another embodiment.

Further, in the second embodiment, the description was made with respect to the case where the housing 204L having the tubular duct 208L provided on a surface of the cover part 204LB is used. However, the present invention is not limited thereto, and as shown in FIG. 35, a housing 504L having a tubular duct 508L provided on a surface of a hemispheric part 504LA in an integrated manner may be used.

In the above case, the housing 504L (FIG. 35) has a similar configuration as a so-called Kelton-type speaker device. The housing 504L traps the middle-pitched and the high-pitched sounds in space in the front of the speaker unit 207L, and also can emit only the low-pitched sound in a predetermined frequency band from a rear side of the speaker unit 207L via a hole 508AL of the tubular duct 508L.

The configuration of the housing 504L (FIG. 35) is not limited to the above. The housing 504L can consider to be configured as the Kelton-type by blocking the rear space of the speaker unit 207L with a hemispheric part, and providing a tubular duct at any part of the surface of the cover part 204LB.

Figure 36:
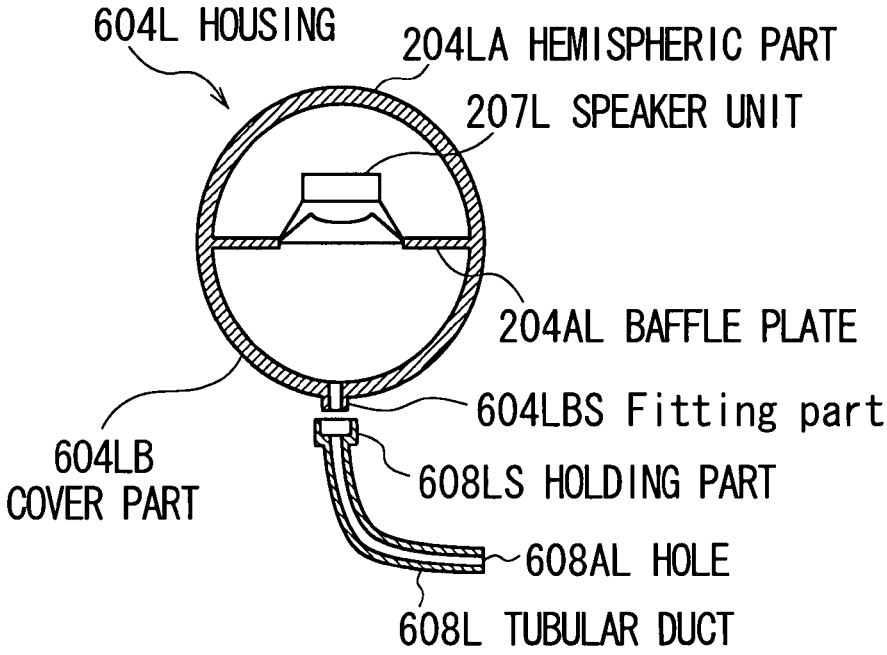
FIG. 36 is a schematic perspective view showing a configuration (5) of the tubular duct according to another embodiment.

Further, in the second embodiment, the description was made with respect to the case where the housing 204L having the tubular duct 208L formed on the surface of the cover part 204LB in an integrated state is used. However, the present invention is not limited thereto, and as shown in FIG. 36, a housing 604L having a configuration where a tubular duct 608L is provided on a cover part 604LB in a detachable manner in a manner that a fitting part 604LBS formed on the cover part 604LB and a holding part 608LS formed on one end of the tubular duct 608L fit to each other.

In the above manner, the housing 604L (FIG. 36) is used in a state where the tubular duct 608L is attached only when the tubular duct 608L is necessary by the listener, and is used in a state where the tubular duct 608L is detached when the tubular duct 608L is not necessary for the listener. Therefore, usability of the listener can be improved significantly.

Figure 37:
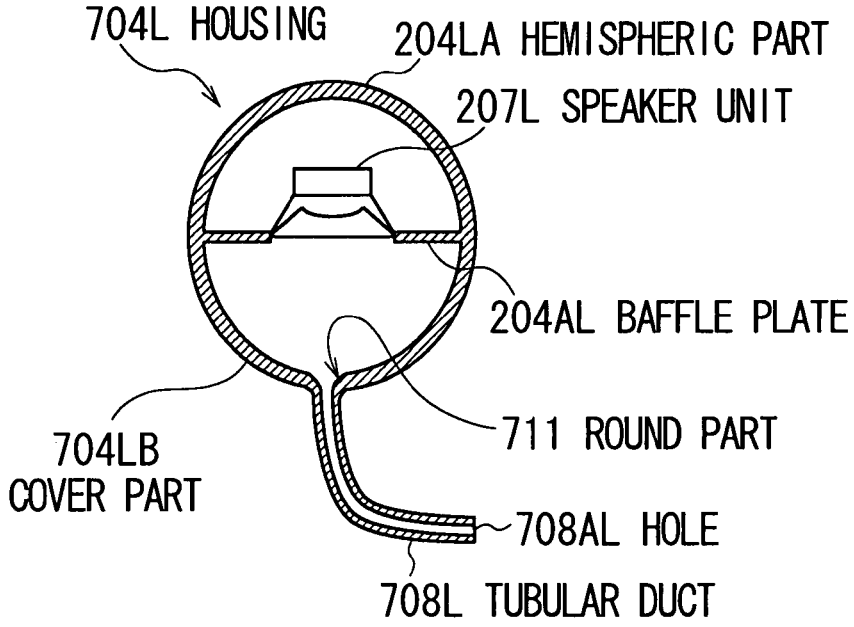
FIG. 37 is a schematic perspective view showing a configuration (6) of the tubular duct according to another embodiment.

Further, in the second embodiment, the description was made with respect to the case where the housing 204L (FIG. 24) in a state that an edge part remains in the inner side of the cover part 204LB and at a base part of the tubular duct 208L is used. However, the present invention is not limited thereto, and as shown in FIG. 37, a housing 704L having a round part 711 having an R-shape formed in an inner side of a cover part 704LB, and at a base part of the tubular duct 708L may be used.

In the housing 704L, air pushed out from a front surface side of the speaker unit 207L does not hit the edge part to generate wind noise, and only the middle-pitched and the high-pitched sounds of high quality can be emitted from a hole 708AL of the tubular duct 708L.

Further, in the second embodiment, the description was made with respect to the case where the housing 204L having the tubular duct 208L formed on the surface of the cover part 204LB in an integrated state. However, the present invention is not limited thereto, and a housing having a configuration where a tubular duct formed in a tubular shape with thinner diameter as it goes to an end in a form of covering the front surface side of the speaker unit 207L is attached to the baffle plate 204AL may be used without discriminating the cover part 204LB and the tubular duct 208L.

Further, in the second embodiment, the description was made with respect to the case where the tubular duct 208L having duct length from the hole 208AL to the surface of the cover part 204LB set to be the same length in both ways is used. However, the present invention is not limited thereto, and a tubular duct set to have different duct length between the both ways may be used.

Figure 38:
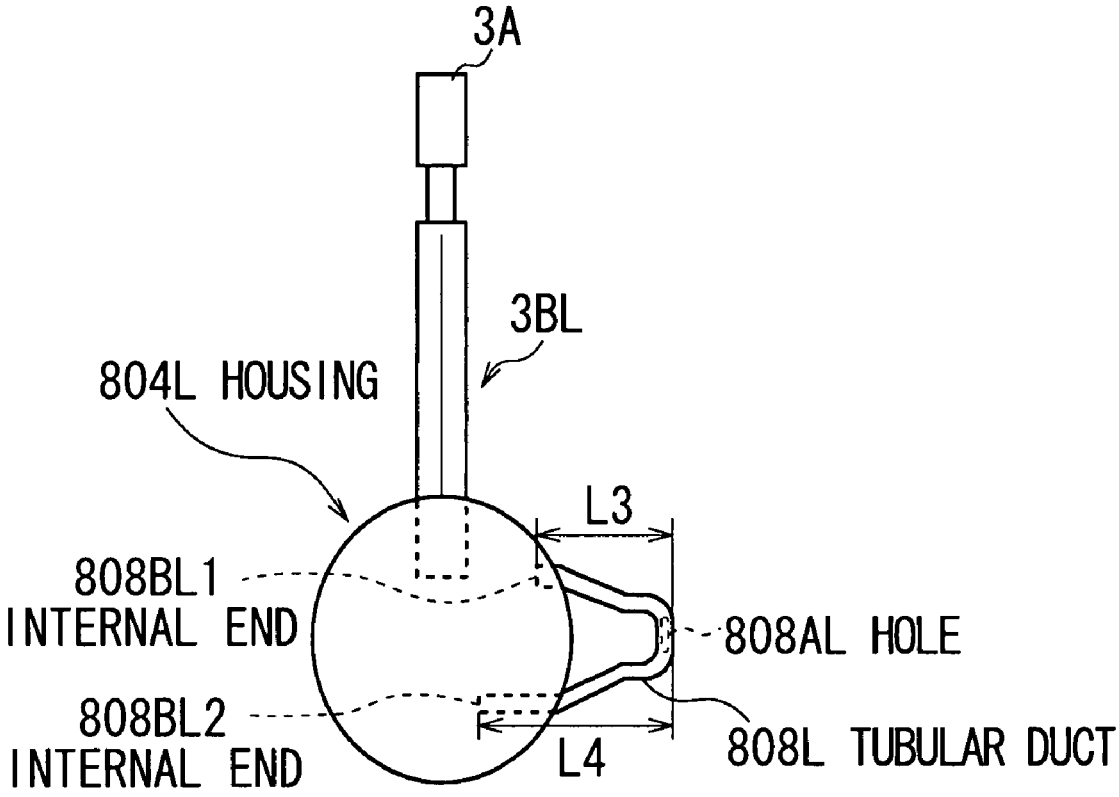
FIG. 38 is a schematic perspective view showing a configuration (7) of the tubular duct according to another embodiment.

For example, as shown in FIG. 38 in which a corresponding part is attached with the same numerical number as found in FIG. 21, in a housing 804L provided with a tubular duct 808L having length L3 from a hole 808AL to an inner end part 808BL1 and length L4 from a hole 808AL to an inner end part 808BL2 different from each other, a phase shift of a resonance characteristic between a duct part of the length L3 and a duct part of the length L4 is generated. As a result, a frequency component of middle and high frequencies slightly output from the hole 808AL is cancelled, and only the low-pitched sound obtained by canceling the middle-pitched and the high-pitched sounds can be emitted from the hole 808AL of the tubular duct 208L2.

Further, in the second embodiment, the description was made with respect to the case where the electroacoustic transducers 202L and 202R as the electroacoustic transducer are configured with the housings 204L and 204R as the housing, the speaker units 207L and 207R as the speaker unit, and the tubular ducts 208L and 208R as the tubular duct. However, the present invention is not limited thereto, and the electroacoustic transducer may be configured with a housing, a speaker unit, and a tubular duct having a variety of other configurations.

Further, in the second embodiment, the description was made with respect to the case where the ear speaker device 1 as the ear speaker device is configured with the housings 204L and 204R as the housing, the speaker units 207L and 207R as the speaker unit, the band part 3 as the mounting part, and the tubular ducts 208L and 208R as the tubular duct. However, the present invention is not limited thereto, and the ear speaker device may be configured with a housing, a speaker unit, a mounting part, and a tubular duct having a variety of other configurations.

(3) Configuration of Ear Speaker Device Having Duct of Other Figuration (3-1) Third Embodiment As shown in FIGS. 1 to 5, when the ear speaker device 1 of the first embodiment is mounted on the head 100 of the listener, the tubular ducts 8L and 8R are extended to the vicinity of the entrances 102L and 102R (not shown) of the external acoustic meatus respectively, and ducts of various figurations may be employed instead of the tubular ducts 8L and 8R.

Figure 39:
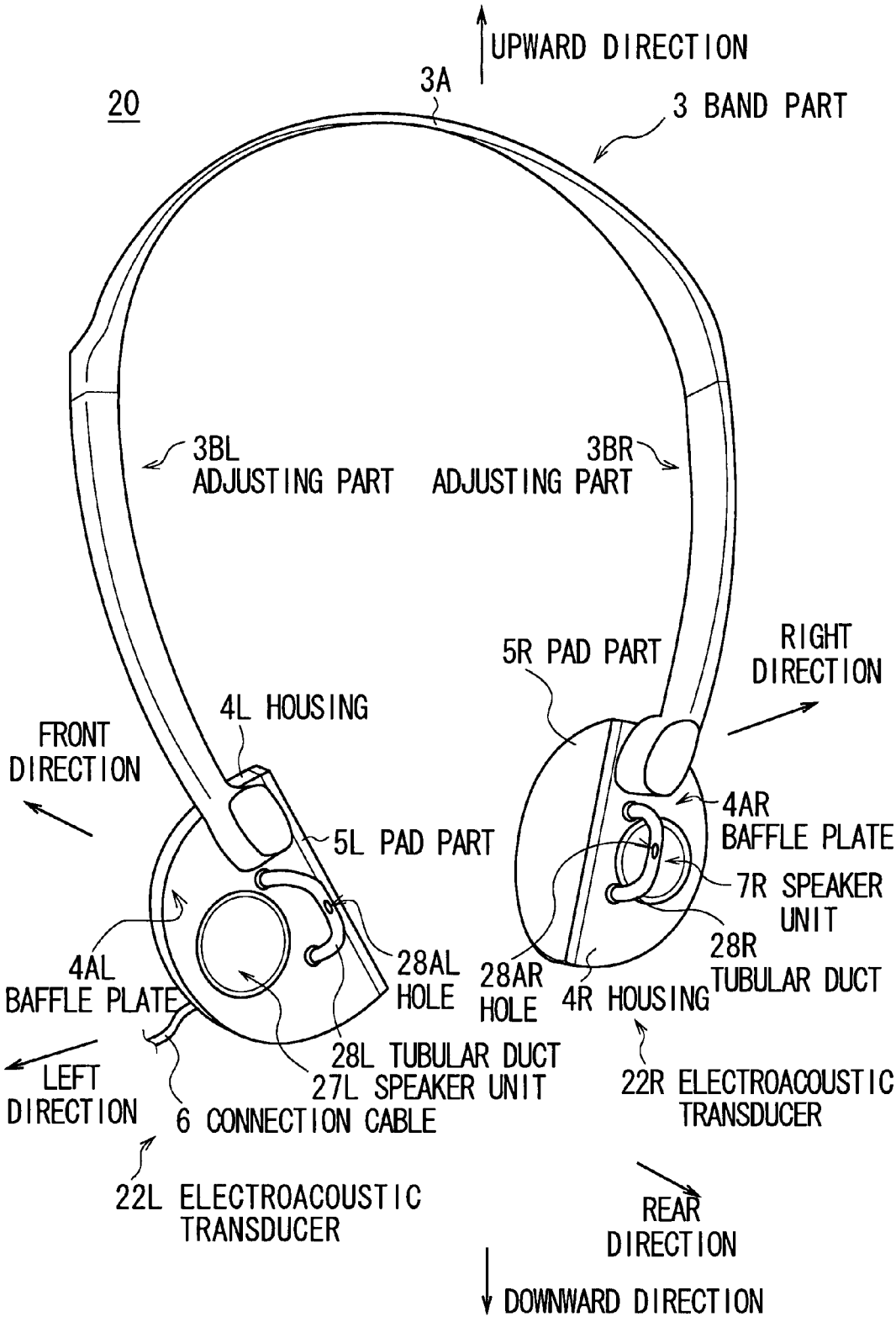
FIG. 39 is a schematic perspective view showing an entire configuration of an ear speaker device according to a third embodiment.
Figure 40:
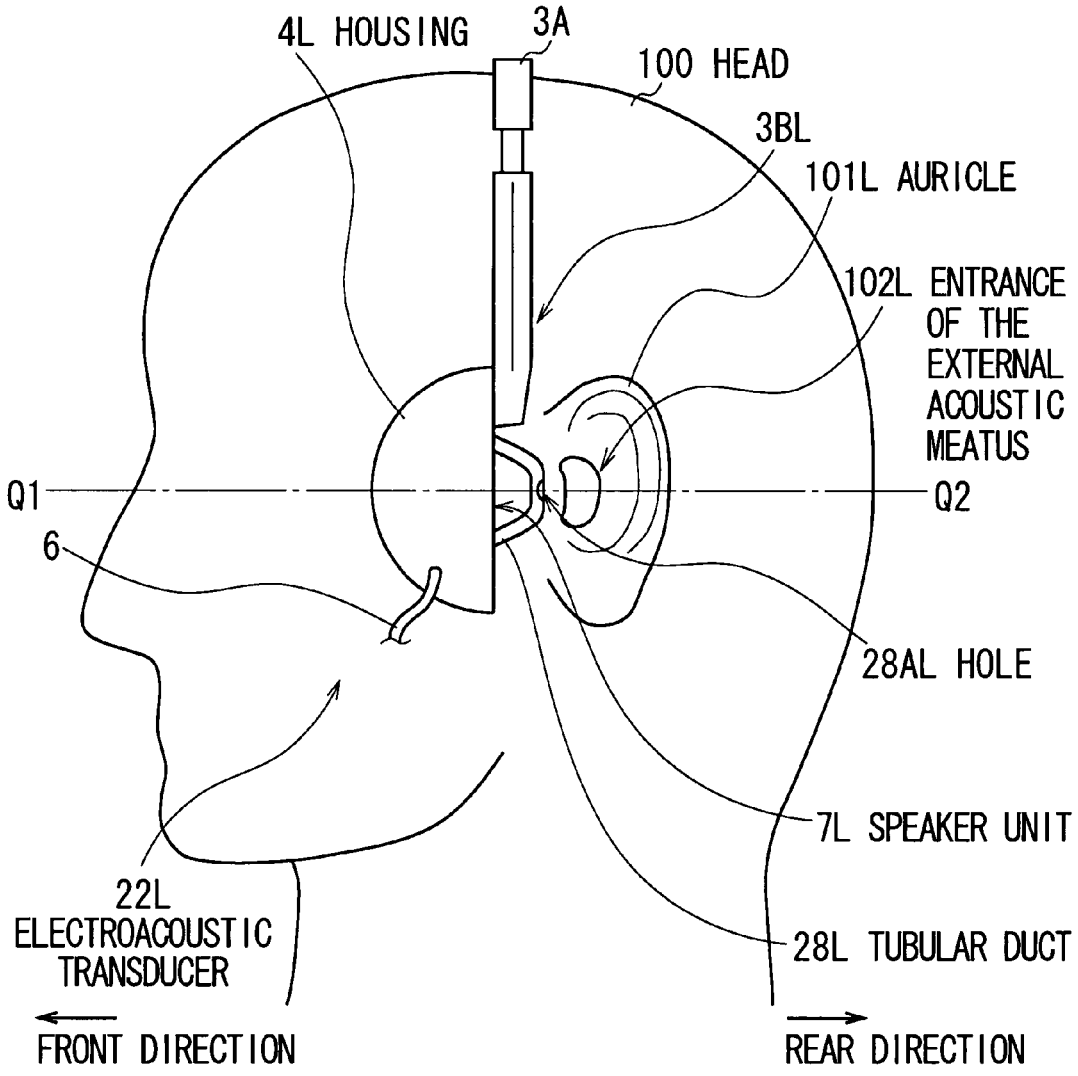
FIG. 40 is a schematic side view showing a mounting state (1) of the ear speaker device according to the third embodiment.
Figure 41:
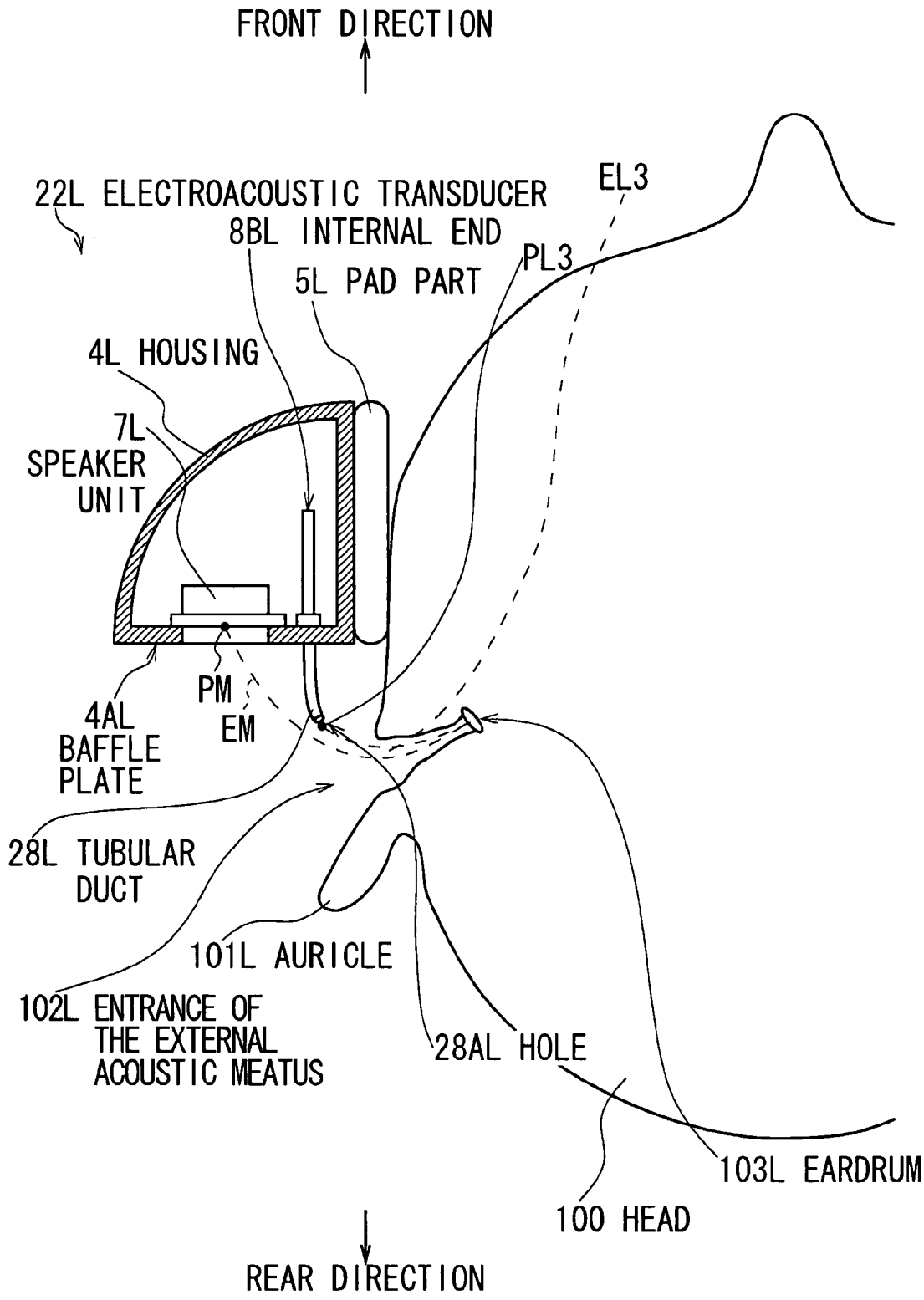
FIG. 41 is a schematic cross-sectional top view showing the mounting state (2) of the ear speaker device according to the third embodiment.

As shown in FIGS. 39 to 41 corresponding to FIGS. 1, 4 and 5, the ear speaker device 20 corresponding to the ear speaker device 1 has electroacoustic transducers 22L and 22R instead of the electroacoustic transducers 2L and 2R.

The electroacoustic transducers 22L and 22R have tubular ducts 28L and 28R instead of the tubular ducts 8L and 8R. Similar to the tubular ducts 8L and 8R, the tubular ducts 28L and 28R are formed by curving a hollow member into a substantial U-shape respectively on sides. On the other hand, the length of parts of the tubular ducts 28L and 28R protruding from the baffle plates 4AL and 4AR is shorter than that of the tubular ducts 8L and 8R protruding therefrom, and holes 28AL and 28AR are provided on a substantial center of each of end parts on the rear side.

Accordingly, when the ear speaker device 20 is mounted on the head 100 of the listener, as shown in FIGS. 40 and 41, the holes 28AL and 28AR of the tubular ducts 28L and 28R are positioned at locations somewhat distant from the entrances 102L and 102R (not shown) of the external acoustic meatus.

Thus, the ear speaker device 20 does not have to make the tubular ducts 28L and 28R come into contact with the external ear etc. of the listener, which can significantly reduce the possibility of giving an uncomfortable feeling to the listener.

With respect to the electroacoustic transducer 22L of the ear speaker device 20, while the path length EL3 (FIG. 41) is longer than the path length EL1 (FIG. 5) of the ear speaker device 1, similar to the ear speaker device 1, a relationship of the path length EM>the path length EL3 is obtained.

Accordingly, similar to the electroacoustic transducer 2L, the electroacoustic transducer 22L can make the low-pitched sound transmitted through the tubular duct 28L and emitted from the hole 28AL (virtual acoustical source position PL3) reach the eardrum 103L with a sound pressure level higher than that in the case of the electroacoustic transducer 12L (FIG. 6).

In this case, in the ear speaker device 20, considering that the sound pressure level of the low-pitched sound output from the electroacoustic transducer 22L becomes lower than the sound pressure level of the low-pitched sound output from the electroacoustic transducer 2L since the path length EL3 (FIG. 41)>the path length EL1 (FIG. 5), it is desired that the entire length, internal diameter, etc. of the tubular ducts 28L and 28R be adjusted.

(3-2) Fourth Embodiment

Figure 42:
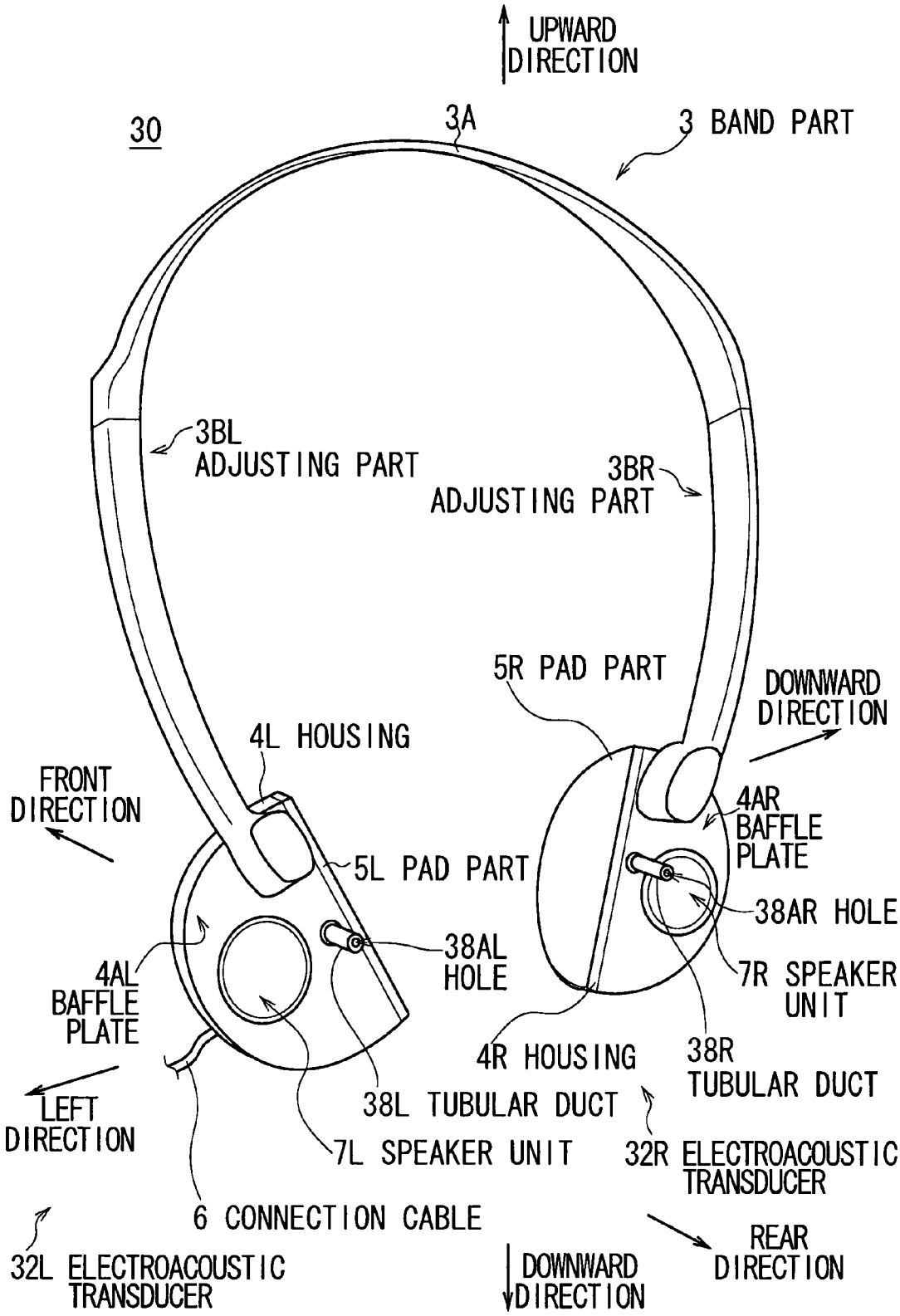
FIG. 42 is a schematic perspective view showing an entire configuration of an ear speaker device according to a fourth embodiment.
Figure 43:
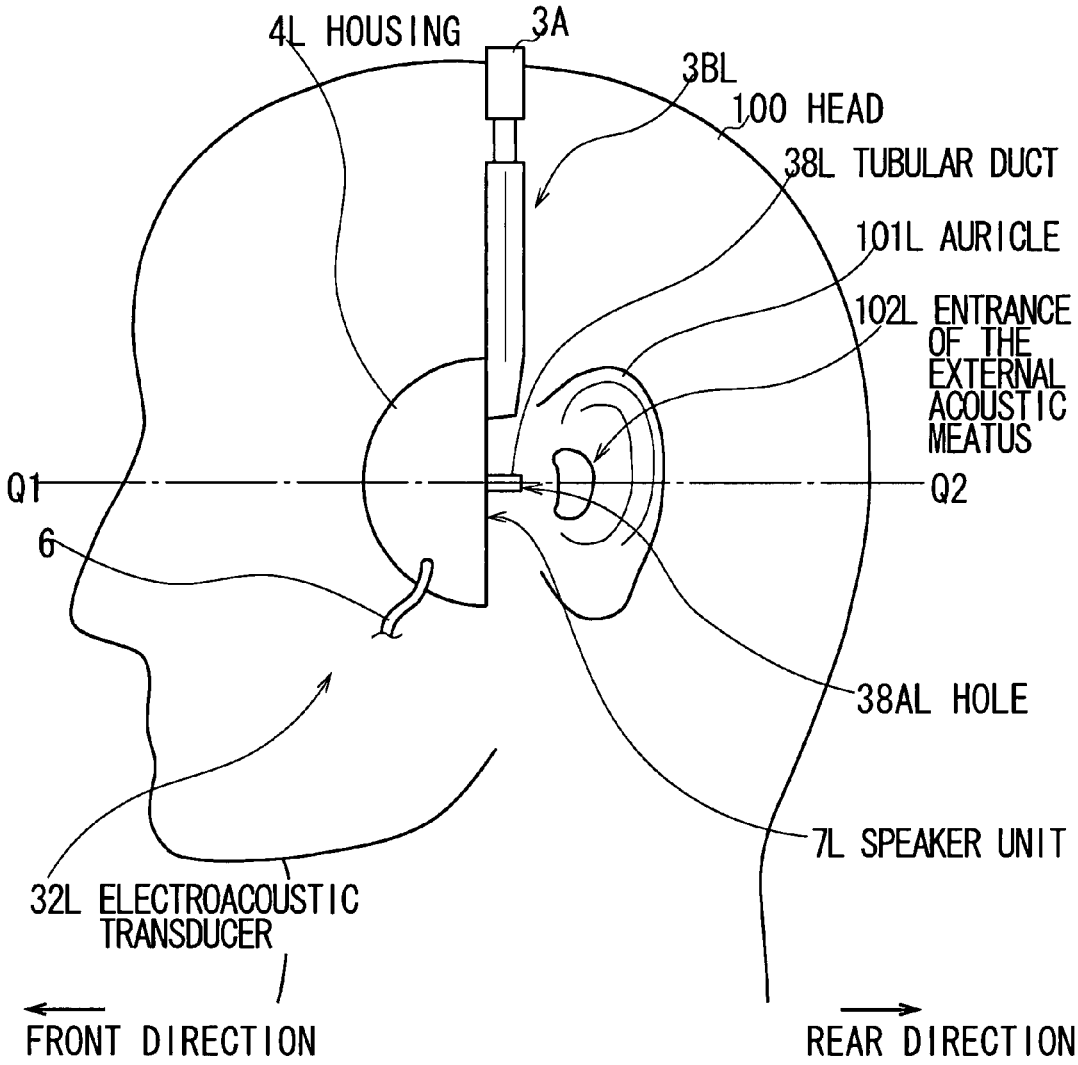
FIG. 43 is a schematic side view showing a mounting state (1) of the ear speaker device according to the fourth embodiment.
Figure 44:
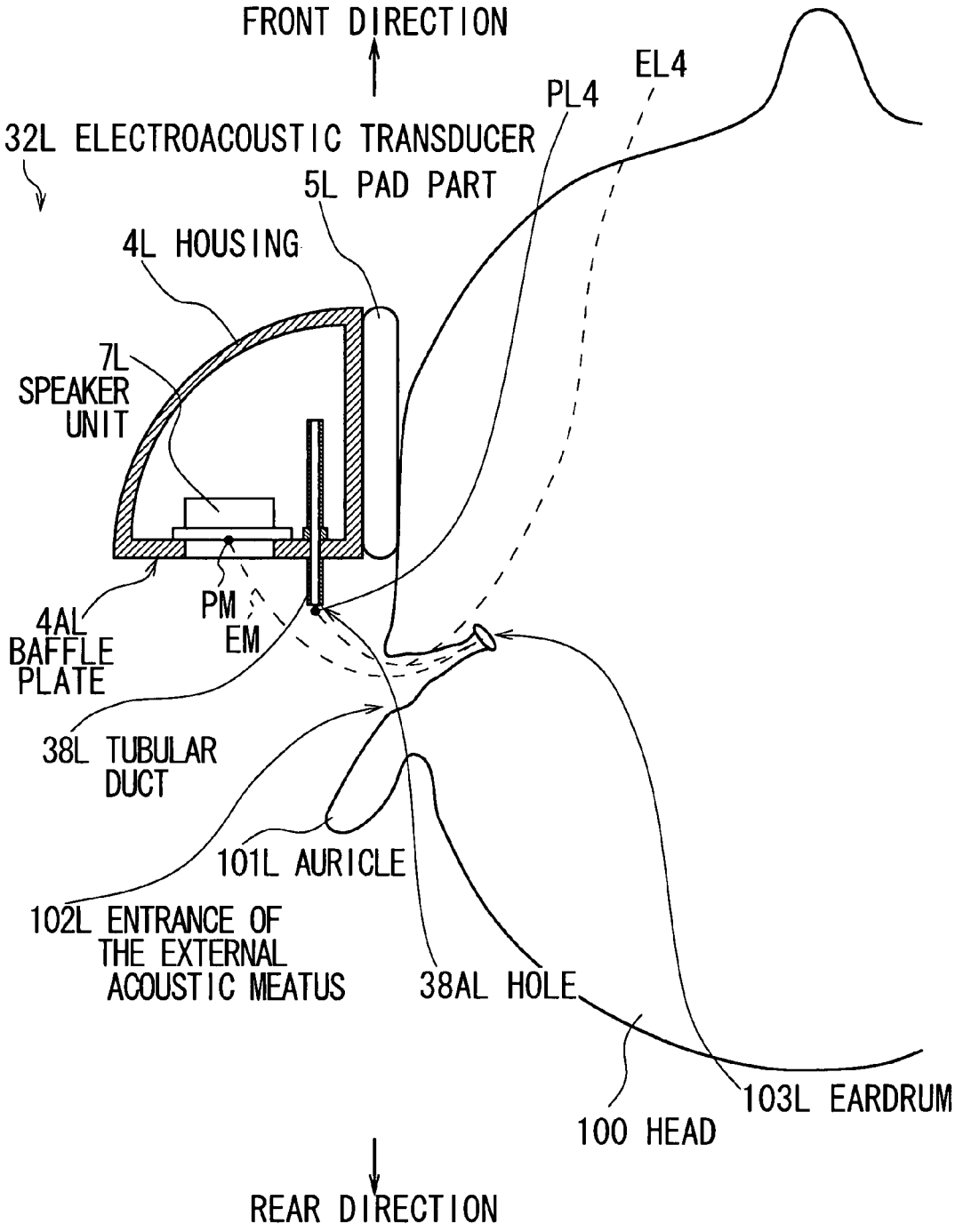
FIG. 44 is a schematic cross-sectional top view showing the mounting state (2) of the ear speaker device according to the fourth embodiment.

As shown in FIGS. 42 to 44 corresponding to FIGS. 1, 4, and 5, the ear speaker device 30 corresponding to the ear speaker device 1 has electroacoustic transducers 32L and 32R instead of the electroacoustic transducers 2L and 2R.

The electroacoustic transducers 32L and 32R have tubular ducts 38L and 38R instead of the tubular ducts 8L and 8R. The tubular ducts 38L and 38R are formed by a linear hollow tube respectively, and holes 38AL and 38AR are provided on end parts on the rear side.

Accordingly, similar to the ear speaker device 20 (FIGS. 40 and 41), when the ear speaker device 30 is mounted on the head 100 of the listener, as shown in FIGS. 43 and 44, the holes 38AL and 38AR of the tubular ducts 38L and 38R are positioned at locations somewhat distant from the entrances 102L and 102R (not shown) of the external acoustic meatus. Therefore, the ear speaker device 30 does not have to make the tubular ducts 38L and 38R come into contact with the external ear etc. of the listener.

With respect to the electroacoustic transducer 32L of the ear speaker device 30, similar to the electroacoustic transducer 22L, a relationship of the path length EM>the path length EL4 (FIG. 44) is obtained. Accordingly, the electroacoustic transducer 32L can make the low-pitched sound transmitted through the tubular duct 38L and emitted from the hole 38AL (virtual acoustical source position PL4) reach the eardrum 103L with a sound pressure level higher than that in the case of the electroacoustic transducer 12L (FIG. 6).

In this case, in the ear speaker device 30, considering that the sound pressure level of the low-pitched sound output from the electroacoustic transducer 32L becomes lower than the sound pressure level of the low-pitched sound output from the electroacoustic transducer 2L since the path length EL4 (FIG. 44)>the path length EL1 (FIG. 5), and that the figuration of the tubular ducts 8L and 8R and the figuration of the tubular ducts 38L and 38R are largely different, it is desired that the entire length, internal diameter, etc. of the tubular ducts 38L and 38R be adjusted.

(3-3) Fifth Embodiment

Figure 45:
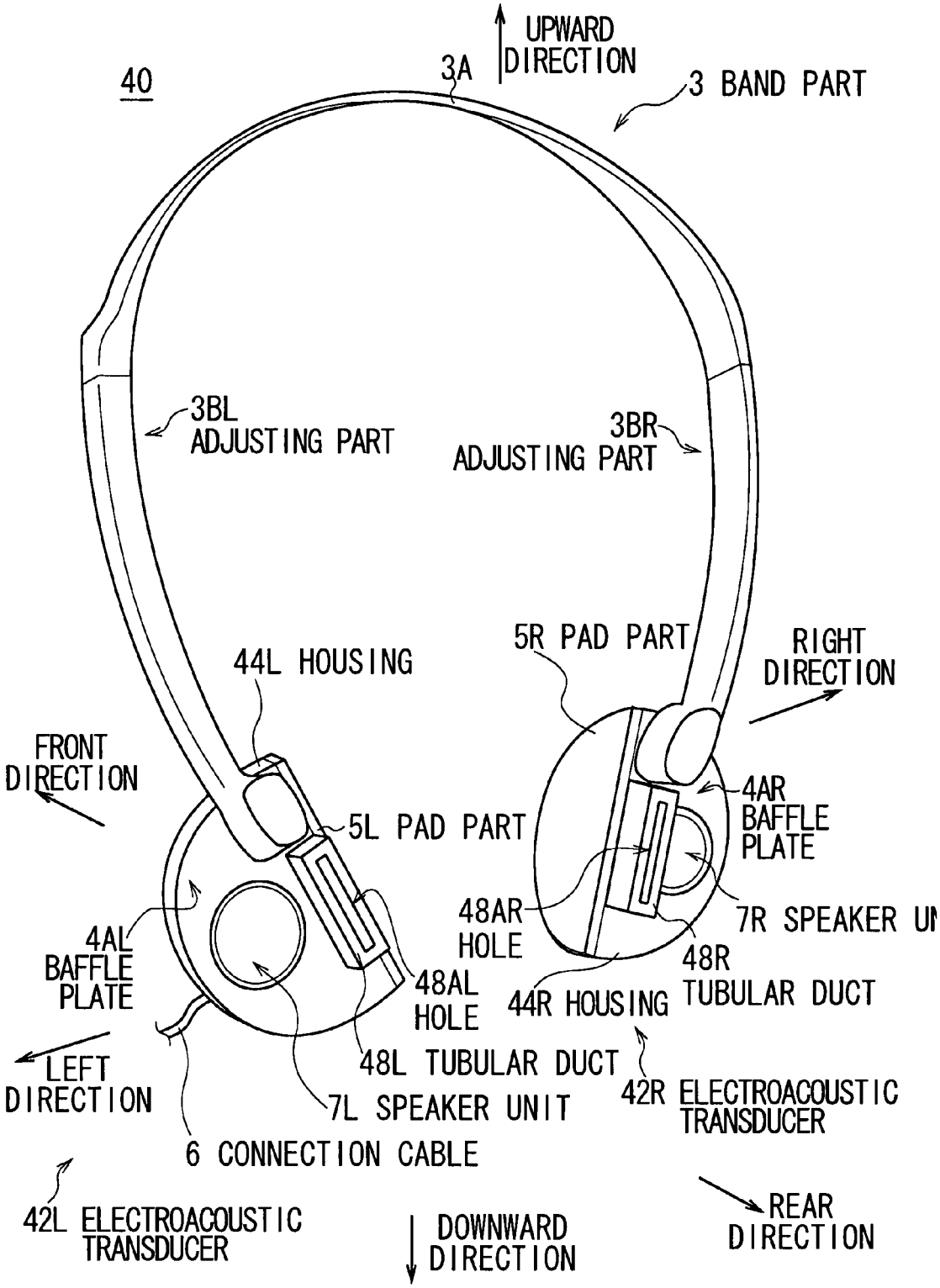
FIG. 45 is a schematic perspective view showing an entire configuration of an ear speaker device according to a fifth embodiment.
Figure 46:
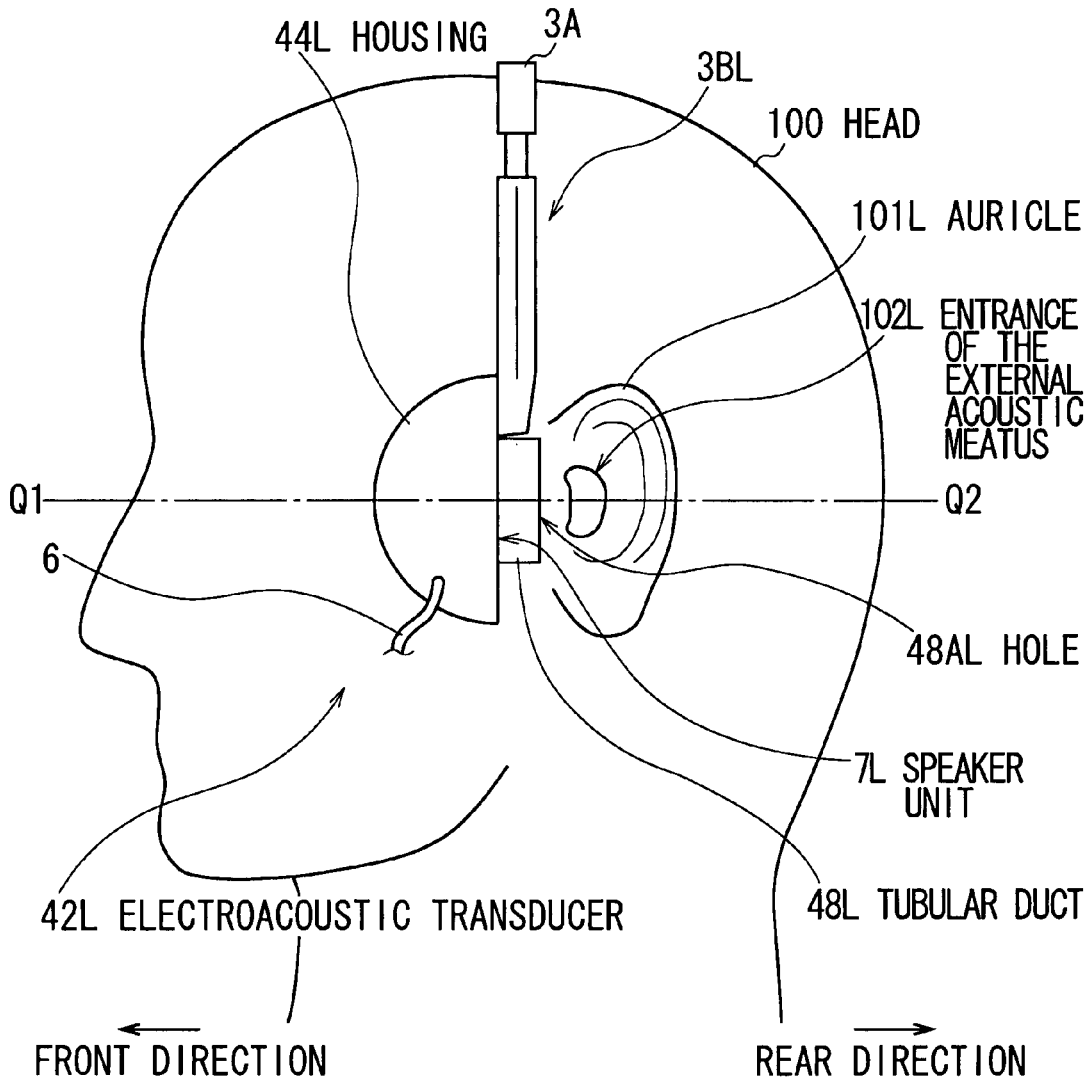
FIG. 46 is a schematic side view showing a mounting state (1) of the ear speaker device according to the fifth embodiment.
Figure 47:
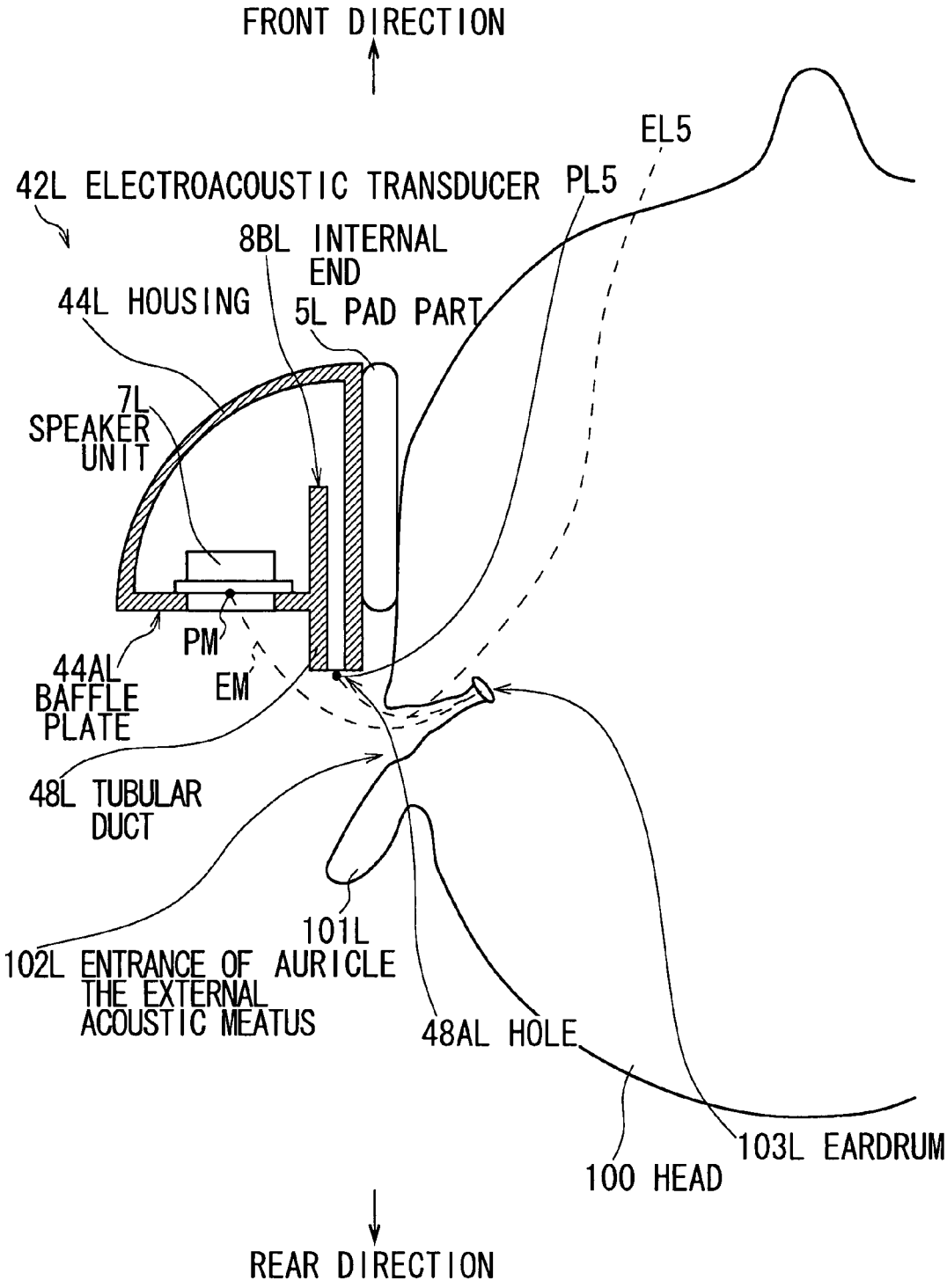
FIG. 47 is a schematic cross-sectional top view showing the mounting state (2) of the ear speaker device according to the fifth embodiment.

As shown in FIGS. 45 to 47 corresponding to FIGS. 1, 4, and 5, the ear speaker device 40 corresponding to the ear speaker device 1 has electroacoustic transducers 42L and 42R instead of the electroacoustic transducers 2L and 2R.

The electroacoustic transducers 42L and 42R have tubular ducts 48L and 48R instead of the tubular ducts 8L and 8R. The tubular ducts 48L and 48R are formed by a rectangular solid penetrating backward and forward respectively, and holes 48AL and 48AR are provided on end parts on the rear side, and the tubular ducts 48L and 48R are united with housings 44L and 44R corresponding to the housings 4L and 4R.

Accordingly, similar to the ear speaker device 30 (FIGS. 43 and 44), when the ear speaker device 40 is mounted on the head 100 of the listener, as shown in FIGS. 46 and 47, the holes 48AL and 48AR of the tubular ducts 48L and 48R are positioned at locations somewhat distant from the entrances 102L and 102R (not shown) of the external acoustic meatus. Thus, the ear speaker device 40 does not have to make the tubular ducts 48L and 48R come into contact with the external ear etc. of the listener.

With respect to the electroacoustic transducer 42L of the ear speaker device 40, similar to the electroacoustic transducer 32L, a relationship of the path length EM>the path length EL5 (FIG. 47) is obtained. Accordingly, the electroacoustic transducer 42L can make the low-pitched sound transmitted through the tubular duct 48L and emitted from the hole 48AL (virtual acoustical source position PL5) reach the eardrum 103L with a sound pressure level higher than that in the case of the electroacoustic transducer 12L (FIG. 6).

In this case, in the ear speaker device 40, considering that the sound pressure level of the low-pitched sound output from the electroacoustic transducer 42L becomes lower than the sound pressure level of the low-pitched sound output from the electroacoustic transducer 2L since the path length EL5 (FIG. 47)>the path length EL1 (FIG. 5), and that the figuration of the tubular ducts 8L and 8R and the figuration of the tubular ducts 48L and 48R are largely different, it is desired that the entire length, top-to-bottom length, etc. of the tubular ducts 48L and 48R be adjusted.

(4) Configuration of Ear Speaker Device Having Another Mounting Part

As shown in FIGS. 1 to 4, 39, 40, 42, 43, 45, and 46, the ear speaker devices 1, 20, 30, and 40 according to the embodiments of the present invention are configured so as to mount the electroacoustic transducers 2L and 2R on the head 100 of the listener by the band part 3 as the mounting part. However, the electroacoustic transducers 2L and 2R, 22L and 22R, 32L and 32R, 42L and 42R may be mounted on the head 100 of the listener by using a variety of other mounting parts in place of the band part 3.

Hereinafter, description will be made by mainly taking the electroacoustic transducer 22L on the left side by taking the ear speaker device 20 in the third embodiment for example. With respect to the electroacoustic transducer 22R on the right side, a configuration is made in a manner symmetrical to the electroacoustic transducer 22L on the left side.

Figure 48:
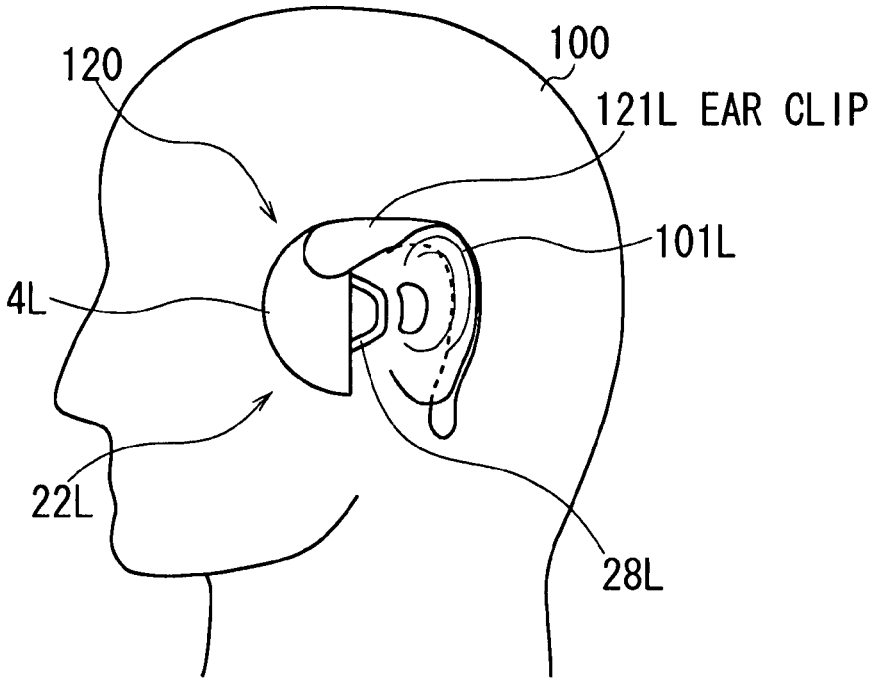
FIG. 48 is a schematic side view showing an example (1) of a configuration and mounting of the ear speaker device according to the third embodiment.

For example, an ear speaker device 120 shown in FIG. 48 is configured as a so-called ear-clip type. In the ear speaker device 120, an ear clip 121L to be hung on an auricle 101L of the listener is attached to the housing 4L of the electroacoustic transducer 22L in place of the band part 3 in the ear speaker device 20 (FIGS. 39 to 41).

The ear speaker device 120 can have the electroacoustic transducer 22L mounted on the head 100 of the listener by hanging the ear clip 121L on the auricle 101L of the listener. In this manner, as similar to the ear speaker device 20, the ear speaker device 120 can make the listener capable of listening to the excellent reproduced sound including the sufficient low-pitched sound while providing the natural sound image localization.

Figure 49:
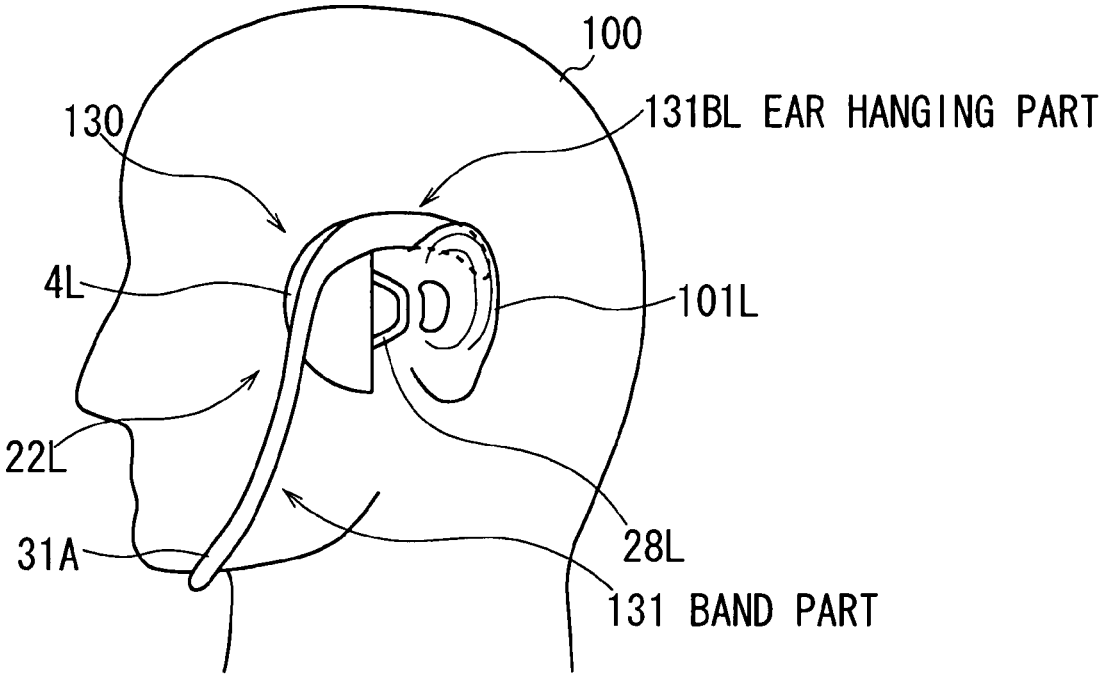
FIG. 49 is a schematic side view showing an example (2) of the configuration and the mounting of the ear speaker device according to the third embodiment.

In addition, an ear speaker device 130 shown in FIG. 49 is configured as a so-called under-chin type. A band part 131 for connecting the electroacoustic transducers 22L and 22R on the left and the right and being hung on the auricle 101L of the listener is attached to the housing 4L in place of the band part 3 of the ear speaker device 20 (FIGS. 39 to 41). A center part 131A of the band part 131 is formed in a substantial arch shape like a U-shape, and premised to be positioned below the chin of the listener and connect the left and the right parts of the band part 131.

The ear speaker device 130 can have the electroacoustic transducer 22L mounted on the head 100 of the listener by an ear hanging part 131BL of the band part 131 being hung on the auricle 101L of the listener. As similar to the ear speaker device 20, the ear speaker device 130 can make the listener capable of listening to the excellent reproduced sound including the sufficient low-pitched sound while providing the natural sound image localization.

Figure 50:
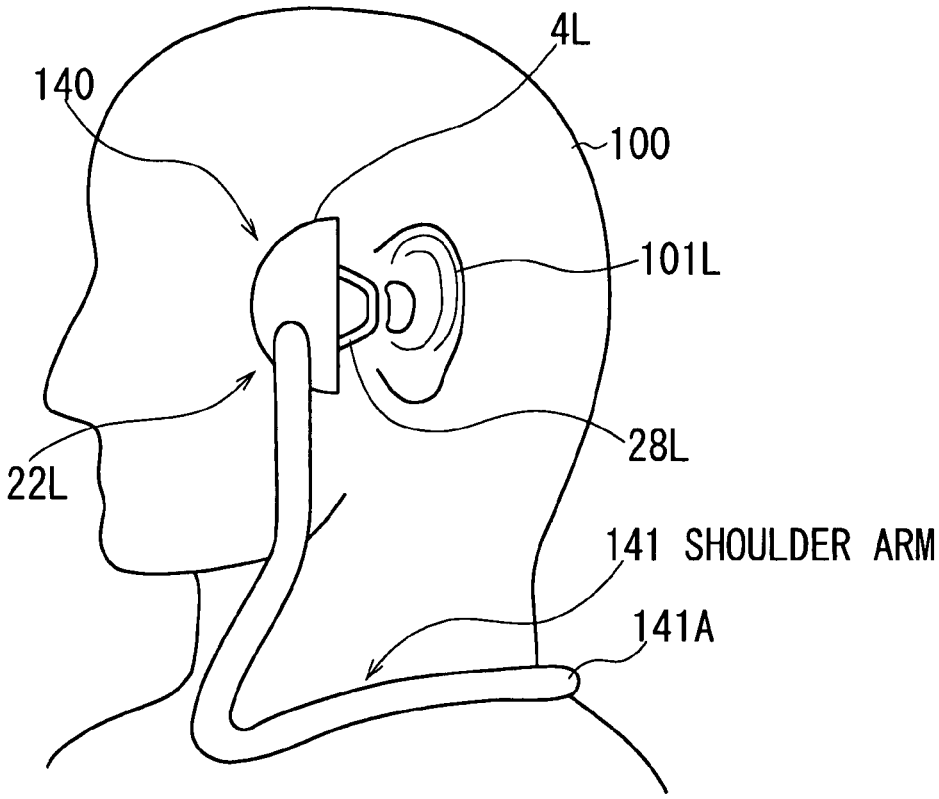
FIG. 50 is a schematic side view showing an example (3) of the configuration and the mounting of the ear speaker device according to the third embodiment.

Further, an ear speaker device 140 shown in FIG. 50 is configured as a so-called shoulder-hold type. A shoulder arm 141 for connecting the electroacoustic transducers 22L and 22R on the left and the right and for supporting the ear speaker device 140 at a shoulder part of the listener is attached to the housing 4L in place of the band part 3 of the ear speaker device 20 (FIGS. 39 to 41). A center part 141A of the shoulder arm 141 is formed in a substantial arch shape curved around a rear side of the neck, and premised to be hung on an upper part of the shoulder from the rear side of the neck of the listener and connect the left and the right parts of the shoulder arm 141.

The ear speaker device 140 can have the electroacoustic transducer 22L mounted on the head 100 of the listener by being hung by extending to both shoulders of the listener. As similar to the ear speaker device 20, the ear speaker device 140 can make the listener capable of listening to the excellent reproduced sound including the sufficient low-pitched sound while providing the natural sound image localization.

Figure 51:
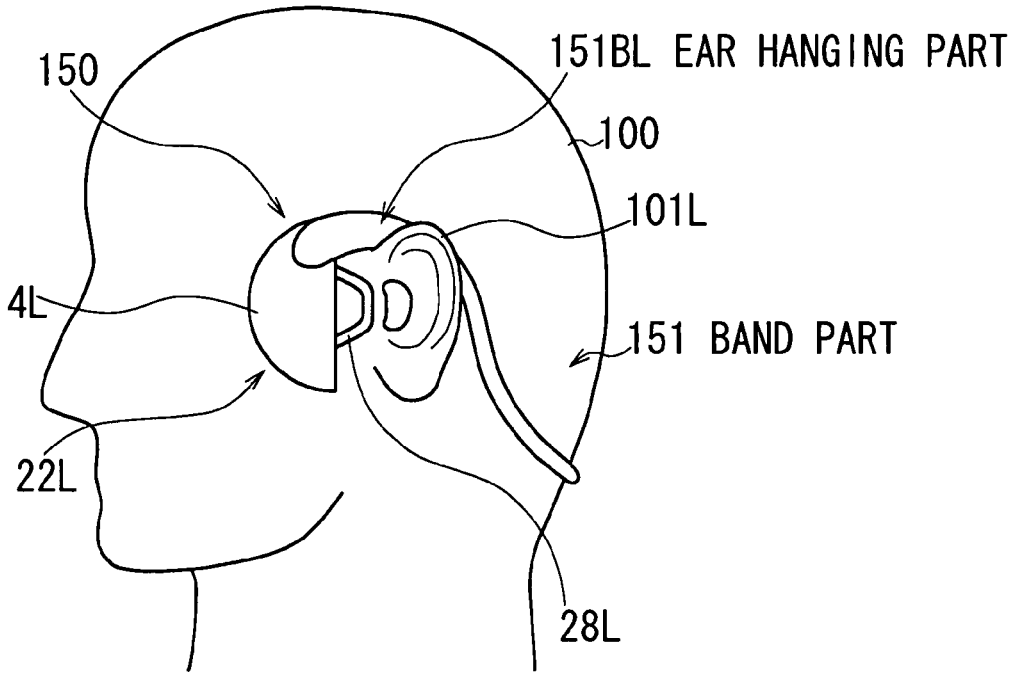
FIG. 51 is a schematic side view showing an example (4) of the configuration and the mounting of the ear speaker device according to the third embodiment.

Further, an ear speaker device 150 shown in FIG. 51 is configured as a so-called neck-band type. A band part 151 for connecting the electroacoustic transducers 22L and 22R on the left and the right and for being hung on the auricle 101L of the listener is attached to the housing 4L in place of the band part 3 of the ear speaker device 20 (FIGS. 39 to 41). A center part 151A of the band part 151 is formed in a substantial arch shape so as to be curved around a rear side of the head, and premised to connect the left and the right parts of the band part 151 on a rear side of the back of the head of the listener.

The ear speaker device 150 can have the electroacoustic transducer 22L mounted on the head 100 of the listener by an ear hanging part 151BL of the band part 151 being hung on the auricle 101L of the listener. As similar to the ear speaker device 20, the ear speaker device 150 can make the listener capable of listening to the excellent reproduced sound including the low-pitched sound while providing the natural sound image localization.

Figure 52:
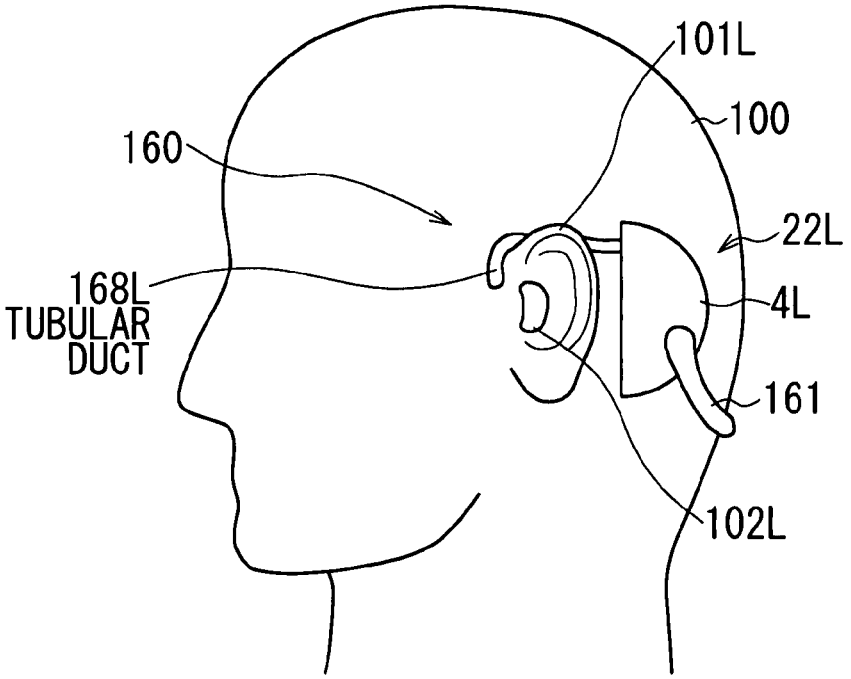
FIG. 52 is a schematic side view showing an example (5) of the configuration and the mounting of the ear speaker device according to the third embodiment.

Further, an ear speaker device 160 shown in FIG. 52 positions the electroacoustic transducer 22L in the ear speaker device 150 shown in FIG. 51 to a position closer to the rear side than the auricle 101L of the listener. At the same time, a tubular duct 168L extends from the housing 4L positioned on the rear side of the auricle 101L of the listener to the vicinity of the entrance 102L of the external acoustic meatus in place of the tubular duct 8L. In addition, a band part 161 positioned at the rear side of the neck of the listener connects the electroacoustic transducers 22L and 22R on the left and the right.

The ear speaker device 160 can have the electroacoustic transducer 22L mounted on the head 100 of the listener by the tubular duct 168L being hung on the auricle 101L of the listener. As similar to the ear speaker device 20, the ear speaker device 160 can make the listener capable of listening to the excellent reproduced sound including the sufficient low-pitched sound while providing the natural sound image localization.

Figure 53:
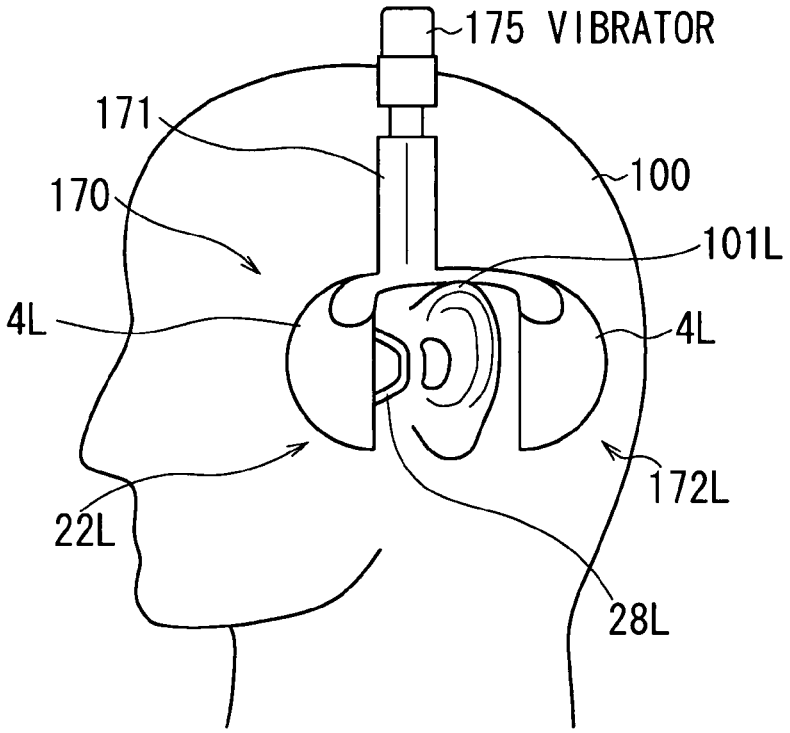
FIG. 53 is a schematic side view showing an example (6) of the configuration and the mounting of the ear speaker device according to the third embodiment.

Further, an ear speaker device 170 shown in FIG. 53 has a rear electroacoustic transducer 172L having a similar configuration as the electroacoustic transducer 12L (FIG. 6) in addition to the electroacoustic transducer 22L. A band part 171 in place of the band part 3 in the ear speaker device 20 (FIGS. 39 to 41) positions the electroacoustic transducer 22L closer to the front than the auricle 101L, and at the same time, the band part 171 positions the rear electroacoustic transducer 172L closer to the rear side of the auricle 101L.

An audio signal for a rear channel in a multi-channel sound source such as 4-channel and 5.1-channel is configured to be supplied to the rear electroacoustic transducer 172L.

The ear speaker device 170 can have the electroacoustic transducer 22L and the rear electroacoustic transducer 172L mounted on the head 100 of the listener by being mounted on the head 100 of the listener. The ear speaker device 170 can make the listener capable of listening to the excellent reproduced sound being surround sound including the sufficient low-pitched sound while providing the natural sound image localization.

In addition, in the above case, the ear speaker device 170 may have a vibrator 175 attached to the band part 171, and vibration corresponding to a deep bass component in a 5.1-channel sound source may be generated on the head 100 of the listener, for example.

The ear speaker device 170 may have the tubular duct extended from the rear electroacoustic transducer 172L to the vicinity of the entrance 102L of the external acoustic meatus of the listener as similar to the ear speaker device 160 (FIG. 52), or may have the tubular duct extended from both the electroacoustic transducer 22L and the rear electroacoustic transducer 172L to the vicinity of the entrance 102L of the external acoustic meatus of the listener, in addition to having the tubular duct 28L extended from the electroacoustic transducer 22L to the vicinity of the entrance 102L of the external acoustic meatus of the listener.

In this way, instead of the band part 3 (FIGS. 39 to 41) of the ear speaker device 20, using various types of mounting parts of the ear speaker devices 120 to 170, the electroacoustic transducers 22L and 22R may be attached to the head 100 of the listener.

(5) Operation and Advantageous Effect

In the ear speaker devices 20, 30, and 40, as compared with the ear speaker device 1, the length of parts of the tubular ducts 28L and 28R, 38L and 38R, and 48L and 48R protruding from the baffle plates 4AL and 4AR, 44AL and 44AR is made short, which does not make the ducts come into contact with the auricle etc., of the listener. This can significantly reduce the possibility of giving an uncomfortable feeling to the listener.

In the ear speaker devices 20, 30, and 40, due to the tubular ducts 28L and 28R, 38L and 38R, and 48L and 48R, the low-pitched sound can be emitted from a position closer to the entrance 102L of the external acoustic meatus than the speaker units 7L and 7R, which can make a listener listen to an excellent reproduced sound including a sufficient low-pitched sound, similar to the ear speaker device 1.

Furthermore, since the tubular ducts 8L, 28L, 38L, and 48L do not cover the entrance 102L of the external acoustic meatus of the listener, reproduced sound as well as the surrounding sound brought about at the surrounding area of the listener can reach the eardrum 103L without being blocked.

Accordingly, the ear speaker devices 1, 20, 30, and 40 can make the listener capable of listening to the surround sound in addition to the excellent reproduction sound even in a case where the listener has to listen to the surround sound, such as when the listener is walking or playing some sports.

Since the ear speaker devices 1, 20, 30, and 40 do not cover the auricle 101L and so on of the listener, the ear speaker devices do not cause uncomfortableness such as a cooped-up feeling and sweatiness the listener feels when the listener wears the general headphone. Further, the ear speaker devices do not form closed space, and therefore, the ear speaker devices do not generate a change of a resonance frequency in the external acoustic meatus which may be generated in a case of using the closed-type headphone, and do not make the listener feel uncomfortable.

In addition, the ear speaker devices 1, 20, 30, and 40 can make the listener capable of listening to the low-pitched sound at the sufficient sound volume level by putting the hole which is the emission aperture of the low-pitched sound close to the eardrum 103L. Therefore, the diameter of the speaker unit 7L does not have to be made larger than necessary, and size of the housing 4L can be limited to be minimum. In this manner, the entire size and mass of the ear speaker device can be limited to be minimum, therefore troublesomeness caused by the size and the mass of the ear speaker device when the listener wears the ear speaker device can be restricted as much as possible.

According to the configuration described above, the ear speaker device 20 positions the speaker unit 7L of the electroacoustic transducer 22L somewhat closer to the front than the entrance 102L of the external acoustic meatus of the listener when the ear speaker device 20 is mounted on the head 100 of the listener. At the same time, the reproduced sound is output in a state that the tubular duct 28L is oriented to be extended to the entrance 102L of the external acoustic meatus. In this manner, the ear speaker device 20 can allow the low-pitched sound emitted from the hole 28AL of the tubular duct 28L working as the bass reflex duct to reach the eardrum 103L at the sufficient sound pressure level. Therefore, the ear speaker device 20 can make the listener capable of listening to the excellent reproduced sound having the sufficient sound pressure level down to the comparatively low frequencies while providing the natural sound image localization.

(6) Other Embodiments

In the first and third embodiments, the tubular ducts 8L and 28L are two bass reflex ducts in the form of a substantial U-shape respectively on sides. However, the present invention is not limited thereto, and the bass reflex duct may be configured by ducts of various number and figuration such as the single tubular duct 38L or three or more tubular ducts as in the fourth embodiment, or by the rectangular tubular duct 48L as in the fifth embodiment.

Furthermore, the tubular duct may be made of rigid material such as metal or soft material such as resin provided with the flexibility. In this case, considering the difference of the material of the tubular duct 8L, it is desired that the inner diameter and path length be determined. Furthermore, a protection part may be attached to the end part on the rear side of the tubular duct so as not to hurt the entrance 102L of the external acoustic meatus of the listener.

Furthermore, in above-described embodiments, the case in which the tubular duct 8L passes through the baffle plate 4AL of the housing 4L is explained. However, the present invention is not limited thereto, and the tubular duct 8L may pass through other side surfaces of the housing 4L.

Furthermore, in above-described embodiments, the case in which, when the ear speaker device 1 is mounted to the head 100 (FIG. 4) of the listener, the sound emitting surface of the speaker unit 7L is oriented to the rear side. However, the present invention is not limited thereto, and the sound emitting surface of the speaker unit 7L may be oriented substantially to the inner side, and it is desirable when the sound emitting surface of the speaker unit 7L is oriented substantially to the direction of the entrance 102L of the external acoustic meatus, and the emitted middle-pitched and the high-pitched sounds reach the eardrum 103L effectively.

Furthermore, in the third to fifth embodiments, the case in which the holes 28AL, 38AL, 48AL of the tubular duct 28L, 38L, and 48L are arranged to be oriented substantially to the direction of the entrance 102L of the external acoustic meatus. However, the present invention is not limited thereto, and the holes may be oriented to directions other than the direction of the entrance 102L of the external acoustic meatus.

Figure 54:
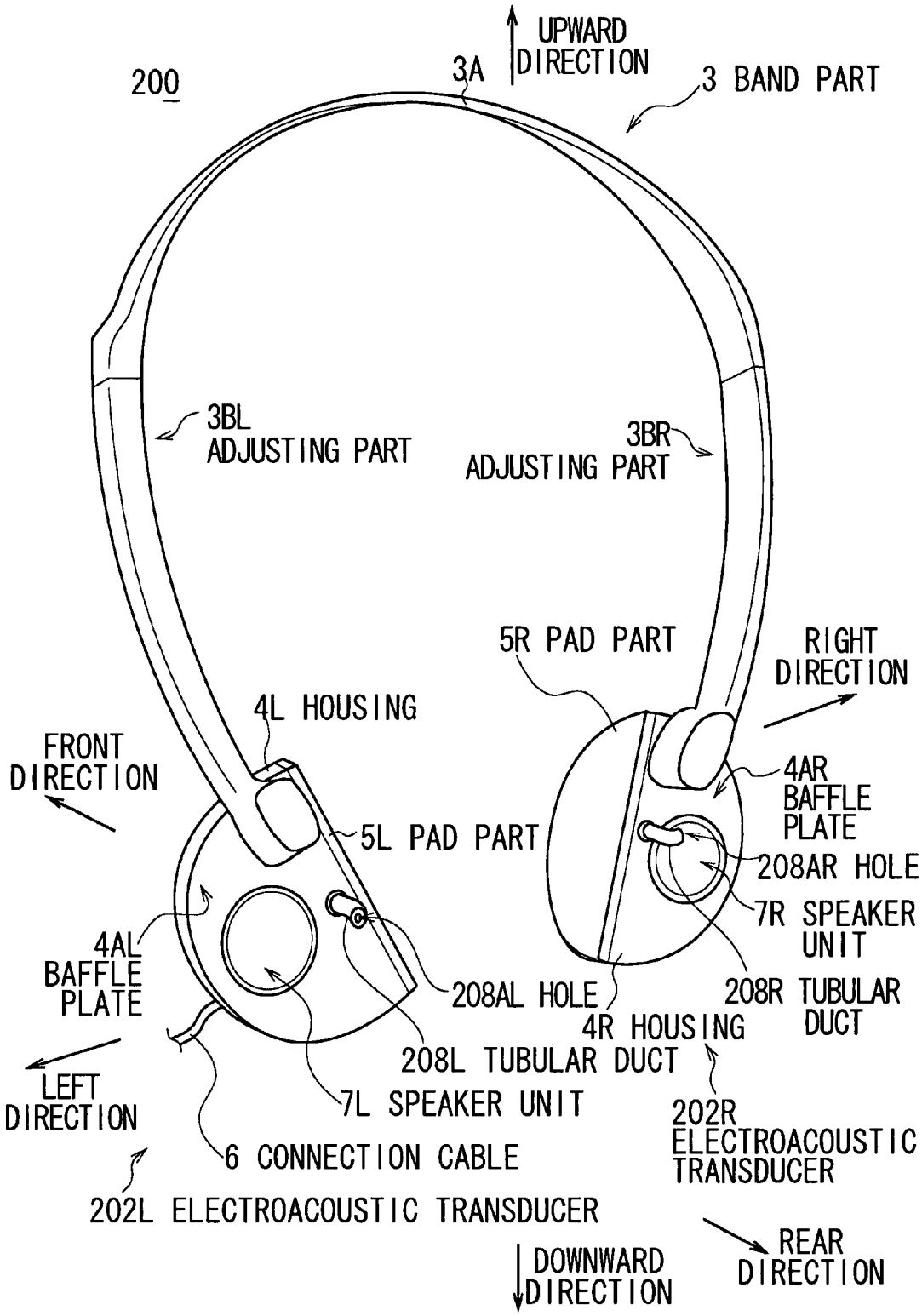
FIG. 54 is a schematic perspective view showing the entire configuration of an ear speaker device according to another embodiment.

As shown in FIG. 54 in which a corresponding part is attached to with the same numerical number as found in FIG. 42, the ear speaker device 200 has electroacoustic transducers 202L and 202R instead of the electroacoustic transducers 2L and 2R of the ear speaker device 1. In the electroacoustic transducers 202L and 202R, rear ends of the tubular ducts 208L and 208R are bent to the outward, and the holes 208AL and 208AR are oriented to the outward.

Accordingly, the ear speaker device 200 can emit a sound output from the tubular duct 208L to a direction different from the direction of the entrance 102L of the external acoustic meatus. As the general characteristics of sound, it is known that the middle-pitched and the high-pitched sounds are provided with a high directivity, while the low-pitched sound is provided with a low directivity.

Utilizing the directivity of sound, the ear speaker device 200 can weaken the middle-pitched and the high-pitched sounds transmitted to the entrance 102L of the external acoustic meatus through the tubular duct 208L, and can transmit the low-pitched sound to the entrance 102L of the external acoustic meatus without weakening it, which can make the listener listen to the sound without breaking the balance of the sounds.

Furthermore, in above-described embodiments, the description was made with respect to the case where the electroacoustic transducers 22L and 22R as the electroacoustic transducer are configured by the housings 4L and 4R as the housing, the speaker units 7L and 7R as the speaker unit, and the tubular ducts 28L and 28R as the tubular duct. However, the present invention is not limited thereto, and the electroacoustic transducer may be configured by the housing, the speaker unit, and the tubular duct, which have a variety of other configurations.

Furthermore, in above-described embodiments, the description was made with respect to the case where the ear speaker device 20 as the ear speaker device is configured by the housings 4L and 4R as the housing, the speaker units 7L and 7R as the speaker unit, the tubular ducts 28L and 28R as the tubular duct, the electroacoustic transducers 22L and 22R as the electroacoustic transducer, and the band part 3 as the mounting part. However, the present invention is not limited thereto, and the ear speaker device may be configured by the housing, the speaker unit, the tubular duct, the electroacoustic transducer, and the mounting part, which have a variety of other configurations.

(7) Sixth Embodiment

(7-1) Configuration of Ear Speaker Device

Figure 55:
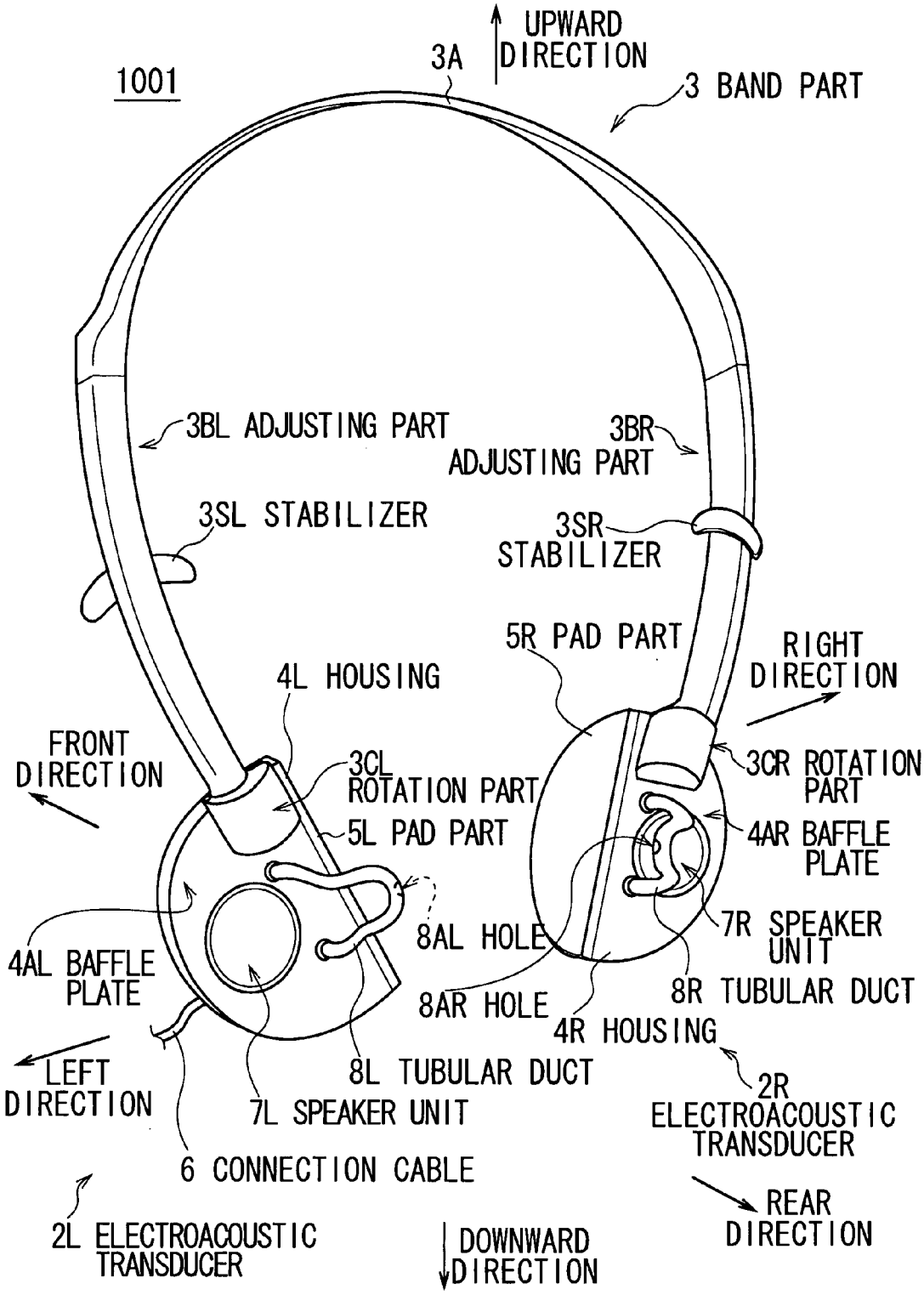
FIG. 55 is a schematic perspective view showing an entire configuration (1) of an ear speaker device according to a sixth embodiment.
Figure 56:
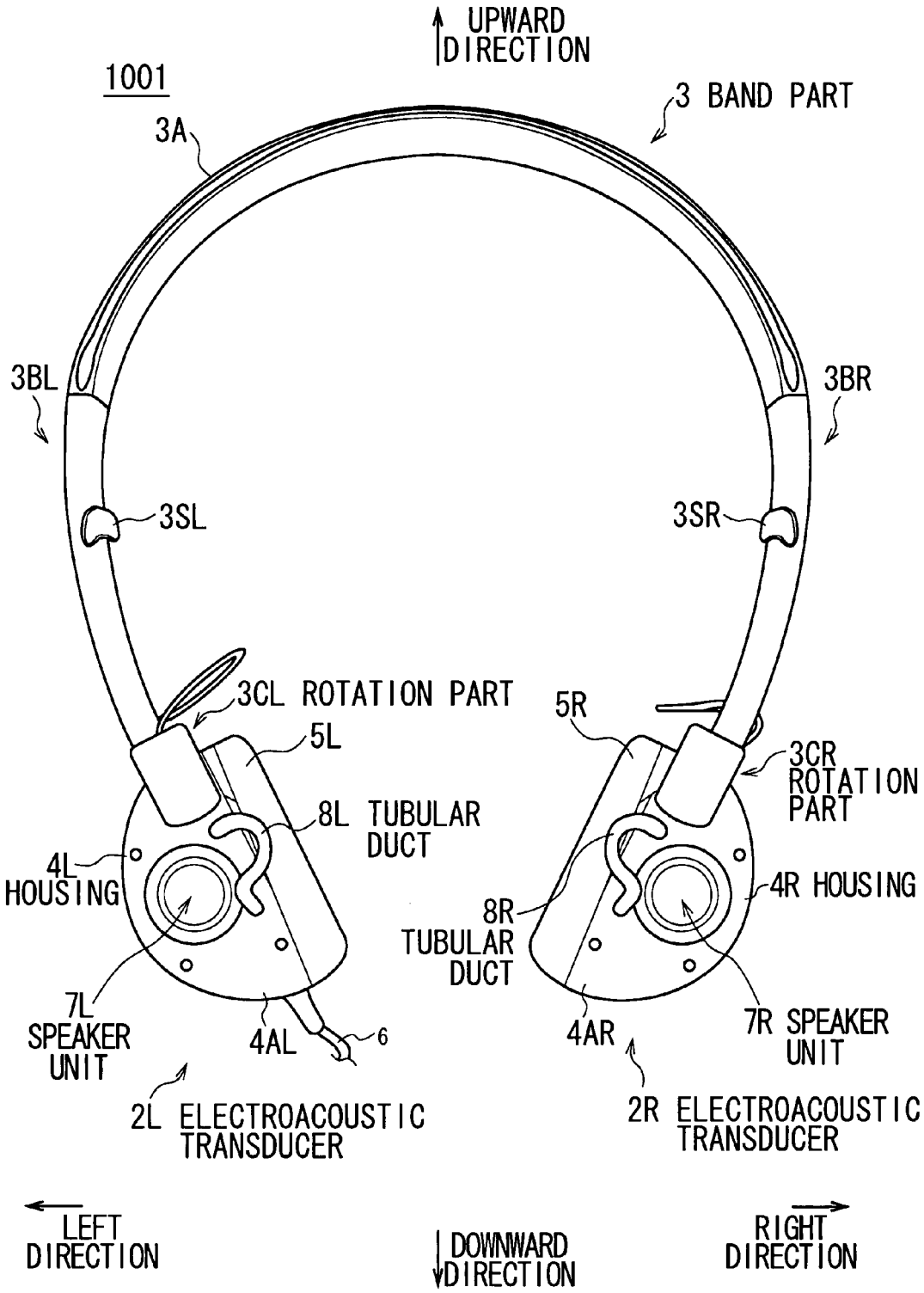
FIG. 56 is a schematic rear view showing the entire configuration (2) of the ear speaker device according to the sixth embodiment.

As shown in FIGS. 55 and 56 in which a corresponding part is attached to with the same numerical number as found in FIGS. 1 and 2, the numerical number 1001 refers to an entire ear speaker device according to the sixth embodiment which converts an audio signal generated by the reproduction processing etc. of a portable CD player or a DMP to a reproduced sound, makes a listener listen to the reproduced sound.

The ear speaker device 1001 is different from the ear speaker device 1 shown in FIGS. 1 and 2 in the following points. That is, the ear speaker device 1001 has rotation parts 3CL and 3CR at the connection points between the band part 3 and housings 4L and 4R, which connection points are located at the underpart of the adjusting parts 3BL and 3BR. The rotation parts 3CL and 3CR rotate the housings 4L and 4R with respect to the band part 3 with the extension direction of the band part 3 being the rotation axis, and apply turning force to bias the rear side of the tubular ducts 8L and 8R to the inner side (details will be explained later).

At the inner side of the adjusting parts 3BL and 3BR of the band part 3, stabilizers 3SL and 3SR in the form of an ellipse plate respectively are so attached as to intersect the adjusting parts 3BL and 3BR.

Figure 57:
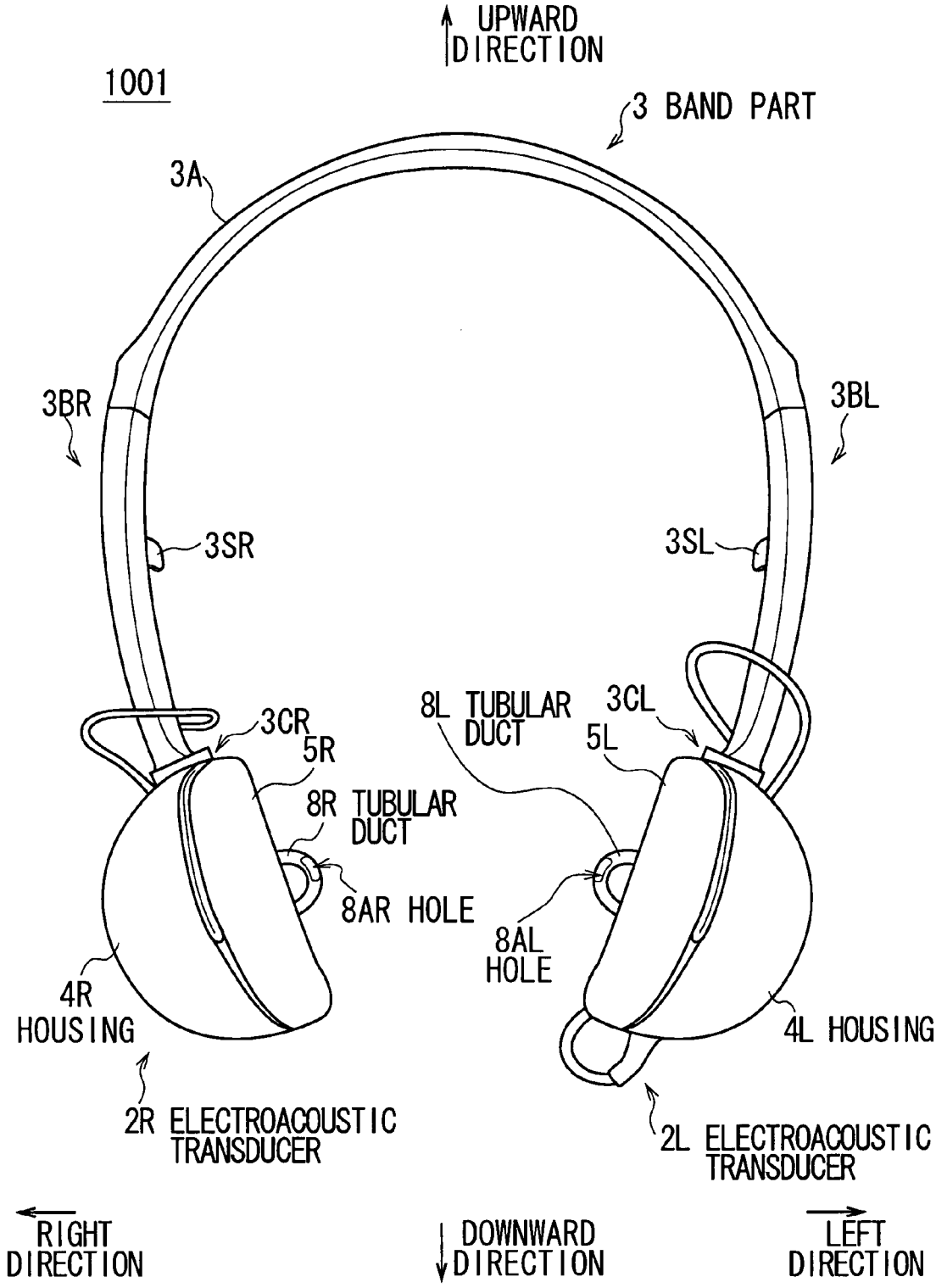
FIG. 57 is a schematic front view showing the entire configuration (3) of the ear speaker device according to the sixth embodiment.

Since the ear speaker device 1001 is symmetrically configured as shown in FIGS. 55 to 57, mainly the electroacoustic transducer 2L of the left side will be explained.

Figure 58:
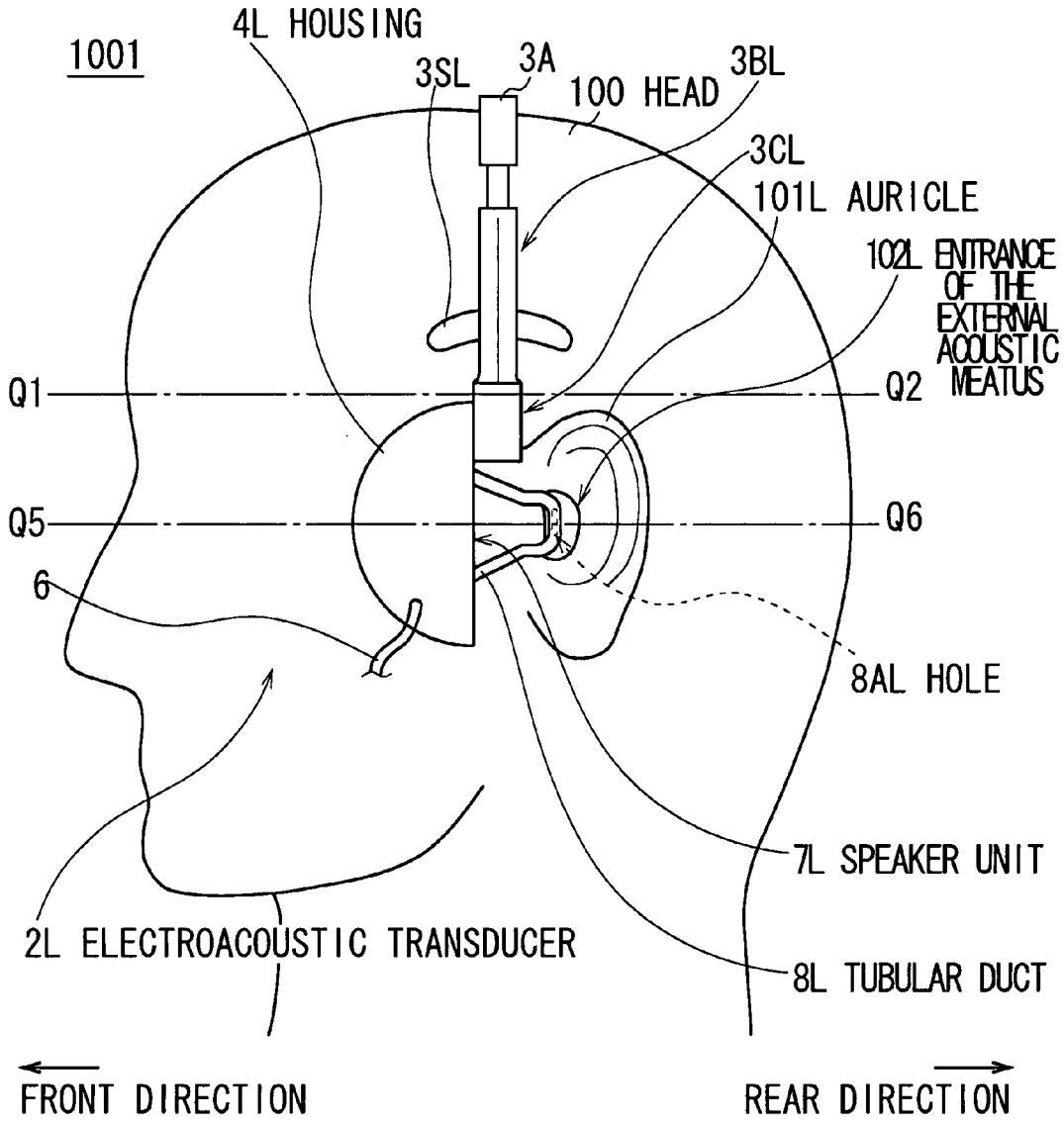
FIG. 58 is a schematic side view showing a mounting state (1) of the ear speaker device according to the sixth embodiment.

In practice, as shown in the left side view of FIG. 58, since the ear speaker device 1001 is mounted to the head 100 of the listener after the length of the band part 3 is adjusted, the electroacoustic transducer 2L attached to the lower end side of the adjusting part 3BL can be located somewhat at the front of the auricle 101L of the of the head 100 of the listener.

In this way, the electroacoustic transducer 2L of the ear speaker device 1001 can make the middle-pitched and the high-pitched sounds emitted from the speaker unit 7L directly reach the inside of the external acoustic meatus, and can also make a reflected sound which is reflected by the cheek and auricle 101L of the listener reach the inside of the external acoustic meatus, which can provide natural sound image localization that is similar to a case of listening to a sound via a general stationary speaker.

At this time, when the ear speaker device 1001 is normally mounted to the listener, the speaker unit 7L is located somewhat at the front of the auricle 101L and entrance 102L of the external acoustic meatus, and the hole 8AL of the tubular duct 8L is positioned in the vicinity of the entrance 102L of the external acoustic meatus.

Figure 59:
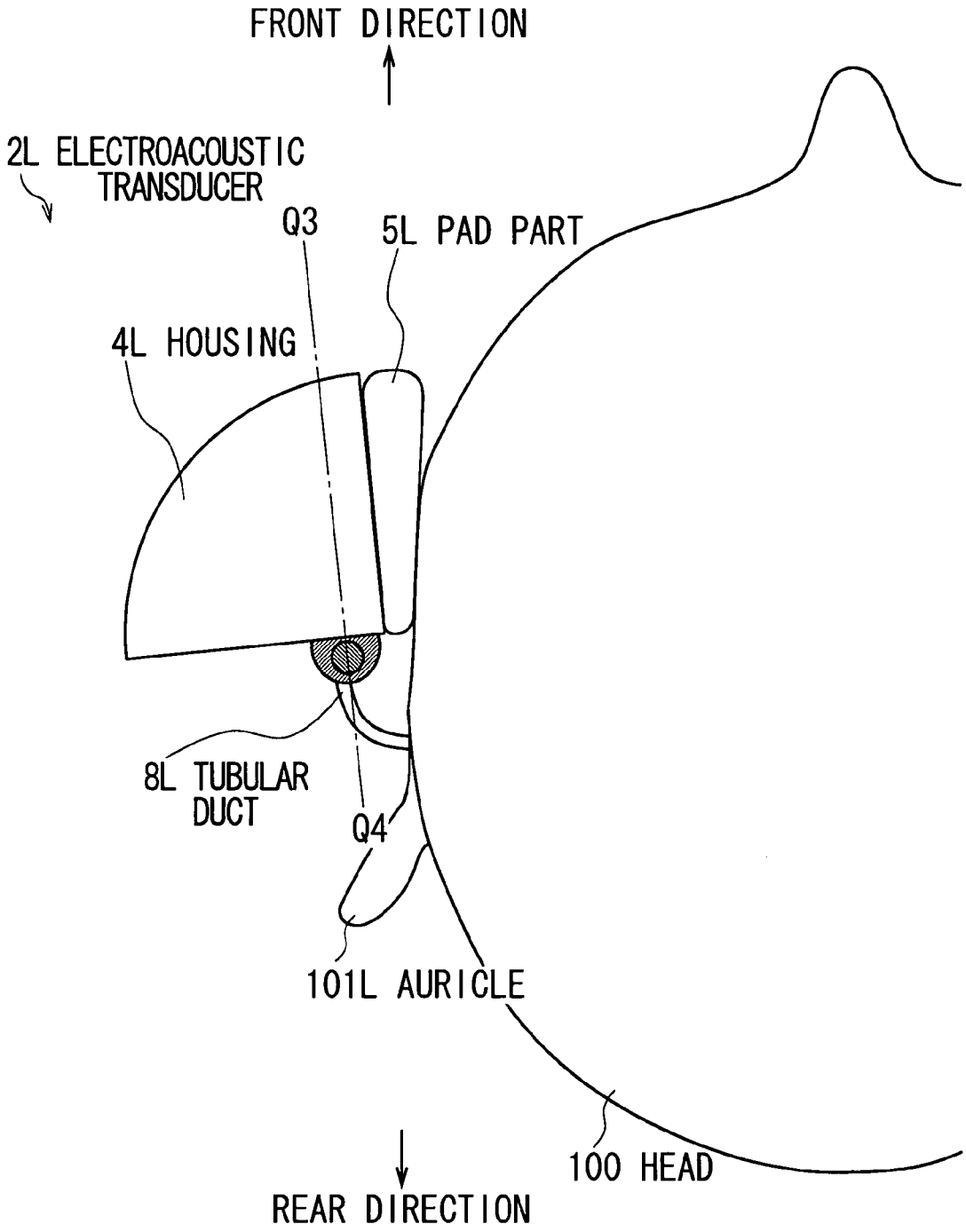
FIG. 59 is a schematic cross-sectional top view showing the mounting state (2) of the ear speaker device according to the sixth embodiment.
Figure 60:
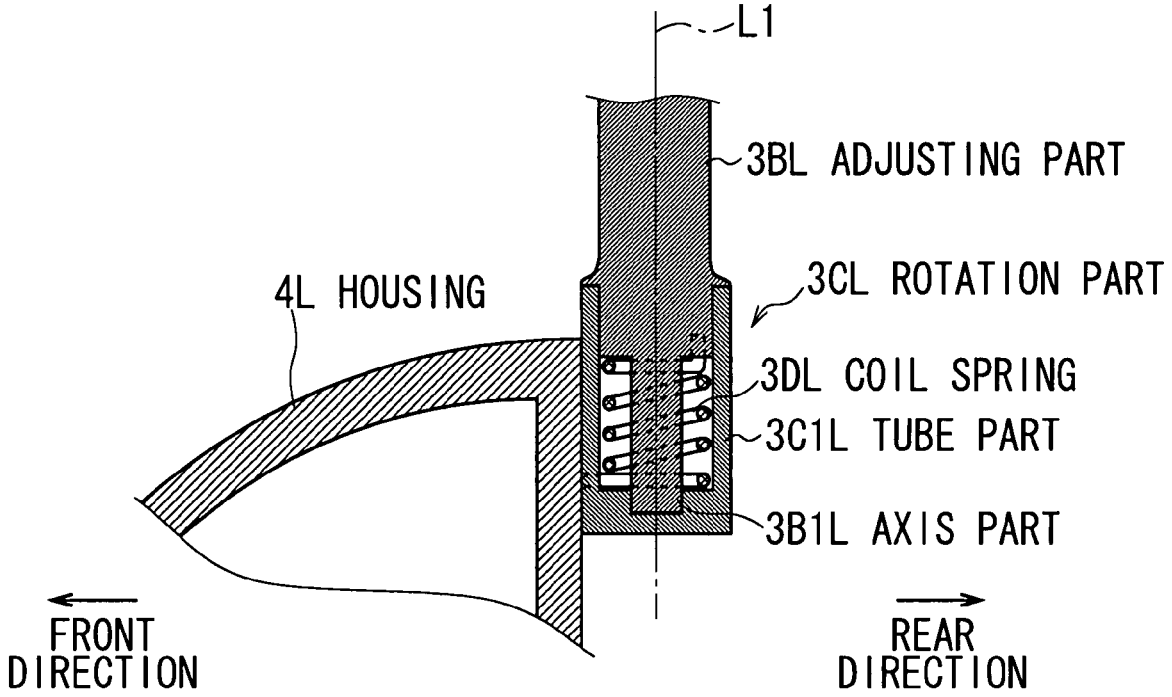
FIG. 60 is a schematic cross-sectional view showing a configuration of a rotation part.

Here, a cross section cut along the line Q1-Q2 in FIG. 58 is shown in FIG. 59, while a cross section cut along the line Q3-Q4 in FIG. 59 is shown in FIG. 60. As shown in FIGS. 59 and 60, the rotation part 3CL is configured by, at the lower end part of the adjusting part 3BL, an axis part 3B1L substantially in the form of a cylinder solid, a coil spring 3DL substantially in the form of a cylinder hollow which is arranged along the circumferential side of the axis part 3B1L, and a tube part 3C1L which is provided with a space in the form of a cylinder capable of housing the axis part 3B1L and coil spring 3DL, and is attached to the housing 4L.

The coil spring 3DL has its upper end fixed to the adjusting part 3BL, and has its lower end fixed to the tube part 3C1L. Furthermore, in the natural state under which external force is not applied, the coil spring 3DL rotates the end side of the tubular duct 8L to the inner side by a predetermined angle (for example, 45 degrees).

When the ear speaker device 1001 is mounted to the head 100 of the listener, as shown in FIG. 59, the rear side of the tubular duct 8L is expanded outward as compared with the natural state. Accordingly, the rotation part 3CL applies force of returning to the natural state, that is, turning force to push the rear side of the tubular duct 8L to the inner side.

Accordingly, the electroacoustic transducer 2L abuts on the vicinity of the temple of the listener through the pad part 5, and the rear side of the tubular duct 8L abuts on the entrance 102L of the external acoustic meatus of the listener.

Furthermore, as shown in FIG. 58, since the stabilizer 3SL abuts on the head 100 of the listener in the forward and backward direction, the band part 3 can be mounted to the head 100 stably, which can prevent the band part 3 from being twisted unnecessarily by the turning force of the rotation part 3CL.

As a result, when the ear speaker device 1001 is correctly mounted to the head 100 of the listener, the center part 3A of the band part 3, adjusting part 3BL, pad part 5L, and also the stabilizer 3SL abut on the head 100, temple, etc., and the rear side of the tubular duct 8L abuts on the entrance 102L of the external acoustic meatus, which can stably fix the ear speaker device 1001 to the head 100 of the listener.

(7-2) Configuration Example of Another Ear Speaker Device

As shown in FIGS. 55 to 58, the ear speaker device 1001 according to the sixth embodiment is configured so as to mount the electroacoustic transducers 2L and 2R on the head 100 of the listener by the band part 3 as the mounting part. However, the electroacoustic transducers 2L and 2R may be mounted on the head 100 of the listener by using a variety of other mounting parts in place of the band part 3.

Hereinafter, description will be made by mainly taking the electroacoustic transducer 2L on the left side as an example as similar to the case of the ear speaker device 1001 described above. With respect to the electroacoustic transducer 2R on the right side, a configuration is made in a manner symmetrical to the electroacoustic transducer 2L on the left side.

Figure 61:
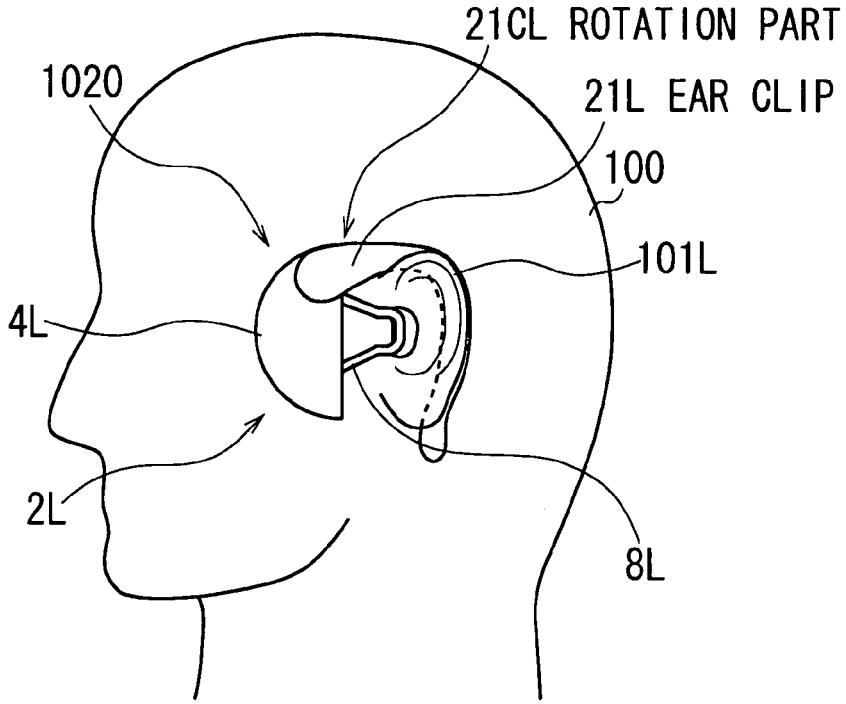
FIG. 61 is a schematic side view showing an example (1) of a configuration and mounting of the ear speaker device according to the sixth embodiment.

For example, an ear speaker device 1020 shown in FIG. 61 is configured as a so-called ear-clip type. In the ear speaker device 1001, an ear clip 21L to be hung on an auricle 101L of the listener is attached to the housing 4L of the electroacoustic transducer 2L in place of the band part 3 in the ear speaker device 1001 (FIGS. 55 to 58). Furthermore, at the attachment part of the ear clip 21L to the housing 4L, a rotation part 21CL whose configuration is similar to that of the rotation part 3CL (FIGS. 59 to 60) is arranged.

The ear speaker device 1020 can have the electroacoustic transducer 2L mounted on the head 100 of the listener by hanging the ear clip 21L on the auricle 101L of the listener. At this time, the ear clip 21L rotates the electroacoustic transducer 2L using the rotation action of the rotation part 21CL, which can make the rear side of the tubular duct 8L abut on the entrance 102L of the external acoustic meatus.

In this manner, as similar to the ear speaker device 1001, the ear speaker device 1020 can be stably mounted to the head 100 of the listener, and can make the listener capable of listening to the excellent reproduced sound including the sufficient low-pitched sound while providing the natural sound image localization.

Figure 62:
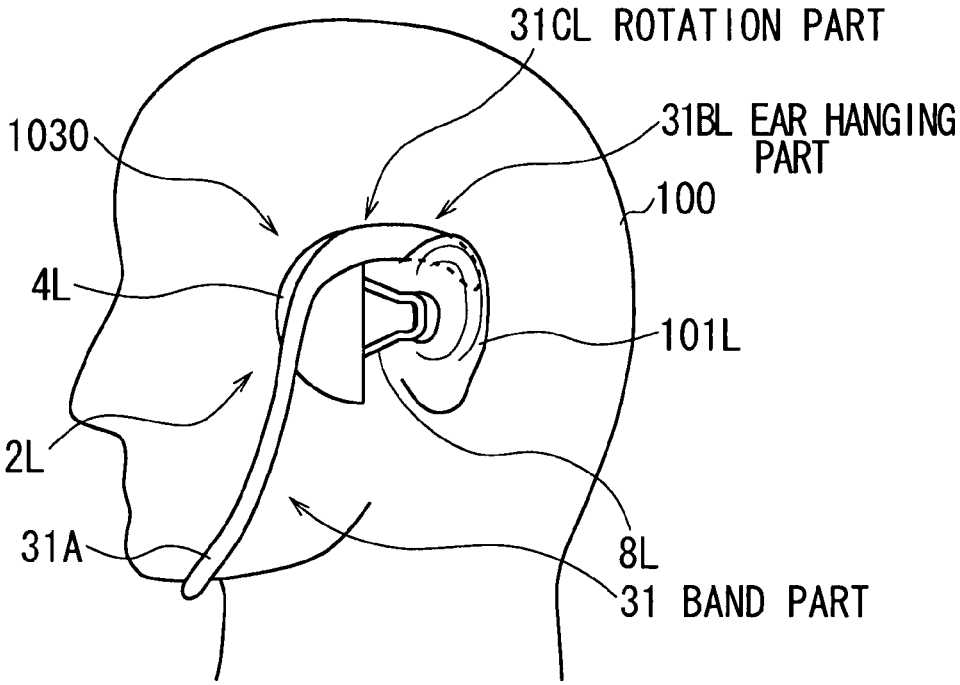
FIG. 62 is a schematic side view showing an example (2) of the configuration and the mounting of the ear speaker device according to the sixth embodiment.

In addition, an ear speaker device 1030 shown in FIG. 62 is configured as a so-called under-chin type. A band part 31 for connecting the electroacoustic transducers 2L and 2R on the left and the right and being hung on the auricle 101L of the listener is attached to the housing 4L in place of the band part 3 of the ear speaker device 1001 (FIGS. 55 to 58). A center part 31A of the band part 31 is formed in a substantial arch shape like a U-shape, and premised to be positioned below the chin of the listener and connect the left and the right parts of the band part 31. Furthermore, at the attachment part of the band part 31 to the housing 4L, a rotation part 31CL whose configuration is similar to that of the rotation part 3CL (FIGS. 59 to 60) is arranged.

The ear speaker device 1030 (FIG. 62) can have the electroacoustic transducer 2L mounted on the head 100 of the listener by an ear hanging part 31BL of the band part 31 being hung on the auricle 101L of the listener. At this time, the band part 31 rotates the electroacoustic transducer 2L using the rotation action of the rotation part 31CL, which can make the rear side of the tubular duct 8L abut on the entrance 102L of the external acoustic meatus.

In this manner, as similar to the ear speaker device 1001, the ear speaker device 1030 can be stably mounted to the head 100 of the listener, and can make the listener capable of listening to the excellent reproduced sound including the sufficient low-pitched sound while providing the natural sound image localization.

Figure 63:
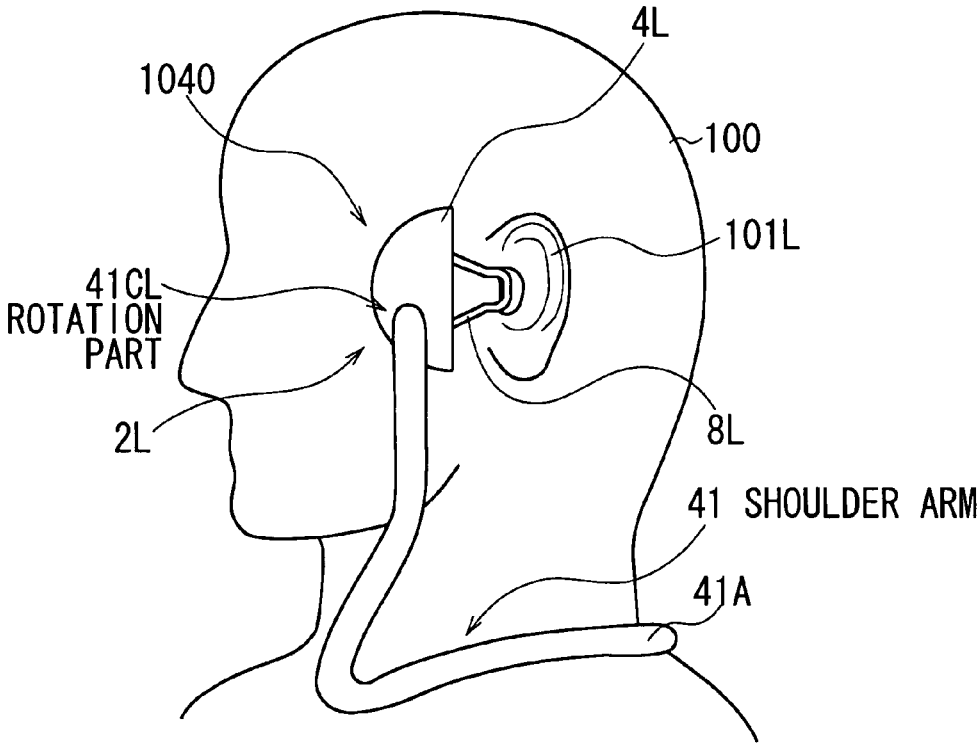
FIG. 63 is a schematic side view showing an example (3) of the configuration and the mounting of the ear speaker device according to the sixth embodiment.

Further, an ear speaker device 1040 shown in FIG. 63 is configured as a so-called shoulder-hold type. A shoulder arm 41 for connecting the electroacoustic transducers 2L and 2R on the left and the right and for supporting the ear speaker device 1040 at a shoulder part of the listener is attached to the housing 4L in place of the band part 3 of the ear speaker device 1001 (FIGS. 55 to 58). A center part 41A of the shoulder arm 41 is formed in a substantial arch shape curved around a rear side of the neck, and premised to be hung on an upper part of the shoulder from the rear side of the neck of the listener and connect the left and the right parts of the shoulder arm 41. Furthermore, at the attachment part of the shoulder arm 41 to the housing 4L, a rotation part 41CL whose configuration is similar to that of the rotation part 3CL (FIGS. 59 to 60) is arranged.

The ear speaker device 1040 (FIG. 63) can have the electroacoustic transducer 2L mounted on the head 100 of the listener by being hung by extending to both shoulders of the listener. At this time, the shoulder arm 41 rotates the electroacoustic transducer 2L using the rotation action of the rotation part 41CL, which can make the rear side of the tubular duct 8L abut on the entrance 102L of the external acoustic meatus.

As similar to the ear speaker device 1001, the ear speaker device 1040 can be stably mounted to the head 100 of the listener, and can make the listener capable of listening to the excellent reproduced sound including the sufficient low-pitched sound while providing the natural sound image localization.

Figure 64:
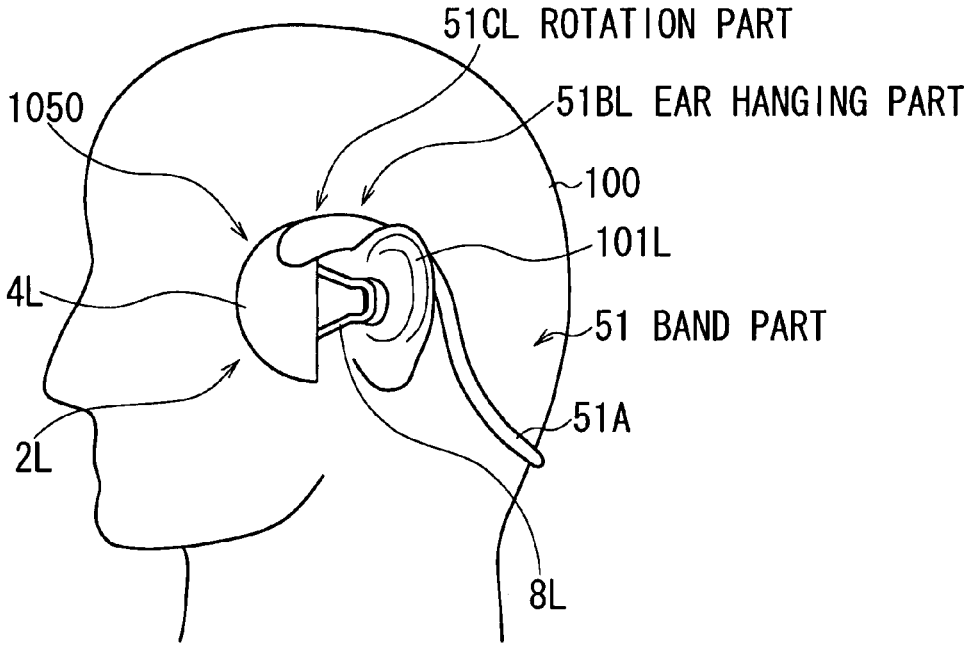
FIG. 64 is a schematic side view showing an example (4) of the configuration and the mounting of the ear speaker device according to the sixth embodiment.

Further, an ear speaker device 1050 shown in FIG. 64 is configured as a so-called neck-band type. A band part 51 for connecting the electroacoustic transducers 2L and 2R on the left and the right and for being hung on the auricle 101L of the listener is attached to the housing 4L in place of the band part 3 of the ear speaker device 1001 (FIGS. 55 to 58). A center part 51A of the band part 51 is formed in a substantial arch shape so as to be curved around a rear side of the head, and premised to connect the left and the right parts of the band part 51 on a rear side of the back of the head of the listener. Furthermore, at the attachment part of the band part 51 to the housing 4L, a rotation part 51CL whose configuration is similar to that of the rotation part 3CL (FIGS. 59 to 60) is arranged.

The ear speaker device 1050 (FIG. 64) can have the electroacoustic transducer 2L mounted on the head 100 of the listener by an ear hanging part 51BL of the band part 51 being hung on the auricle 101L of the listener. At this time, the band part 51 rotates the electroacoustic transducer 2L using the rotation action of the rotation part 51CL, which can make the rear side of the tubular duct 8L abut on the entrance 102L of the external acoustic meatus.

In this manner, as similar to the ear speaker device 1001, the ear speaker device 1050 can be stably mounted to the head 100 of the listener, and can make the listener capable of listening to the excellent reproduced sound including the low-pitched sound while providing the natural sound image localization.

Figure 65:
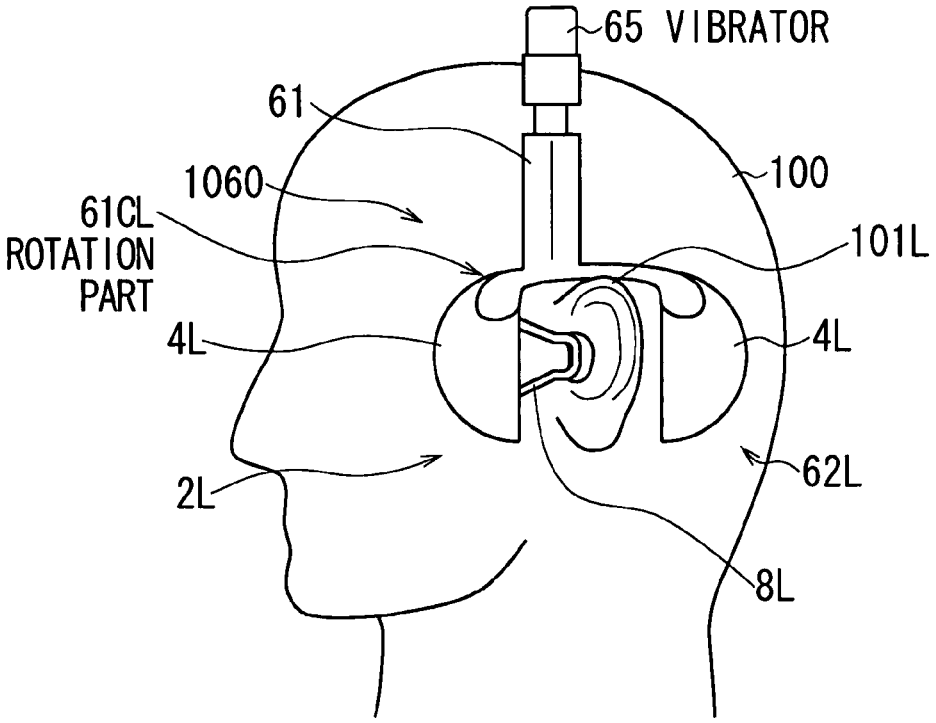
FIG. 65 is a schematic side view showing an example (5) of the configuration and the mounting of the ear speaker device according to the sixth embodiment.

Further, an ear speaker device 1060 shown in FIG. 65 has a rear electroacoustic transducer 62L having a similar configuration as the electroacoustic transducer 12L (FIG. 8) in addition to the electroacoustic transducer 2L. A band part 61 in place of the band part 3 in the ear speaker device 1001 (FIGS. 55 to 58) positions the electroacoustic transducer 2L closer to the front than the auricle 101L, and at the same time, the band part 61 positions the rear electroacoustic transducer 62L closer to the rear side of the auricle 101L.

An audio signal for a rear channel in a multi-channel sound source such as 4-channel and 5.1-channel is configured to be supplied to the rear electroacoustic transducer 62L. Furthermore, at the attachment part of the band part 61 to the housing 4L, a rotation part 61CL whose configuration is similar to that of the rotation part 3CL (FIGS. 59 to 60) is arranged.

The ear speaker device 1060 (FIG. 65) can have the electroacoustic transducer 2L and the rear electroacoustic transducer 62L mounted on the head 100 of the listener by being mounted on the head 100 of the listener. At this time, the band part 61 rotates the electroacoustic transducer 2L using the rotation action of the rotation part 61CL, which can make the rear side of the tubular duct 8L abut on the entrance 102L of the external acoustic meatus.

In this manner, as similar to the ear speaker device 1001, the ear speaker device 1060 can be stably mounted to the head 100 of the listener, and can make the listener capable of listening to the excellent reproduced sound being surround sound including the sufficient low-pitched sound while providing the natural sound image localization in a state that the auricle 101L is sandwiched between the electroacoustic transducer 2L and the rear electroacoustic transducer 62L.

In addition, in the above case, the ear speaker device 1060 (FIG. 65) may have a vibrator 65 attached to the band part 61, and vibration corresponding to a deep bass component in a 5.1-channel sound source may be generated on the head 100 of the listener, for example.

The ear speaker device 1060 (FIG. 65) may have the tubular duct extended from the rear electroacoustic transducer 62L to the vicinity of the entrance 102L of the external acoustic meatus of the listener, or may have the tubular duct extended from both the electroacoustic transducer 2L and the rear electroacoustic transducer 62L to the vicinity of the entrance 102L of the external acoustic meatus of the listener, in addition to having the tubular duct 8L extended from the electroacoustic transducer 2L to the vicinity of the entrance 102L of the external acoustic meatus of the listener. In this case, a rotation part similar to the rotation part 61CL may be arranged at the attachment part of the rear electroacoustic transducer 62L of the band part 61 so as to make the tubular duct abut on the entrance 102L of the external acoustic meatus.

Figure 66:
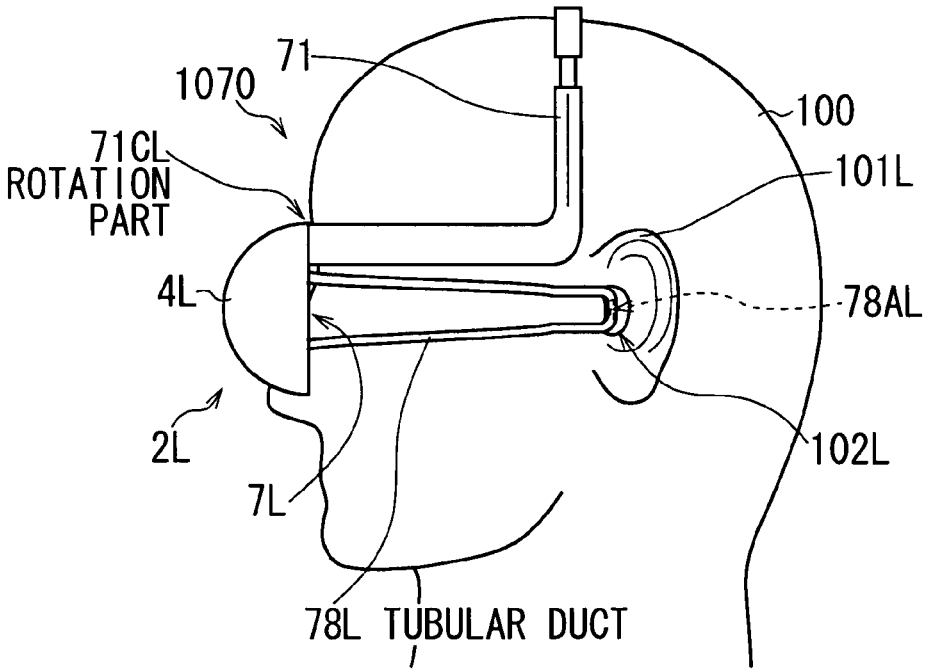
FIG. 66 is a schematic side view showing an example (6) of the configuration and the mounting of the ear speaker device according to the sixth embodiment.

Further, an ear speaker device 1070 shown in FIG. 66 has a band part 71 for connecting the electroacoustic transducers 2L and 2R on the left and the right and for positioning the electroacoustic transducers closer to the front than the cheeks of the listener attached to the housing 4L in place of the band part 3 of the ear speaker device 1001 (FIGS. 55 to 58). Furthermore, at the attachment part of the band part 71 to the housing 4L, a rotation part 71CL whose configuration is similar to that of the rotation part 3CL (FIGS. 59 to 60) is arranged.

In addition, the housing 4L has a tubular duct 78L extended from the housing 4L to the vicinity of the entrance 102L of the external acoustic meatus of the listener provided thereto in place of the tubular duct 8L. The tubular duct 78L has its inner diameter, path length of a sound, and so on appropriately calculated so as to emit the excellent low-pitched sound of the reproduced sound from the hole 78AL.

The ear speaker device 1070 (FIG. 66) can position the housing 4L closer to the front than the cheek of the listener by being mounted on the head 100 of the listener. At this time, the band part 71 rotates the electroacoustic transducer 2L using the rotation action of the rotation part 71CL, which can make the rear side of the tubular duct 78L abut on the entrance 102L of the external acoustic meatus.

In this manner, as similar to the ear speaker device 1001, the ear speaker device 1070 can be stably mounted to the head 100 of the listener. In this case, the middle-pitched and the high-pitched sounds emitted from the speaker unit 7L have their characteristic changed by being reflected on the cheeks of the listener and so on. Therefore, the middle-pitched and the high-pitched sounds are made even closer to the sound emitted from the general stationary speaker as compared with the ear speaker device 1001. In this manner, the ear speaker device 1070 can make the listener capable of listening to the reproduced sound that can provide even more natural localization.

Figure 67:
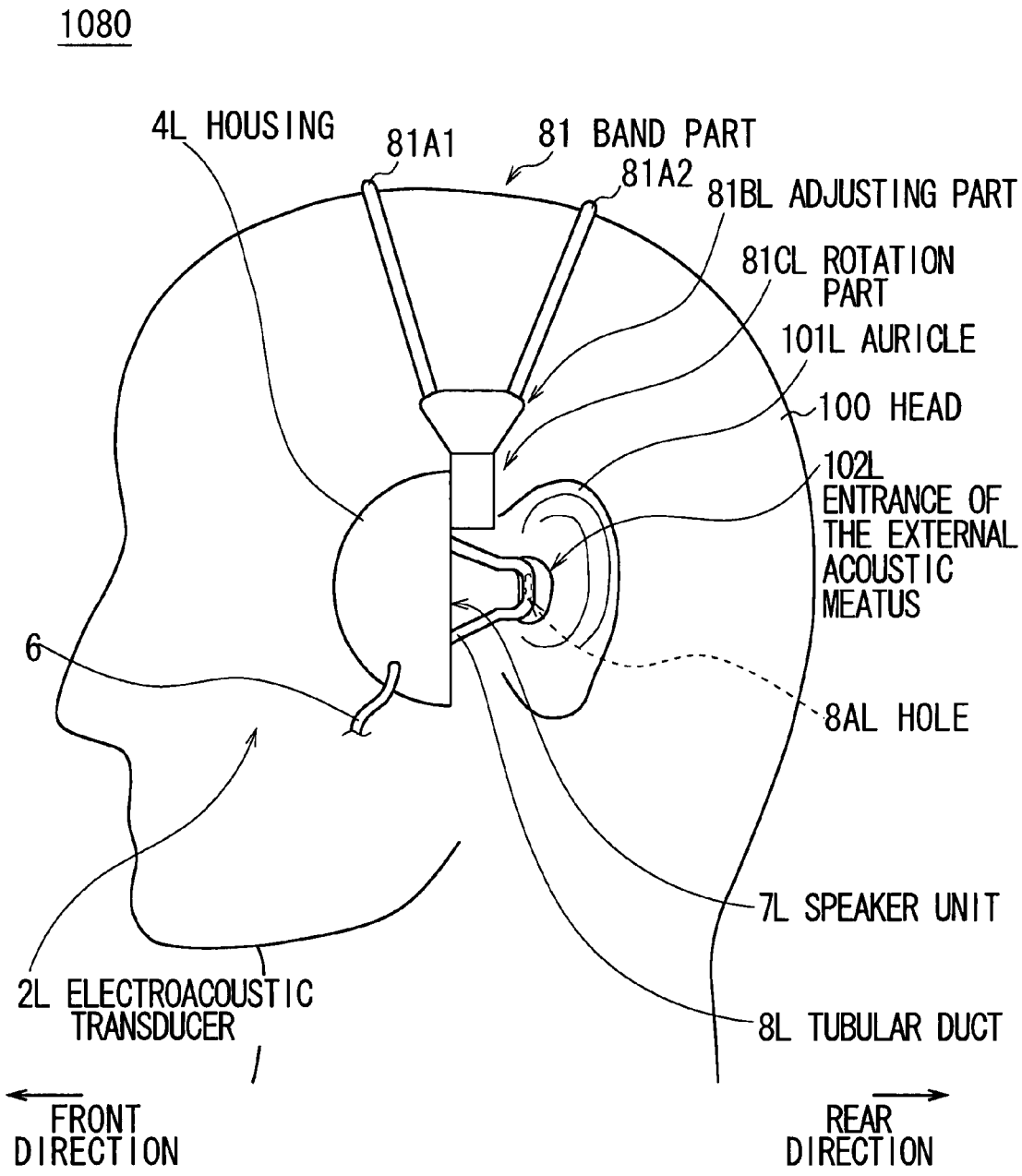
FIG. 67 is a schematic side view showing an example (7) of the configuration and the mounting of the ear speaker device according to the sixth embodiment.

Furthermore, in an ear speaker device 1080 shown in FIG. 67, a band part 81 for connecting the electroacoustic transducers 2L and 2R on the left and the right is attached to the housing 4L in place of the band part 3 of the ear speaker device 1001 (FIGS. 55 to 58). The band part 81 has two coupling bands 81A1 and 81A2 in place of the center part 3A of the band part 3 (FIGS. 55 to 58), which are expanded forward and backward from an adjusting part 81BL. Furthermore, at the attachment part of the band part 81 to the housing 4L, a rotation part 81CL whose configuration is similar to that of the rotation part 3CL (FIGS. 59 to 60) is arranged.

Accordingly, the band part 81 rotates the electroacoustic transducer 2L using the rotation action of the rotation part 81CL, which can make the rear side of the tubular duct 8L abut on the entrance 102L of the external acoustic meatus. At this time, since the coupling bands 81A1 and 81A2 of the band part 81 are expanded forward and backward of the head 100 of the listener, similar to the stabilizers 3SL and 3SR of the band part 3, the ear speaker device 1080 (FIG. 67) can stably mount the band part 81 to the head 100 of the listener, which can prevent the adjusting part 81BL from being twisted.

In this manner, as similar to the ear speaker device 1001, the ear speaker device 1080 can be stably mounted to the head 100 of the listener, and can make the listener capable of listening to the excellent reproduced sound including the sufficient low-pitched sound while providing the natural sound image localization.

In this way, according to the embodiment of the present invention, instead of the band part 3 (FIGS. 55 to 58) of the ear speaker device 1001, by employing various type of mounting parts of the ear speaker devices 1020 to 1080 (FIGS. 61 to 67), the electroacoustic transducers 2L and 2R may be mounted to the head 100 of the listener.

(7-3) Operation and Advantageous Effect in Sixth Embodiment

The band part 3 of the ear speaker device 1001 rotates the electroacoustic transducer 2L using the rotation part 3CL to push the rear side of the tubular duct 8L to the inner side. Accordingly, the ear speaker device 1001 can make the electroacoustic transducer 2L abut on the head 100 of the listener and the entrance 102L of the external acoustic meatus through the pad part 5 and the rear side of the tubular duct 8L, which can stably mount the ear speaker device 1001 to the head 100 of the listener.

The tubular duct 8L does not block the entrance 102L of the external acoustic meatus of the listener. Therefore, the ear speaker device 1001 can allow, without blocking, the surround sound generated around the listener to reach the eardrum 103L and can make the listener capable of listening to the surround sound together with the reproduced sound.

In the above manner, the ear speaker device 1001 can make the listener capable of reliably listening to the surround sound in addition to the excellent reproduction sound even in a case where the listener has to listen to the surround sound, such as when the listener is walking or playing some sports.

The ear speaker device 1001 does not cover the auricle 101L and so on of the listener by the electroacoustic transducer 2L like a closed-type headphone in the past. Therefore, the ear speaker device 1001 does not cause uncomfortableness such as a cooped-up feeling and sweatiness the listener feels when the listener wears the closed-type headphone. Further, the ear speaker device 1001 does not form closed space, therefore the ear speaker device 1001 does not generate a change of a resonance frequency in the external acoustic meatus which may be generated in a case of using the closed-type headphone, and does not make the listener uncomfortable.

In addition, the ear speaker device 1001 can make the listener capable of listening to the low-pitched sound at the sufficient sound volume level by putting the hole 8AL of the tubular duct 8L which is the emission aperture of the low-pitched sound close to the eardrum 103L. Therefore, the diameter of the speaker unit 7L does not have to be made larger than necessary, and size of the housing 4L can be limited to be minimum. In this manner, the entire size and mass of the speaker device 1001 can be limited to be minimum, therefore troublesomeness caused by the size and the mass of the ear speaker device 1001 when the listener wears the ear speaker device 1001 can be restricted as much as possible.

According to the configuration described above, the ear speaker device 1001 positions the speaker unit 7L of the electroacoustic transducer 2L somewhat closer to the front than the entrance 102L of the external acoustic meatus of the listener when the ear speaker device 1001 is mounted on the head 100 of the listener. At the same time, the reproduced sound is output in a state that the hole 8AL of the tubular duct 8L is positioned in the vicinity of the entrance 102L of the external acoustic meatus. In this manner, the ear speaker device 1001 can allow the low-pitched sound emitted from the hole 8AL of the tubular duct 8L working as the bass reflex duct to reach the eardrum 103 at the sufficient sound pressure level. Therefore, the ear speaker device 1001 can make the listener capable of listening to the excellent reproduced sound having the sufficient sound pressure level down to the comparatively low frequencies while providing the natural sound image localization.

(8) Seventh Embodiment (8-1) Configuration of Ear Speaker Device

Figure 68:
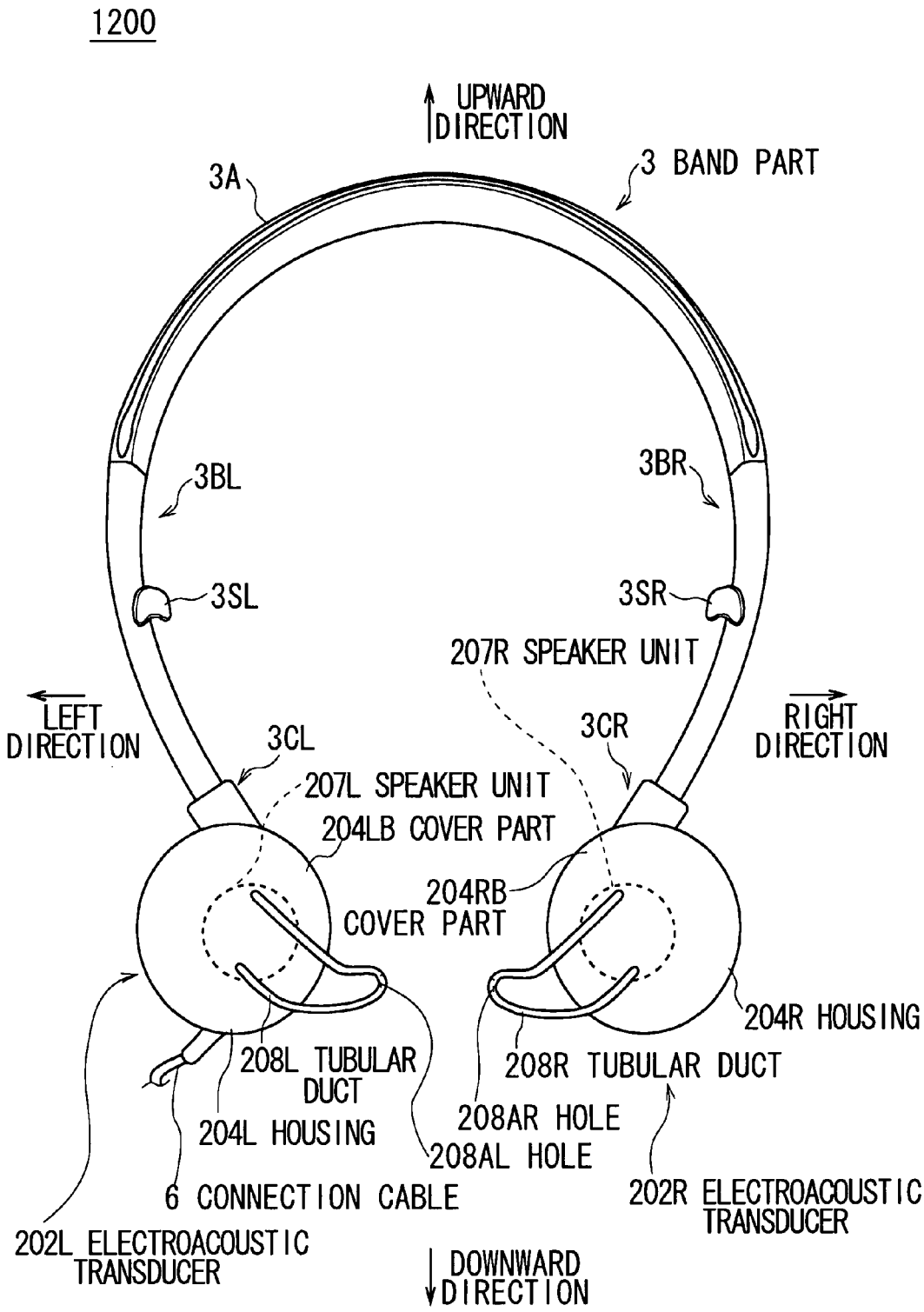
FIG. 68 is a schematic perspective view showing an entire configuration of an ear speaker device according to a seventh embodiment.
Figure 69:
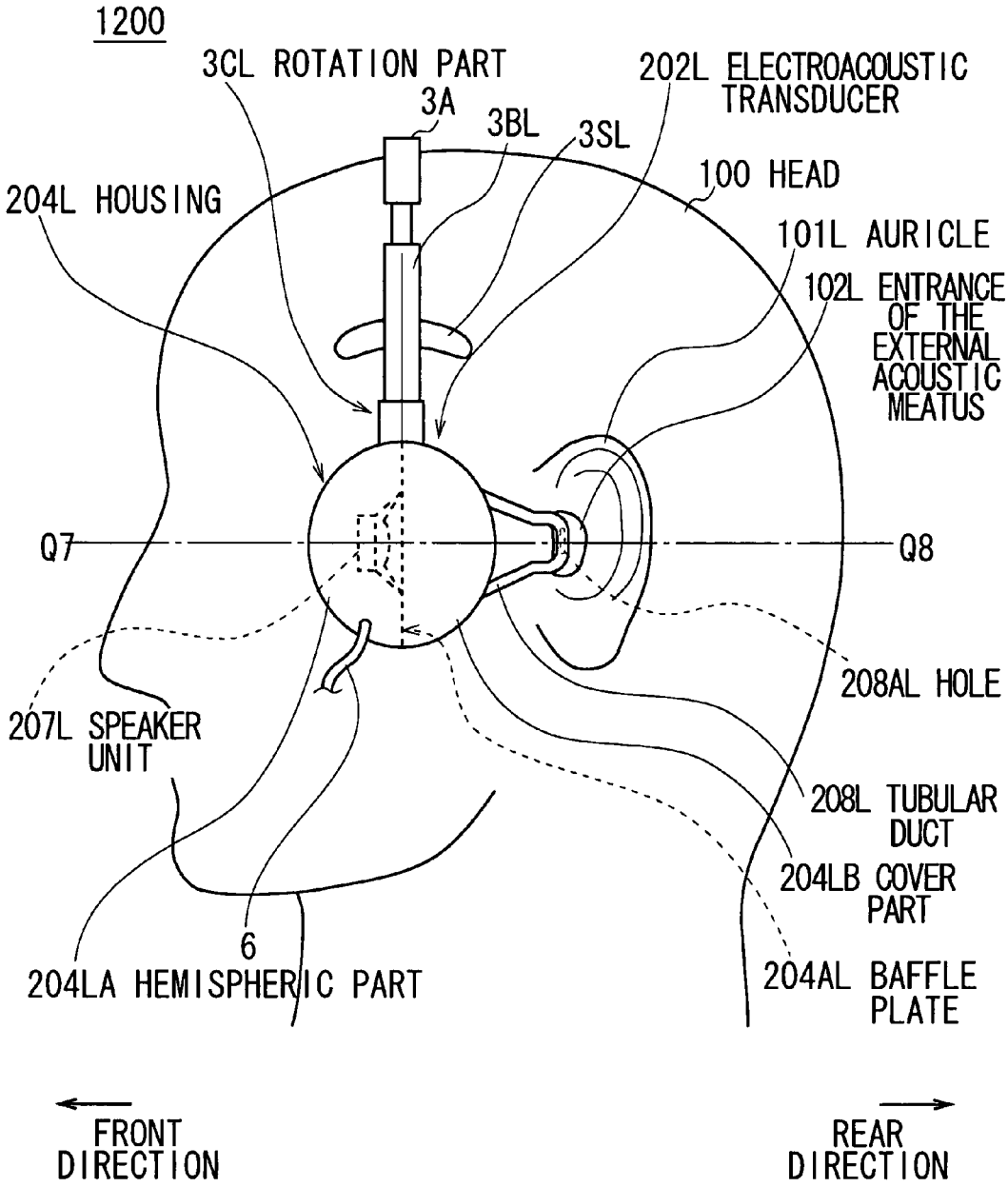
FIG. 69 is a schematic side view showing a mounting state (1) of the ear speaker device according to the seventh embodiment.

As shown in FIGS. 68 and 69 in which a corresponding part is attached to with the same numerical number as found in FIGS. 22 and 23, the numerical number 1200 refers to an entire ear speaker device according to the seventh embodiment which converts an audio signal generated by the reproduction processing etc. of a portable CD player or a DMP to a reproduced sound, and makes a listener listen to the reproduced sound.

The ear speaker device 1200 is different from the ear speaker device 200 shown in FIGS. 22 and 23 in the following points. That is, similar to the sixth embodiment, the ear speaker device 1200 has rotation parts 3CL and 3CR at the connection points between the band part 3 and housings 204L and 204R, which connection points are located at the under-part of the adjusting parts 3BL and 3BR. The rotation part 3CL has the internal configuration shown in FIGS. 59 and 60, similar to the sixth embodiment.

At the inner side of the adjusting parts 3BL and 3BR of the band part 3, stabilizers 3SL and 3SR in the form of an ellipse plate respectively are so attached as to intersect the adjusting parts 3BL and 3BR.

Since the ear speaker device 1200 is symmetrically configured, mainly the electroacoustic transducer 202L of the left side will be explained.

In practice, since the ear speaker device 1200 (FIG. 69) is mounted to the head 100 of the listener after the length of the band part 3 is adjusted, the electroacoustic transducer 202L attached to the lower end side of the adjusting part 3BL can be located somewhat at the front of the auricle 101L of the of the head 100 of the listener.

In this way, when the ear speaker device 1200 is normally mounted to the listener through the band part 3, the speaker unit 207L of the housing 204L is located somewhat at the front of the auricle 101L and entrance 102L of the external acoustic meatus, and the hole 208AL of the tubular duct 208L of the cover part 204LB is positioned in the vicinity of the entrance 102L of the external acoustic meatus.

When the ear speaker device 1200 is mounted to the head 100 of the listener, similar to the sixth embodiment, the rear side of the tubular duct 208L is expanded outward as compared with the natural state. Accordingly, the rotation part 3CL applies force of returning to the natural state, that is, turning force to push the rear side of the tubular duct 208L to the inner side.

Accordingly, the electroacoustic transducer 202L abuts on the vicinity of the temple of the listener through the rotation part 3CL, and the rear side of the tubular duct 208L abuts on the entrance 102L of the external acoustic meatus of the listener.

Furthermore, as shown in FIG. 69, since the stabilizer 3SL abuts on the head 100 of the listener in the forward and backward direction, the band part 3 can be mounted to the head 100 stably, which can prevent the band part 3 from being twisted unnecessarily by the turning force of the rotation part 3CL.

As a result, when the ear speaker device 1200 is correctly mounted to the head 100 of the listener, the center part 3A of the band part 3, adjusting part 3BL, rotation part 3CL, and also the stabilizer 3SL abut on the head 100, temple, etc., and the rear side of the tubular duct 208L abuts on the entrance 102L of the external acoustic meatus, which can stably fix the ear speaker device 1200 to the head 100 of the listener.

Therefore, the ear speaker device 1200 can allow mainly the middle-pitched and the high-pitched sounds emitted from the speaker unit 207L to reach the inside of the external acoustic meatus of the listener directly via the cover part 204LB and the tubular duct 208L. In this manner, the ear speaker device 1200 can provide the natural sound image localization in a state of less sound leakage of the middle-pitched and the high-pitched sounds than when the sounds are listened to via the general stationary speaker.

The tubular duct 208L has its end part formed in a substantial U-shape on its side surface, and therefore is configured so as not to enter into the inside of the external acoustic meatus of the listener. In this manner, the ear speaker device 1200 is configured so as to be able to prevent the end part of the tubular duct 208L from hurting the inside of the external acoustic meatus in error when the listener mounts the ear speaker device 1200, and so on.

Figure 70:
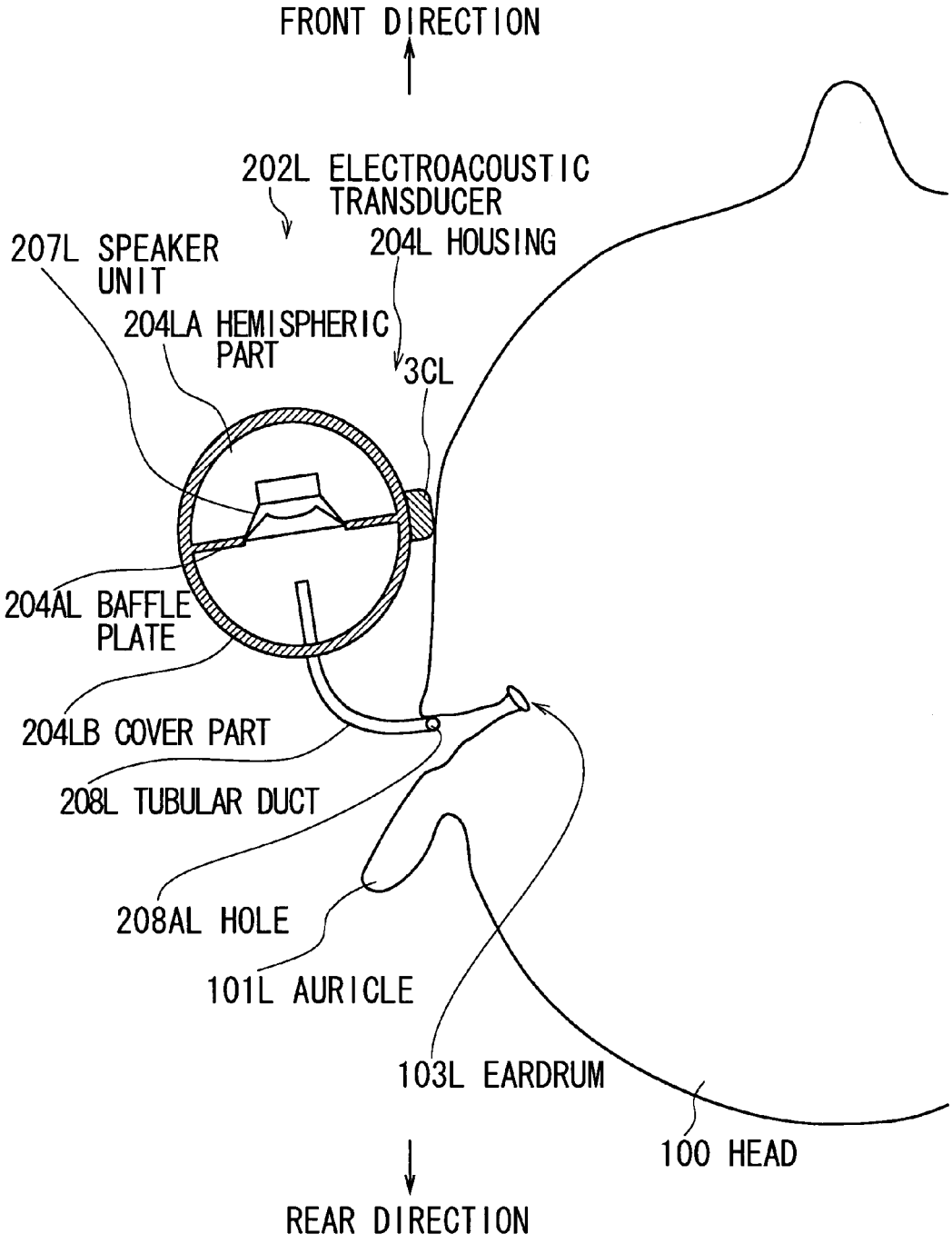
FIG. 70 is a schematic cross-sectional top view showing the mounting state (2) of the ear speaker device according to the seventh embodiment.

Here, as a cross section cut along the line Q7-Q8 in FIG. 69 is shown in FIG. 70, the housing 204L of the electroacoustic transducer 202L has the front space of the speaker unit 207L forming closed space excluding the hole 208AL of the tubular duct 208L. The cover part 204LB and the tubular duct 208L form a resonant circuit with respect to the speaker unit 207L.

In addition, the tubular duct 208L reaches the vicinity of the entrance 102L of the external acoustic meatus of the listener via the cover part 204LB of the housing 204L from the inside of the housing 204L. In practice, the electroacoustic transducer 202L gathers mainly the middle-pitched and the high-pitched sounds emitted from a front surface of the speaker unit 207L via the cover part 204LB and the tubular duct 208L, and allows the middle-pitched and the high-pitched sounds to directly reach the eardrum 103 of the listener from the hole 208AL of the tubular duct 208L. In this manner, the middle-pitched and the high-pitched sounds at a sufficient sound level can be listened to by the listener in a state where there is little sound leakage.

The tubular duct 208L is formed in a substantial U-shape on its side surface. Therefore, effective length of the tubular duct 208L can be set shorter as compared with a case where one tubular duct is used. Also, design and safety of the tubular duct 208L can be significantly improved.

(8-2) Configuration Example of Another Ear Speaker Device

As shown in FIGS. 68 to 70, the ear speaker device 1200 according to the seventh embodiment is configured so as to mount the electroacoustic transducers 202L and 202R on the head 100 of the listener by the band part 3 as the mounting part. However, the electroacoustic transducers 202L and 202R may be mounted on the head 100 of the listener by using a variety of other mounting parts in place of the band part 3.

Hereinafter, description will be made by mainly taking the electroacoustic transducer 202L on the left side as an example as similar to the case of the ear speaker device 1200 described above. With respect to the electroacoustic transducer 202R on the right side, a configuration is made in a manner symmetrical to the electroacoustic transducer 202L on the left side.

Figure 71:
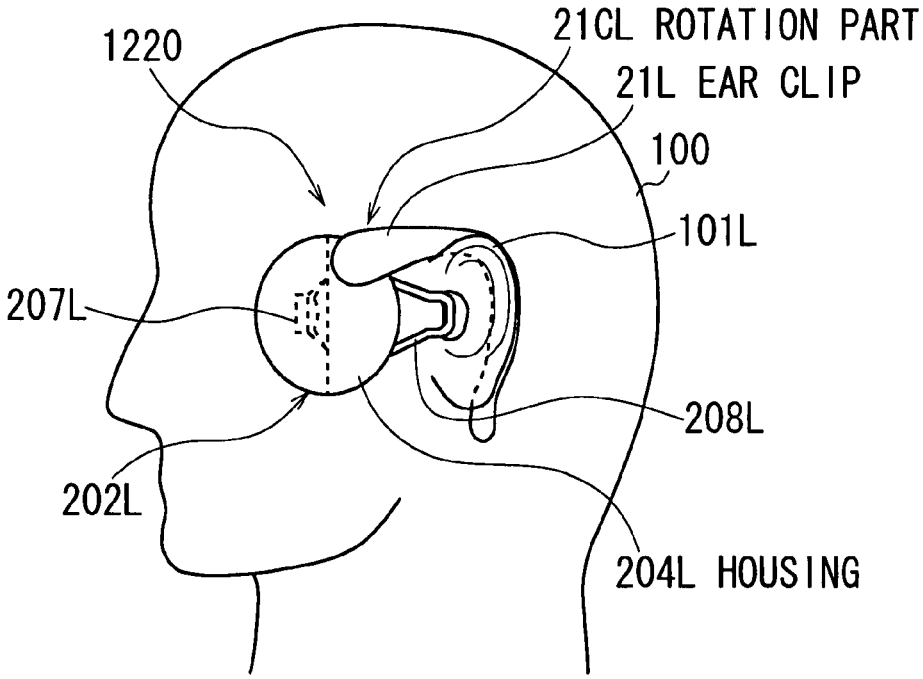
FIG. 71 is a schematic side view showing an example (1) of a configuration and mounting of the ear speaker device according to the seventh embodiment.

For example, as shown in FIG. 71 in which a corresponding part is attached to with the same numerical number as found in FIG. 61, there may be considered an ear speaker device 1220 which is configured as a so-called ear-clip type. In the ear speaker device 1220, an ear clip 21L to be hung on an auricle 101L of the listener is attached to the housing 204L of the electroacoustic transducer 202L in place of the band part 3 in the ear speaker device 1200 (FIGS. 68 to 70) in the seventh embodiment. Furthermore, at the attachment part of the ear clip 21L to the housing 204L, a rotation part 21CL is arranged.

In the ear speaker device 1220 (FIG. 71), the electroacoustic transducer 202L is rotated using the rotation action of the rotation part 21CL, which can make the rear side of the tubular duct 208L abut on the entrance 102L of the external acoustic meatus so as to stably mount the ear speaker device 1220. Furthermore, the ear speaker device 1220 can allow mainly the middle-pitched and the high-pitched sounds emitted from the speaker unit 207L to reach the inside of the external acoustic meatus of the listener directly via the cover part 204LB and the tubular duct 208L. In this manner, the ear speaker device 1220 can provide the natural sound image localization in a state of less sound leakage of the middle-pitched and the high-pitched sounds than when the sounds are listened to via the general stationary speaker.

Figure 72:
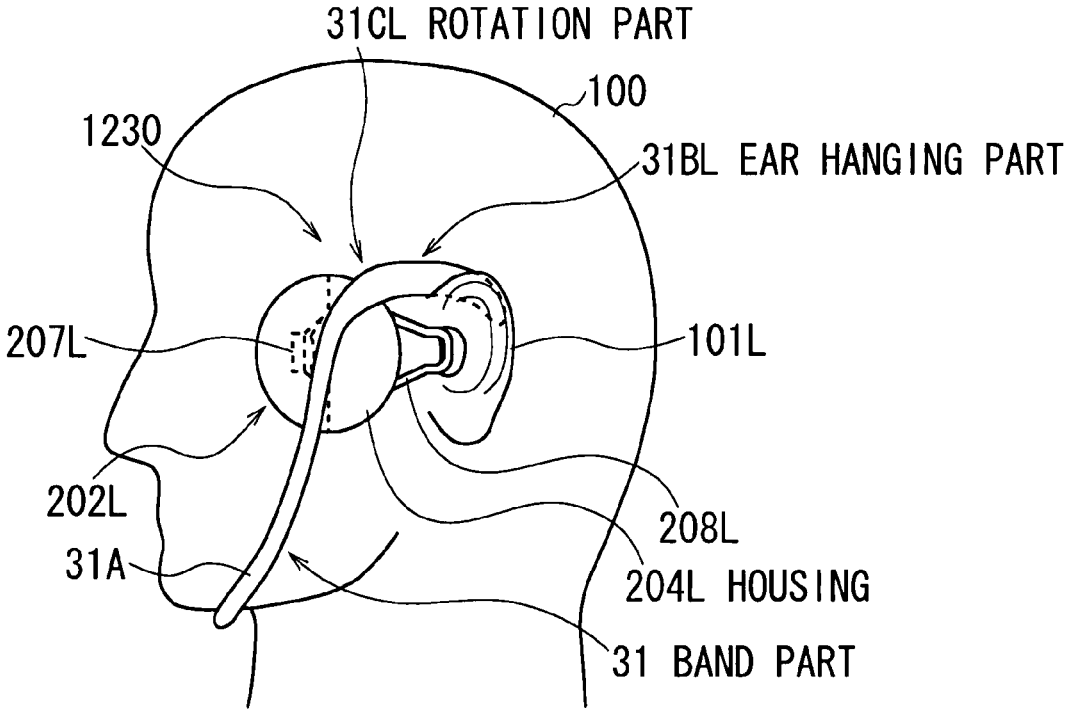
FIG. 72 is a schematic side view showing an example (2) of the configuration and the mounting of the ear speaker device according to the seventh embodiment.

Furthermore, as shown in FIG. 72 in which a corresponding part is attached to with the same numerical number as found in FIG. 62, there may be considered an ear speaker device 1230 which is configured as a so-called under-chin type. In the ear speaker device 1230, a band part 31 for connecting the electroacoustic transducers 202L and 202R on the left and the right of the ear speaker device 1200 (FIGS. 68 to 70) in the seventh embodiment and being hung on the auricle 101L of the listener is attached to the housing 204L of the electroacoustic transducer 202L in place of the band part 3 of the ear speaker device 1200. Furthermore, at the attachment part of the band part 31 to the housing 204L, a rotation part 31CL is arranged.

In the ear speaker device 1230 (FIG. 72), the electroacoustic transducer 202L is rotated using the rotation action of the rotation part 31CL, which can make the rear side of the tubular duct 208L abut on the entrance 102L of the external acoustic meatus so as to stably mount the ear speaker device 1230. Furthermore, the ear speaker device 1230 can allow mainly the middle-pitched and the high-pitched sounds emitted from the speaker unit 207L to reach the inside of the external acoustic meatus of the listener directly via the cover part 204LB and the tubular duct 208L. In this manner, the ear speaker device 1230 can provide the natural sound image localization in a state of less sound leakage of the middle-pitched and the high-pitched sounds than when the sounds are listened to via the general stationary speaker.

Figure 73:
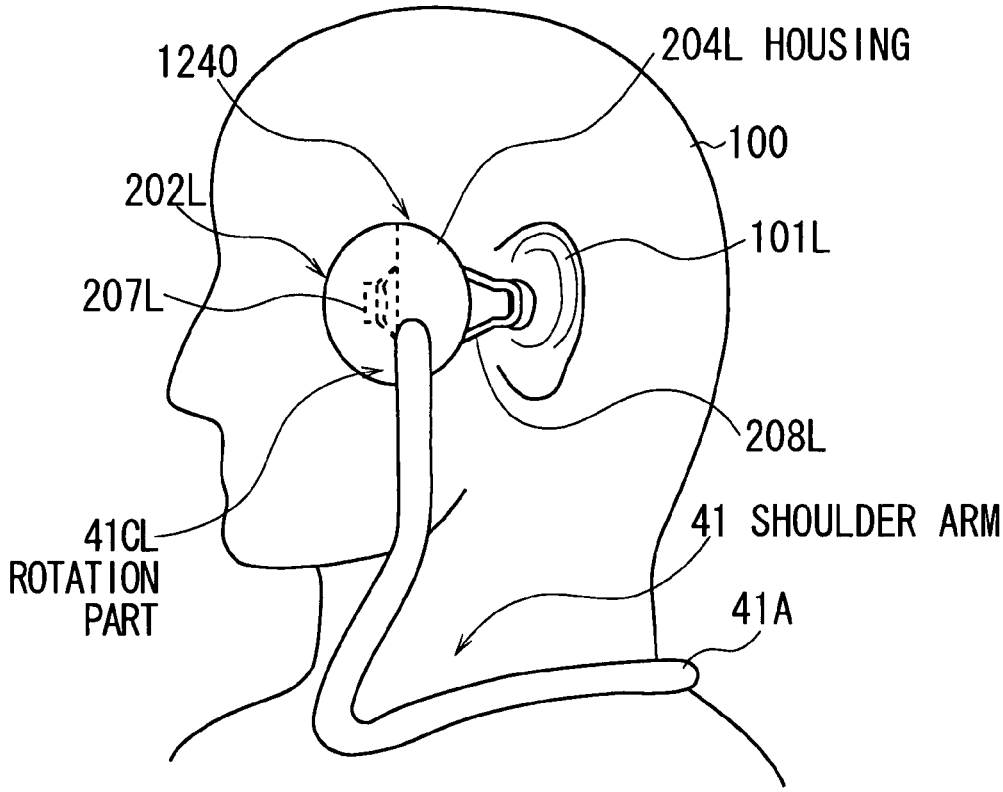
FIG. 73 is a schematic side view showing an example (3) of the configuration and the mounting of the ear speaker device according to the seventh embodiment.

Furthermore, as shown in FIG. 73 in which a corresponding part is attached to with the same numerical number as found in FIG. 63, there may be considered an ear speaker device 1240 which is configured as a so-called shoulder-hold type. In the ear speaker device 1240, a shoulder arm 41 for connecting the electroacoustic transducers 202L and 202R on the left and the right of the ear speaker device 1200 (FIGS. 68 to 70) in the seventh embodiment and for supporting the ear speaker device 1240 at a shoulder part of the listener is attached to the housing 204L of the electroacoustic transducer 202L in place of the band part 3 of the ear speaker device 1200. Furthermore, at the attachment part of the shoulder arm 41 to the housing 204L, a rotation part 41CL is arranged.

In the ear speaker device 1240 (FIG. 73), the electroacoustic transducer 202L is rotated using the rotation action of the rotation part 41CL, which can make the rear side of the tubular duct 208L abut on the entrance 102L of the external acoustic meatus so as to stably mount the ear speaker device 1240. Furthermore, the ear speaker device 1240 can allow mainly the middle-pitched and the high-pitched sounds emitted from the speaker unit 207L to reach the inside of the external acoustic meatus of the listener directly via the cover part 204LB and the tubular duct 208L. In this manner, the ear speaker device 1240 can provide the natural sound image localization in a state of less sound leakage of the middle-pitched and the high-pitched sounds than when the sounds are listened to via the general stationary speaker.

Figure 74:
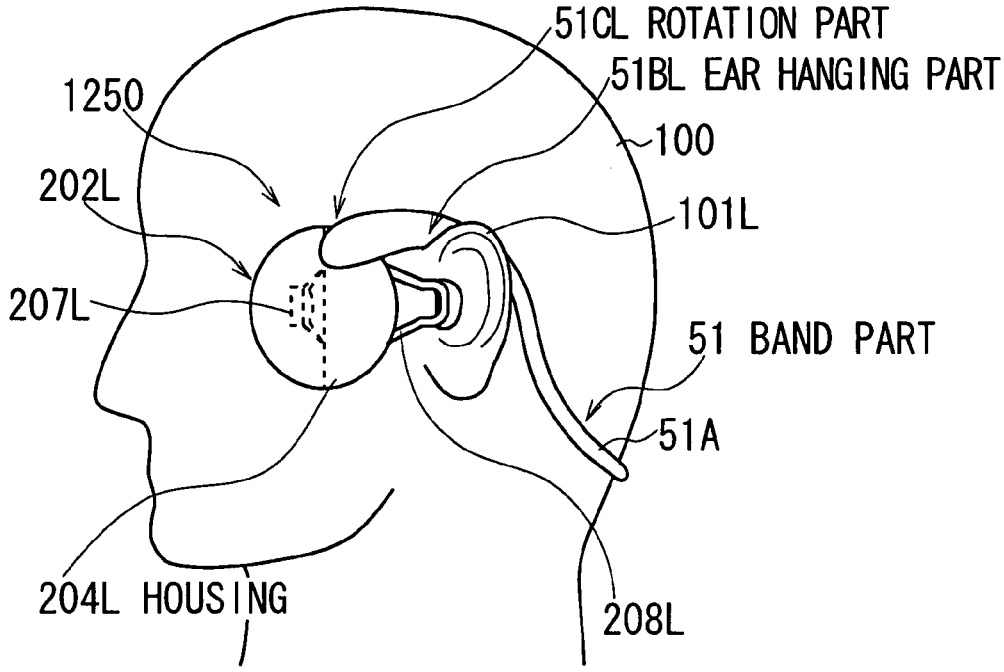
FIG. 74 is a schematic side view showing an example (4) of the configuration and the mounting of the ear speaker device according to the seventh embodiment.

Furthermore, as shown in FIG. 74 in which a corresponding part is attached to with the same numerical number as found in FIG. 64, there may be considered an ear speaker device 1250 which is configured as a so-called neck-band type. In the ear speaker device 1250, a band part 51 for connecting the electroacoustic transducers 202L and 202R on the left and the right of the ear speaker device 1200 (FIGS. 68 to 70) in the seventh embodiment and for being hung on the auricle 101L of the listener is attached to the housing 204L of the electroacoustic transducer 202L in place of the band part 3 of the ear speaker device 1200. Furthermore, at the attachment part of the band part 51 to the housing 204L, a rotation part 51CL is arranged.

In the ear speaker device 1250 (FIG. 74), the electroacoustic transducer 202L is rotated using the rotation action of the rotation part 51CL, which can make the rear side of the tubular duct 208L abut on the entrance 102L of the external acoustic meatus so as to stably mount the ear speaker device 1250. Furthermore, the ear speaker device 1250 can allow mainly the middle-pitched and the high-pitched sounds emitted from the speaker unit 207L to reach the inside of the external acoustic meatus of the listener directly via the cover part 204LB and the tubular duct 208L. In this manner, the ear speaker device 1250 can provide the natural sound image localization in a state of less sound leakage of the middle-pitched and the high-pitched sounds than when the sounds are listened to via the general stationary speaker.

Figure 75:
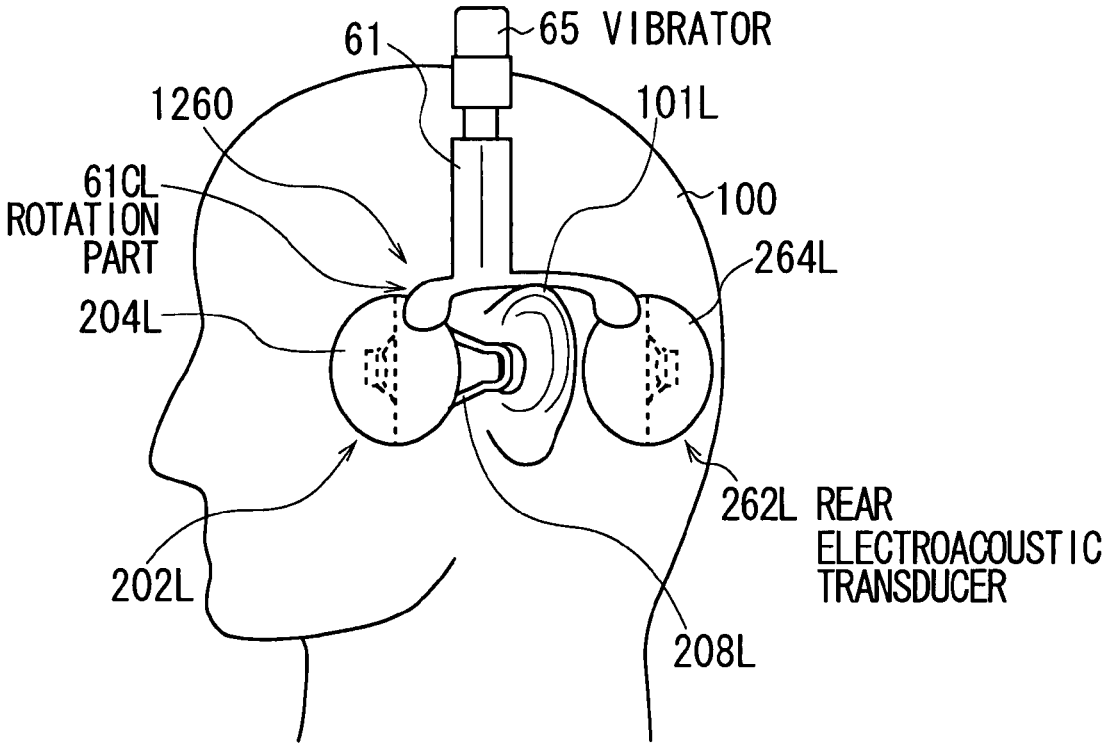
FIG. 75 is a schematic side view showing an example (5) of the configuration and the mounting of the ear speaker device according to the seventh embodiment.

Further, as shown in FIG. 75 in which a corresponding part is attached to with the same numerical number as found in FIG. 65, an ear speaker device 1260 has a rear electroacoustic transducer 262L having a similar configuration as the electroacoustic transducer 202L in addition to the electroacoustic transducer 202L of the ear speaker device 1200 (FIGS. 68 to 70) in the seventh embodiment. A band part 61 in place of the band part 3 in the ear speaker device 1200 (FIGS. 68 to 70) positions the electroacoustic transducer 202L closer to the front than the auricle 101L, and at the same time, the band part 61 positions the rear electroacoustic transducer 262L closer to the rear side of the auricle 101L.

An audio signal for a rear channel in a multi-channel sound source such as 4-channel and 5.1-channel is configured to be supplied to the rear electroacoustic transducer 262L. Furthermore, at the attachment part of the band part 61 to the housing 204L, a rotation part 61CL is arranged.

The ear speaker device 1260 (FIG. 75) can have the electroacoustic transducer 202L and the rear electroacoustic transducer 262L mounted on the head 100 of the listener by being mounted on the head 100 of the listener. At this time, the band part 61 rotates the electroacoustic transducer 202L using the rotation action of the rotation part 61CL, which can make the rear side of the tubular duct 208L abut on the entrance 102L of the external acoustic meatus, making it possible to stably mount the ear speaker device 1260.

In this manner, the ear speaker device 1260 can make the listener capable of listening to the excellent reproduced sound being surround sound including the sufficient low-pitched sound while providing the natural sound image localization in a state that the auricle 101L is sandwiched between the electroacoustic transducer 202L and the rear electroacoustic transducer 262L.

In addition, in the above case, the ear speaker device 1260 (FIG. 75) may have a vibrator 65 attached to the band part 61, and vibration corresponding to a deep bass component in a 5.1-channel sound source may be generated on the head 100 of the listener, for example.

The ear speaker device 1260 (FIG. 75) may have the tubular duct extended from the rear electroacoustic transducer 262L to the vicinity of the entrance 102L of the external acoustic meatus of the listener, or may have the tubular duct extended from both the electroacoustic transducer 202L and the rear electroacoustic transducer 262L to the vicinity of the entrance 102L of the external acoustic meatus of the listener, in addition to having the tubular duct 208L extended from the electroacoustic transducer 202L to the vicinity of the entrance 102L of the external acoustic meatus of the listener. In this case, a rotation part similar to the rotation part 61CL may be arranged at the attachment part of the rear electroacoustic transducer 262L of the band part 61 so as to make the tubular duct abut on the entrance 102L of the external acoustic meatus of the listener.

Figure 76:
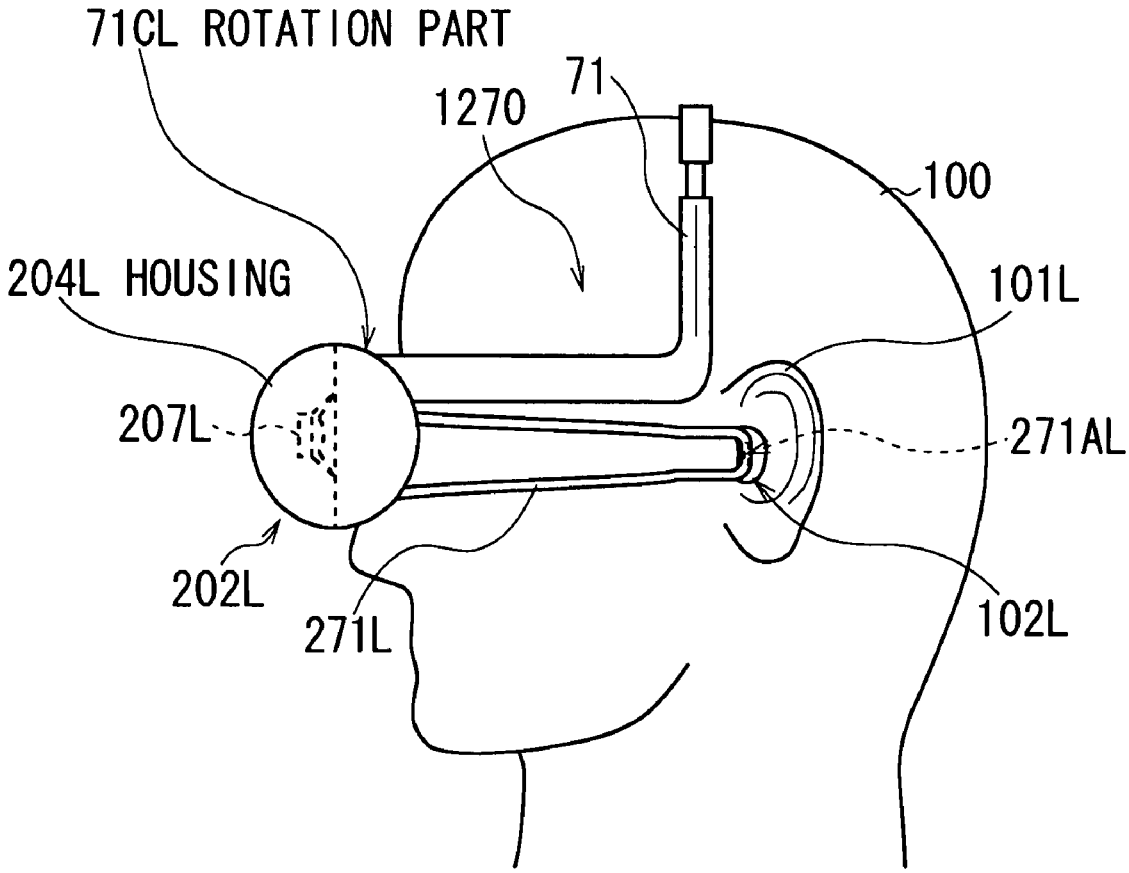
FIG. 76 is a schematic side view showing an example (6) of the configuration and the mounting of the ear speaker device according to the seventh embodiment.

Further, as shown in FIG. 76 in which a corresponding part is attached to with the same numerical number as found in FIG. 66, there may be considered an ear speaker device 1270 which has a band part 71 for positioning the electroacoustic transducer 202L of the ear speaker device 1200 (FIGS. 68 to 70) in the seventh embodiment closer to the front than the cheeks of the listener attached to the housing 204L. Furthermore, at the attachment part of the band part 71 to the housing 4L, a rotation part 71CL is arranged.

In addition, the housing 204L has a tubular duct 271L extended from the housing 204L to the vicinity of the entrance 102L of the external acoustic meatus of the listener provided thereto in place of the tubular duct 208L. The tubular duct 271L has its inner diameter, path length of a sound, and so on appropriately calculated so as to emit the excellent low-pitched sound of the reproduced sound from the hole 271AL.

When the ear speaker device 1270 (FIG. 76) is mounted on the head 100 of the listener, the band part 71 rotates the electroacoustic transducer 202L using the rotation action of the rotation part 71CL, which can make the rear side of the tubular duct 208L abut on the entrance 102L of the external acoustic meatus, making it possible to stably mount the ear speaker device 1270, and can position the housing 204L closer to the front than the cheek of the listener. In this case, the middle-pitched and the high-pitched sounds emitted from the speaker unit 207L have their characteristic changed by being reflected on the cheeks of the listener and so on. Therefore, the middle-pitched and the high-pitched sounds are made even closer to the sound emitted from the general stationary speaker as compared with the ear speaker device 1200. In this manner, the ear speaker device 1270 can make the listener capable of listening to the reproduced sound that can provide even more natural localization.

In this way, according to the embodiment of the present invention, instead of the band part 3 (FIGS. 68 to 70) of the ear speaker device 1200, by employing various type of mounting parts of the ear speaker devices 1220 to 1270 (FIGS. 71 to 76), the electroacoustic transducers 202L and 202R may be mounted to the head 100 of the listener.

(8-3) Operation and Advantageous Effect in Seventh Embodiment

The band part 3 of the ear speaker device 1200 rotates the electroacoustic transducer 202L using the rotation part 3CL to push the rear side of the tubular duct 208L to the inner side. Accordingly, the ear speaker device 1200 can make the electroacoustic transducer 202L abut on the head 100 of the listener and the entrance 102L of the external acoustic meatus through the rotation part 3CL and the rear side of the tubular duct 208L, which can stably mount the ear speaker device 1200 to the head 100 of the listener.

Furthermore, the ear speaker device 1200 only positions the hole 208AL of the tubular duct 208L in the vicinity of the entrance 102L of the external acoustic meatus, and the entrance 102L of the external acoustic meatus is not blocked like a closed-type headphone in the past. Therefore, the ear speaker device 1200 can allow, without blocking, the surround sound to reach the eardrum 103L and can make the listener capable of listening to the surround sound together with the reproduced sound output from the hole 208AL of the tubular duct 208L. Accordingly, it becomes possible for the listener to listen to the surround sound while listening to the reproduced sound through the tubular duct 208L.

In the above manner, the ear speaker device 1200 can make the listener capable of reliably listening to the surround sound in addition to the reproduction sound output from the hole 208AL of the tubular duct 208L even in a case where the listener has to listen to the surround sound, such as when the listener is walking or playing some sports.

The ear speaker device 1200 does not cover the auricle 101L and so on of the listener by the electroacoustic transducer 202L. Therefore, the ear speaker device 1200 does not cause uncomfortableness such as a cooped-up feeling and sweatiness the listener feels when the listener wears the general headphone. Further, the ear speaker device 1200 does not form closed space, therefore the ear speaker device 1200 does not generate a change of a resonance frequency in the external acoustic meatus which may be generated in a case of using the closed-type headphone, and does not make the listener uncomfortable.

In addition, the ear speaker device 1200 can make the listener capable of listening to the middle-pitched and the high-pitched sounds at the sufficient sound volume level by putting the hole 208AL of the tubular duct 208L which is the emission aperture of the reproduced sound close to the eardrum 103L. Therefore, the diameter of the speaker unit 207L does not have to be made larger than necessary, and size of the housing 204L can be limited to be minimum.

In this manner, the entire size and mass of the speaker device 1200 can be limited to be minimum, therefore troublesomeness caused by the size and the mass of the ear speaker device 1200 when the listener wears the ear speaker device 1200 can be restricted as much as possible.

According to the configuration described above, the ear speaker device 1200 stably positions the speaker unit 207L of the electroacoustic transducer 202L somewhat closer to the front than the entrance 102L of the external acoustic meatus of the listener when the ear speaker device 1200 is mounted on the head 100 of the listener. Also, the ear speaker device 1200 gathers mainly the middle-pitched and the high-pitched sounds emitted from the speaker unit 207L via the cover part 204LB to the tubular duct 208L without leaking to the outside, and outputs the reproduced sound based on the sound signal from the hole 208AL of the tubular duct 208L positioned in the vicinity of the entrance 102L of the external acoustic meatus. In this manner, the ear speaker device 1200 can allow the middle-pitched and the high-pitched sounds emitted from the hole 208AL of the tubular duct 208L to reach the eardrum 103 at the sufficient sound pressure level. Therefore, the ear speaker device 1200 can make the listener capable of stably listening to the excellent reproduced sound at the sufficient sound pressure level while providing the natural sound image localization.

In above-described seventh embodiment, the band part 3 rotates the electroacoustic transducer 202L using the rotation part 3CL to make the rear side of the tubular duct 208L abut on the entrance 102L of the external acoustic meatus of the listener. However, the present invention is not limited thereto, and only the tubular duct may be rotated with respect to the housing 204L.

(9) Eighth Embodiment

(9-1) Configuration of Ear Speaker Device

Figure 77:
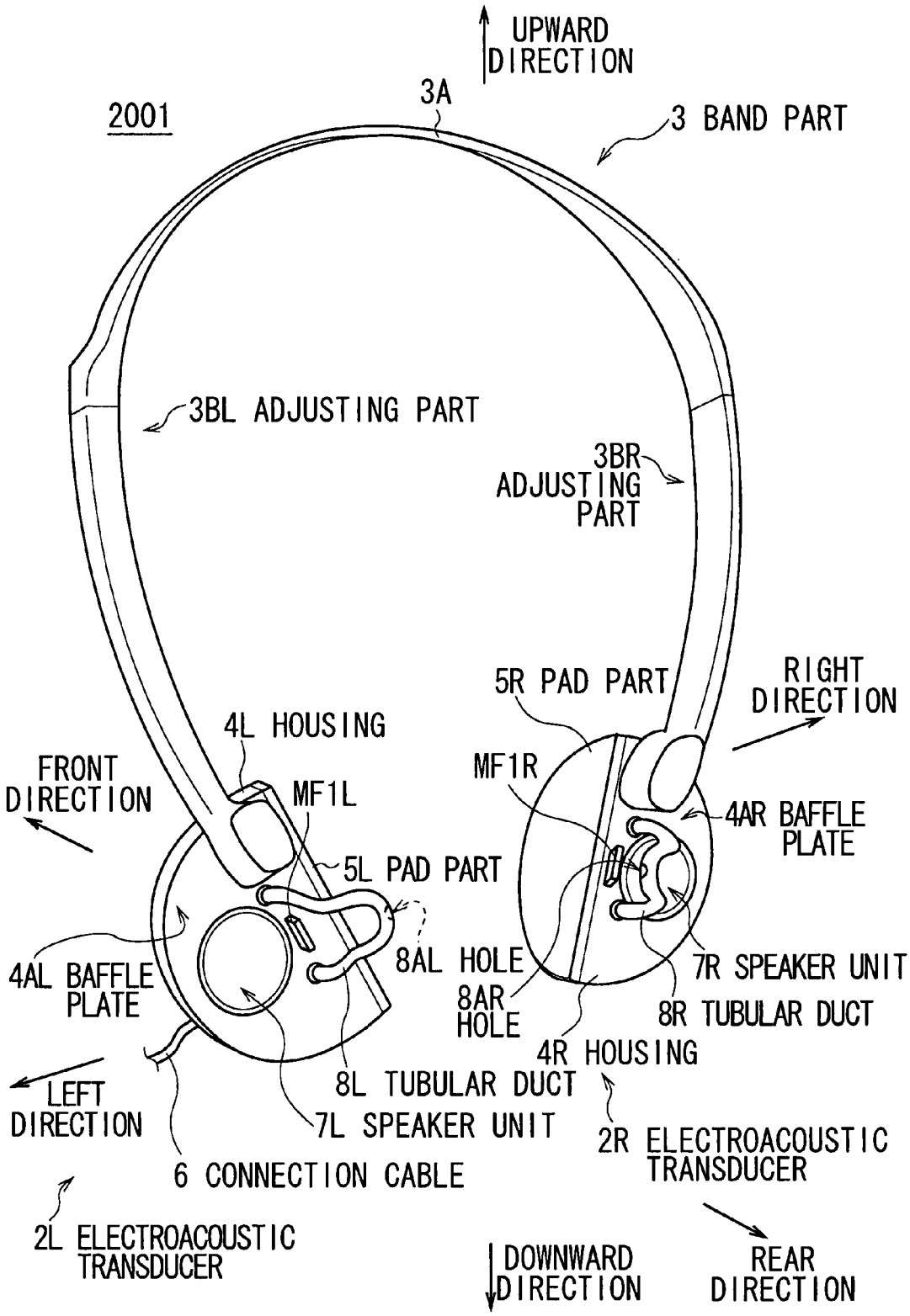
FIG. 77 is a schematic perspective view showing an entire configuration (1) of an ear speaker device according to an eighth embodiment.
Figure 78:
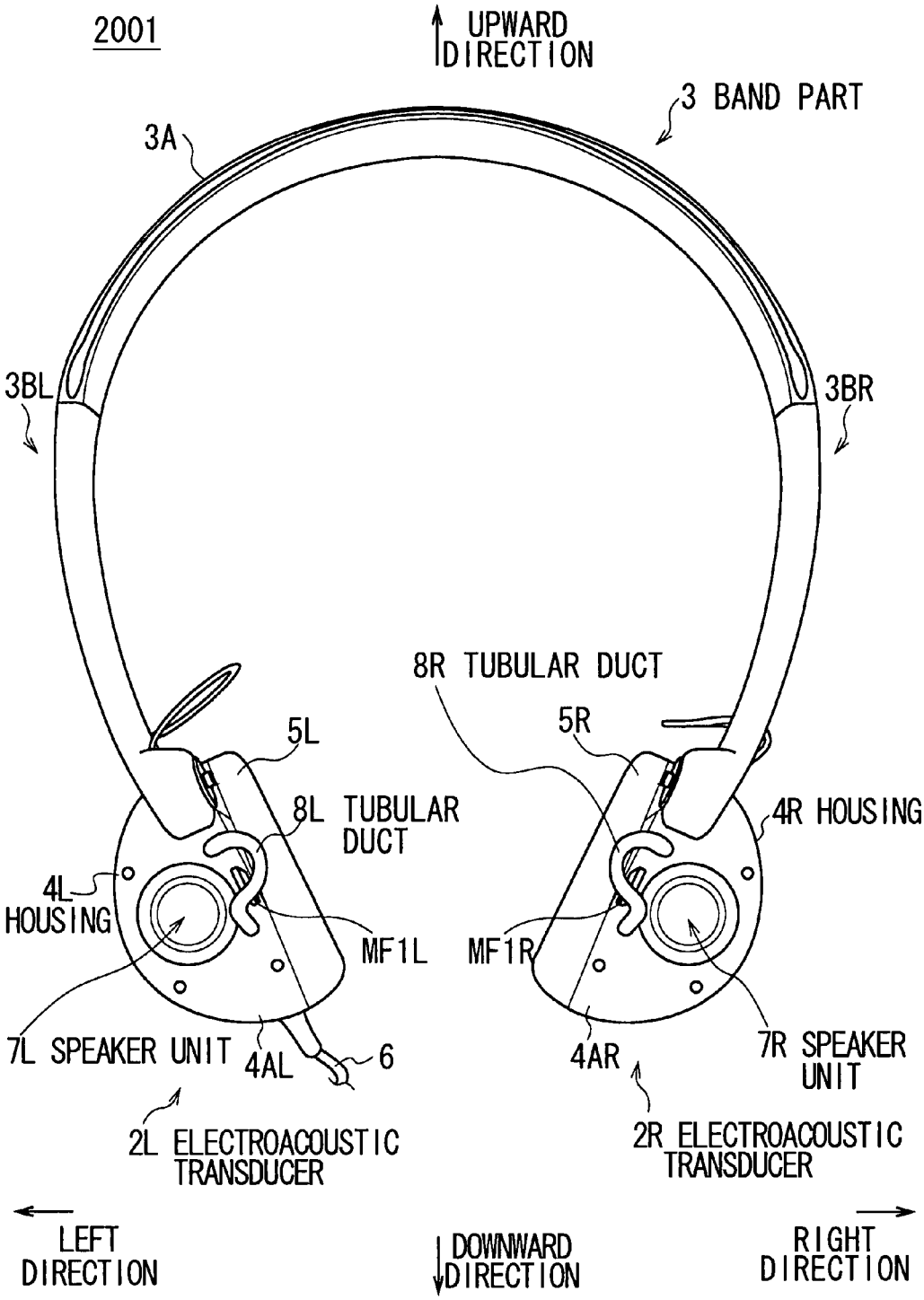
FIG. 78 is a schematic rear view showing the entire configuration (2) of the ear speaker device according to the eighth embodiment.

As shown in FIGS. 77 and 78 in which a corresponding part is attached to with the same numerical number as found in FIGS. 1 and 2, the numerical number 2001 refers to an entire ear speaker device according to the eighth embodiment which converts an audio signal generated by the reproduction processing etc. of a portable compact disc (CD) player or a digital music Player (DMP) to a reproduced sound, and makes a listener listen to the reproduced sound.

The ear speaker device 2001 has, in addition to the configuration of the ear speaker device 1 in FIGS. 1 and 2, microphones MF1L and MF1R for the binaural recording attached thereto. The microphones MF1L and MF1R for the binaural recording are attached to the housings 4L and 4R (FIGS. 77 and 78), and are located on the surfaces on which the speaker units 7L and 7R arranged on the baffle plates 4AL and 4AR are also positioned, and are located next to the speaker units 7L and 7R, being provided with no directivity.

The binaural recording is a recording method which records a sound using two microphones attached to a dummy head or real ears of the listener under the state of being influenced by the head-related transfer function.

In the binaural recording, when a recorded sound is reproduced to be output by the speaker units 7L and 7R of the ear speaker device 1, right and left sounds listened to by the dummy head or real ears of the listener are not mixed up, and reach the ears of the listener directly, which can make the listener feel the feeling of presence, or feel as if the listener himself stays the performance spot.

That is, in the binaural recording, a sound can be recorded under the state in which the listener really listens to the sound from the sound source, which can realize the ideal sound image localization.

Accordingly, by outputting a reproduced sound of sound contents which has been recorded under the binaural recording from the speaker units 7L and 7R, the ear speaker device 2001 can provide natural sound image localization and make the listener listen to an excellent reproduced sound including a sufficient low-pitched sound through the holes 8AL and 8AR of the tubular ducts 8L and 8R.

The attachment positions to which the microphones MF1L and MF1R are attached are not restricted to the places, and the microphones MF1L and MF1R, which are not provided with directivity, may be attached to any predetermined positions on the surfaces of the housings 4L and 4R which are not the surfaces on which the speaker units 7L and 7R are positioned so long as the microphones MF1L and MF1R are located in the vicinity of the speaker units 7L and 7R.

Furthermore, in the ear speaker device 2001, instead of newly arranging the microphones MF1L and MF1R for the binaural recording, microphones for canceling noise attached to the same positions may be used as the microphones MF1L and MF1R for the binaural recording by switching the mode.

Furthermore, in the ear speaker device 2001, instead of newly arranging the microphones MF1L and MF1R for the binaural recording, the speaker units 7L and 7R may be used as the microphones MF1L and MF1R for the binaural recording by switching the mode.

Furthermore, in the eighth embodiment, the microphones MF1L and MF1R are used as microphones for the binaural recording. However, the present invention is not limited thereto, and the microphones MF1L and MF1R may be used also as microphones to realize the function of canceling noise.

In this case, when making a listener listen to a reproduced sound, the ear speaker device 2001 can make the listener listen to only the reproduced sound by gathering extraneous noise using the microphones MF1L and MF1R and generating and outputting a sound whose phase is opposite to that of the extraneous noise.

Further, in the eighth embodiment, the description was made with respect to the case where the electroacoustic transducers 2L and 2R as the electroacoustic transducer are configured by the housings 4L and 4R as the housing, the speaker units 7L and 7R as the speaker unit, the tubular ducts 8L and 8R as the tubular duct, and the microphones MF1L and MF1R as the microphone for the binaural recording. However, the present invention is not limited thereto, and the electroacoustic transducer may be configured by the housing, the speaker unit, the tubular duct, and the microphone for the binaural recording, which have a variety of other configurations.

Further, in the eighth embodiment, the description was made with respect to the case where the ear speaker device 2001 as the ear speaker device is configured by the housings 4L and 4R as the housing, the speaker units 7L and 7R as the speaker unit, the band part 3 as the mounting part, the tubular ducts 8L and 8R as the tubular duct, and the microphones MF1L and MF1R as the microphone for the binaural recording. However, the present invention is not limited thereto, and the ear speaker device may be configured by the housing, the speaker unit, the mounting part, the tubular duct, and the microphone for the binaural recording, which have a variety of other configurations.

(10) Ninth Embodiment

(10-1) Configuration of Ear Speaker Device

Figure 79:
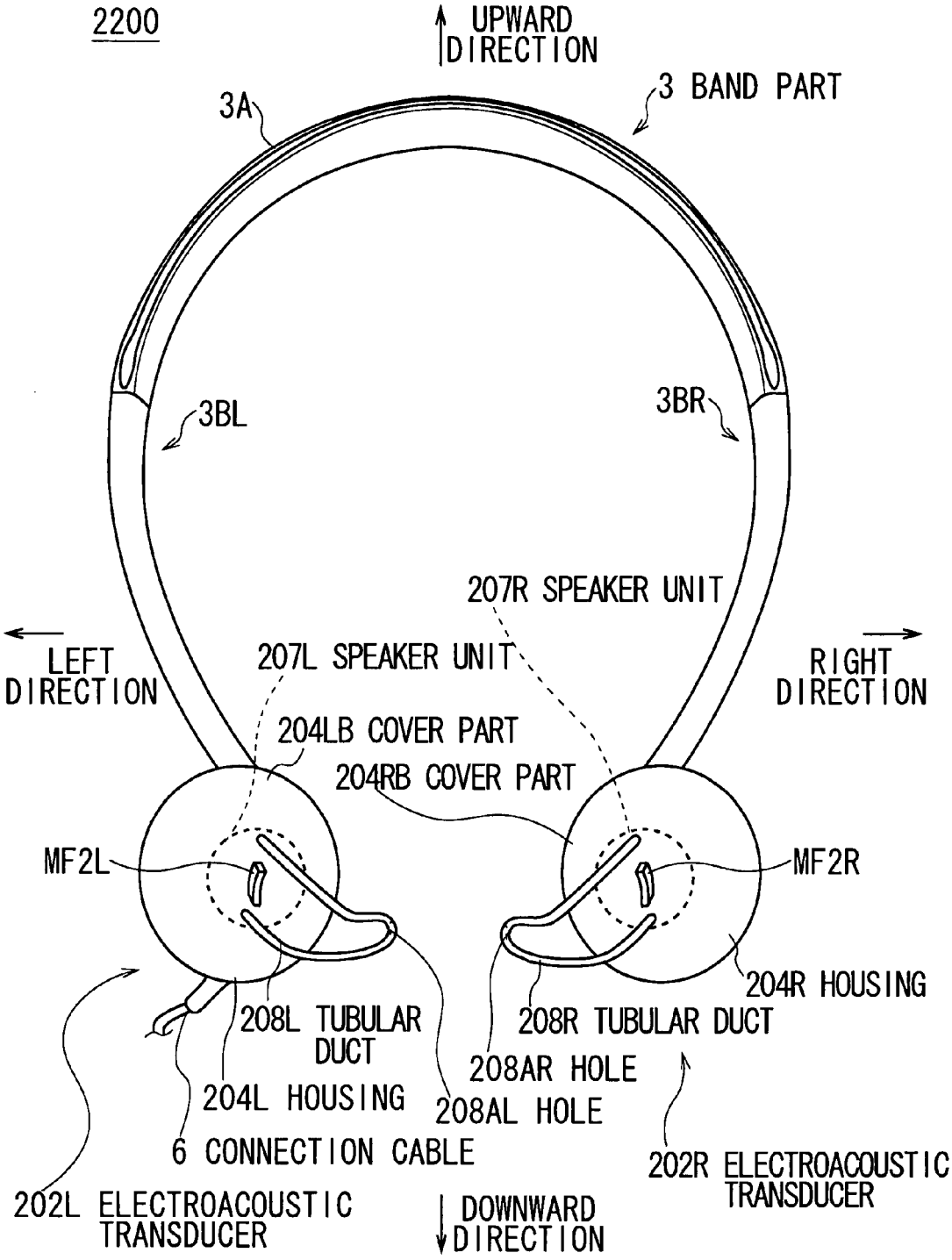
FIG. 79 is a schematic perspective view showing an entire configuration of an ear speaker device according to a ninth embodiment.
Figure 80:
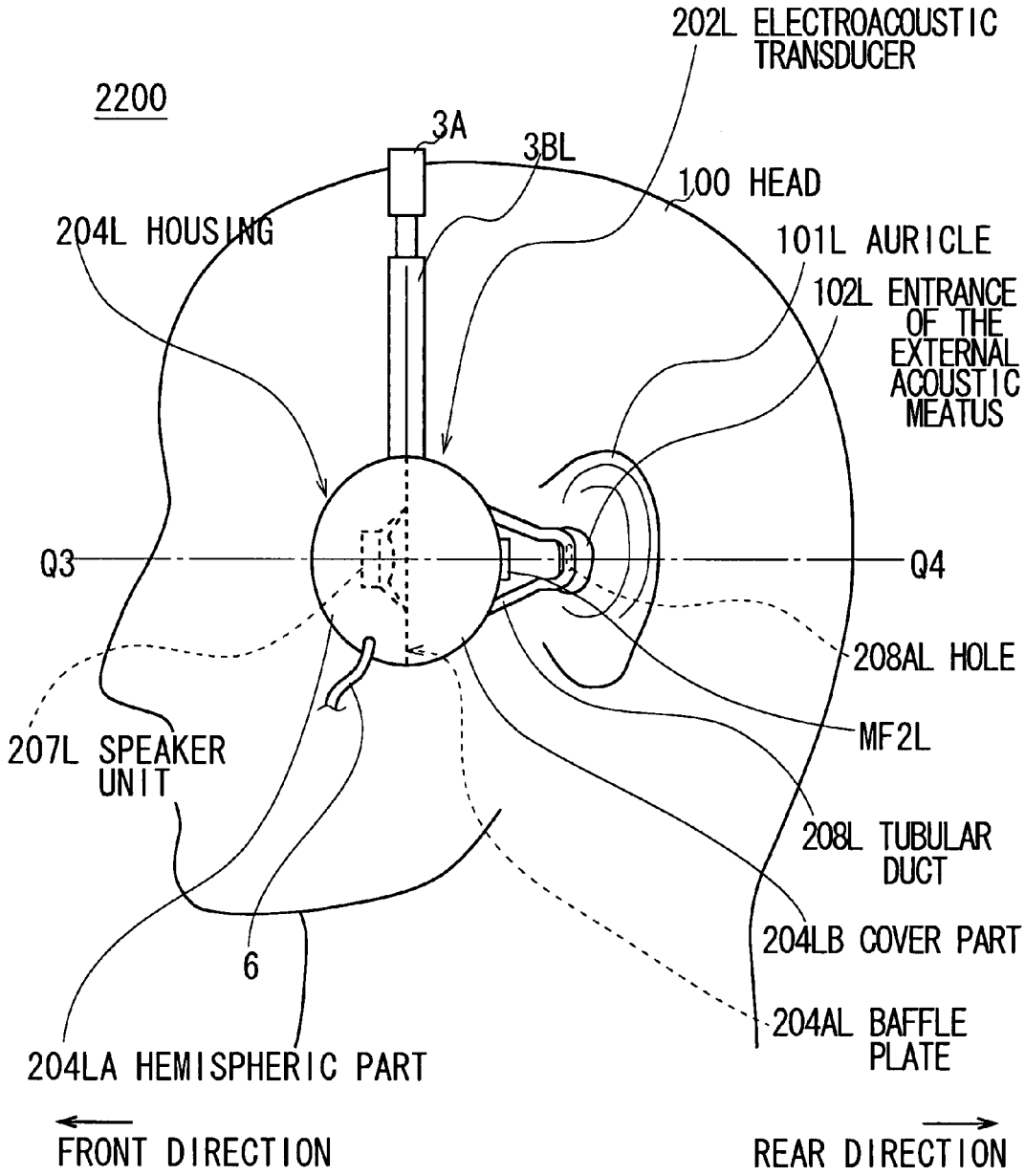
FIG. 80 is a schematic side view showing a mounting state of the ear speaker device according to the ninth embodiment.

As shown in FIGS. 79 and 80 in which a corresponding part is attached to with the same numerical number as found in FIGS. 22 and 23, the numerical number 2200 refers to an entire ear speaker device according to the ninth embodiment which converts an audio signal generated by the reproduction processing etc. of a portable CD player or a DMP to a reproduced sound, and makes a listener listen to the reproduced sound.

The ear speaker device 2200 has, in addition to the configuration of the ear speaker device 200 in FIGS. 22 and 23, microphones MF2L and MF2R for the binaural recording attached thereto. The microphones MF2L and MF2R for the binaural recording are attached to the surface of the cover parts 204LB and 204RB (FIGS. 77 and 78), and are located on positions opposite to the positions of the speaker units 7L and 7R, being provided with no directivity.

In the binaural recording, when a recorded sound is reproduced to be output by the speaker units 207L and 207R of the ear speaker device 2200, right and left sounds listened to by a dummy head or real ears of the listener are not mixed up, and reach the ears of the listener directly, which can make the listener feel the feeling of presence, or feel as if the listener himself stays the performance spot.

That is, in the binaural recording, a sound can be recorded under the state in which the listener really listens to the sound from the sound source, which can realize the ideal sound image localization.

Accordingly, by outputting a reproduced sound of sound contents which has been recorded under the binaural recording from the speaker units 207L and 207R through the tubular ducts 208L and 208R, the ear speaker device 2200 can provide natural sound image localization and make the listener listen to a reproduced sound of the middle-pitched and the high-pitched sounds in a state that there is less sound leakage through the holes 208AL and 208AR of the tubular ducts 208L and 208R.

The attachment positions to which the microphones MF2L and MF2R are attached are not restricted to the places, and the microphones MF2L and MF2R, which are not provided with directivity, may be attached to any predetermined positions on the surfaces of the cover parts 204LB and 204RB or on the surfaces of the hemispheric parts 204LA and 204RA.

Furthermore, in the ear speaker device 2200, instead of newly arranging the microphones MF2L and MF2R for the binaural recording, microphones for canceling noise attached to the same positions may be used as the microphones MF2L and MF2R for the binaural recording by switching the mode.

Furthermore, in the ear speaker device 2200, instead of newly arranging the microphones MF2L and MF2R for the binaural recording, the speaker units 207L and 207R may be used as the microphones MF2L and MF2R for the binaural recording by switching the mode.

Furthermore, in the ninth embodiment, the microphones MF2L and MF2R are used as microphones for the binaural recording. However, the present invention is not limited thereto, and the microphones MF2L and MF2R may be used also as microphones to realize the function of canceling noise.

In this case, when making a listener listen to a reproduced sound, the ear speaker device 2200 can make the listener listen to only the reproduced sound by gathering extraneous noise using the microphones MF2L and MF2R and generating and outputting a sound whose phase is opposite to that of the extraneous noise.

Further, in the ninth embodiment, the description was made with respect to the case where the electroacoustic transducers 202L and 202R as the electroacoustic transducer are configured by the housings 204L and 204R as the housing, the speaker units 207L and 207R as the speaker unit, the tubular ducts 208L and 208R as the tubular duct, and the microphones MF2L and MF2R as the microphone for the binaural recording. However, the present invention is not limited thereto, and the electroacoustic transducer may be configured by the housing, the speaker unit, the tubular duct, and the microphone for the binaural recording, which have a variety of other configurations.

Further, in the ninth embodiment, the description was made with respect to the case where the ear speaker device 2200 as the ear speaker device is configured by the housings 204L and 204R as the housing, the speaker units 207L and 207R as the speaker unit, the band part 3 as the mounting part, the tubular ducts 208L and 208R as the tubular duct, and the microphones MF2L and MF2R as the microphone for the binaural recording. However, the present invention is not limited thereto, and the ear speaker device may be configured by the housing, the speaker unit, the mounting part, the tubular duct, and the microphone for the binaural recording, which have a variety of other configurations.

The present invention can be applied to various ear speaker devices which mount a speaker device having other various kinds of duct of the backload horn type etc. other than the bass reflex type speaker to the head of the listener.

It should be understood by those skilled in the art that various modifications, combinations, sub-combinations and alterations may occur depending on design requirements and other factors insofar as they are within the scope of the appended claims or the equivalents thereof.

What is claimed is:

1. An ear speaker device, comprising:

an electroacoustic transducer including a housing mounted at a predetermined position of the head of a listener, a speaker unit that is mounted on one surface in the housing, and is positioned away from an entrance of an external acoustic meatus of the listener for a predetermined distance when the housing is mounted on the head of the listener, and a tubular duct that is extended so as to allow a sound generated by the housing in the inner space thereof to reach the vicinity of the entrance of the external acoustic meatus of the listener, and a hole in a sidewall of the tubular duct for emitting sound of the duct is oriented to the opposite direction with respect to the entrance of the external acoustic meatus; and a mounting part that is used for mounting the electroacoustic transducer on the head of the listener in a manner that the predetermined distance is provided between the speaker unit and the entrance of the external acoustic meatus of the listener.

2. The ear speaker device according to claim 1, wherein the tubular duct works as the duct of a bass reflex speaker.

3. The ear speaker device according to claim 1, wherein the tubular duct is formed in a substantial U-shape such that the tubular duct extends from the inner space of the housing to the vicinity of the entrance of the external acoustic meatus of the listener and then returns to the inner space of the housing again.

4. The ear speaker device according to claim 1, wherein the tubular duct has a protective part provided thereon for preventing an end part positioned in the vicinity of the entrance of the external acoustic meatus from entering into the inside of the external acoustic meatus of the listener.

5. The ear speaker device according to claim 1, wherein the housing orients a sound emitting surface of the speaker unit to a substantial direction of the entrance of the external acoustic meatus of the listener when the housing is mounted on the head of the listener.

6. The ear speaker device according to claim 1, wherein the mounting part has a rearward housing having attached thereto a predetermined rearward speaker unit to be positioned at the rear of the entrance of the external acoustic meatus of the listener, while the speaker unit is positioned at the front of the entrance of the external acoustic meatus of the listener when mounting the electroacoustic transducer on the head of the listener.

7. The ear speaker device according to claim 1, wherein the mounting part has mounted thereto a predetermined vibrator that applies a vibration to the head of the listener in addition to the housing.

* * * * *